US010399804B2

(12) United States Patent
Ogura et al.

(10) Patent No.: US 10,399,804 B2
(45) Date of Patent: Sep. 3, 2019

(54) PAPER SHEET CONVEYANCE DEVICE AND SEPARATION/COLLECTION DEVICE

(71) Applicants: ACE DENKEN Co., Ltd., Tokyo (JP); Shinko MechatroTech Co., Ltd., Iwate (JP)

(72) Inventors: Eiji Ogura, Tokyo (JP); Hisashi Takahashi, Tokyo (JP); Tomiyasu Sasaki, Iwate (JP); Yoshiharu Abe, Iwate (JP); Jun Furudate, Iwate (JP)

(73) Assignees: ACE DENKEN Co., Ltd., Tokyo (JP); Shinko MechatroTech Co., Ltd., Iwate (JP)

( * ) Notice: Subject to any disclaimer, the term of this patent is extended or adjusted under 35 U.S.C. 154(b) by 192 days.

(21) Appl. No.: 15/609,911

(22) Filed: May 31, 2017

(65) Prior Publication Data

US 2017/0267472 A1 Sep. 21, 2017

Related U.S. Application Data

(62) Division of application No. 14/443,017, filed as application No. PCT/JP2013/080166 on Nov. 7, 2013, now Pat. No. 10,150,629.

(30) Foreign Application Priority Data

Dec. 27, 2012 (JP) ..... 2012-285588
Jan. 17, 2013 (JP) ..... 2013-006305

(51) Int. Cl.
*B65H 5/22* (2006.01)
*B65H 29/24* (2006.01)
(Continued)

(52) U.S. Cl.
CPC ..... *B65H 5/22* (2013.01); *B65H 3/08* (2013.01); *B65H 5/021* (2013.01); *B65H 5/228* (2013.01);
(Continued)

(58) Field of Classification Search
CPC ..... B65H 3/08; B65H 3/0825; B65H 3/24; B65H 5/22; B65H 5/021
See application file for complete search history.

(56) References Cited

U.S. PATENT DOCUMENTS 5,213,451 A * 5/1993 Frank ..... H01L 21/67092 406/72
6,820,873 B2 11/2004 Kulpa
(Continued)

FOREIGN PATENT DOCUMENTS

AU 2007287117 A1 2/2008
CN 1042127 A 5/1990
(Continued)

OTHER PUBLICATIONS

Machine translation of JP 2012-76875. (Year: 2012).*
(Continued)

*Primary Examiner* — Thomas A Morrison
(74) *Attorney, Agent, or Firm* — Osha Liang LLP

(57) ABSTRACT

A paper sheet conveyance device for conveying a paper sheet by an airstream generated in a tubular conveyance path. The paper sheet conveyance device includes a frame member that supports the conveyance path and are provided along an installation route of the conveyance path, pedestal units attached to the frame member and that slide along a longitudinal direction of the frame member, and a plurality of paper sheet capturing devices that send out the paper sheet to be conveyed into the conveyance path and are provided in the conveyance path. Each of the paper sheet capturing devices includes a path part that forms a part of the conveyance path, which is formed by joining a plurality of conveyance ducts and the path parts of the paper sheet capturing devices. The pedestal unit is provided for and holds each of the paper sheet capturing devices.

8 Claims, 58 Drawing Sheets

(51) Int. Cl.

| | |
|---|---|
| ***B65H 3/08*** | (2006.01) |
| ***B65H 5/02*** | (2006.01) |
| ***B65H 5/26*** | (2006.01) |
| ***B65H 7/16*** | (2006.01) |
| ***B65H 7/20*** | (2006.01) |
| ***B65H 31/00*** | (2006.01) |
| ***B65H 43/00*** | (2006.01) |
| ***B65H 29/12*** | (2006.01) |
| ***B65H 29/52*** | (2006.01) |
| ***B65H 31/10*** | (2006.01) |
| ***G07F 17/32*** | (2006.01) |

(52) U.S. Cl.

CPC ..... *B65H 5/26* (2013.01); *B65H 7/16* (2013.01); *B65H 7/20* (2013.01); *B65H 29/12* (2013.01); *B65H 29/24* (2013.01); *B65H 29/245* (2013.01); *B65H 29/52* (2013.01); *B65H 31/00* (2013.01); *B65H 31/10* (2013.01); *B65H 43/00* (2013.01); *G07F 17/32* (2013.01); *G07F 17/3216* (2013.01); *G07F 17/3244* (2013.01); *G07F 17/3297* (2013.01); *B65H 2301/321* (2013.01); *B65H 2301/33212* (2013.01); *B65H 2301/33222* (2013.01); *B65H 2301/5125* (2013.01); *B65H 2404/144* (2013.01); *B65H 2404/611* (2013.01); *B65H 2404/73* (2013.01); *B65H 2406/3124* (2013.01); *B65H 2701/1912* (2013.01); *B65H 2801/27* (2013.01)

(56) References Cited

U.S. PATENT DOCUMENTS

| | | | | |
|---|---|---|---|---|
| 8,596,932 | B2 | 12/2013 | Hoganson et al. | |
| 2007/0216087 | A1* | 9/2007 | Matsudaira ..... | B65H 29/241 271/265.04 |
| 2011/0270440 | A1 | 11/2011 | Hoganson et al. | |

FOREIGN PATENT DOCUMENTS

| | | | | |
|---|---|---|---|---|
| CN | 1062867 | A | | 7/1992 |
| CN | 1094372 | A | | 11/1994 |
| CN | 1714033 | A | | 12/2005 |
| CN | 1792753 | A | | 6/2006 |
| CN | 102083726 | A | | 6/2011 |
| EP | 1275606 | A2 | | 1/2003 |
| JP | 11-349173 | | * | 12/1999 |
| JP | 2007-279979 | A | | 10/2007 |
| JP | 4130697 | B2 | | 8/2008 |
| JP | 2009-051624 | A | | 3/2009 |
| JP | 2009-179483 | A | | 8/2009 |
| JP | 2009-215079 | A | | 9/2009 |
| JP | 2010-189189 | A | | 9/2010 |
| JP | 2011-140397 | A | | 7/2011 |
| JP | 2012-12199 | A | | 1/2012 |
| JP | 2012-76875 | | * | 4/2012 |
| JP | 2012-076875 | A | | 4/2012 |
| JP | 2012-082062 | A | | 4/2012 |

OTHER PUBLICATIONS

Machine translation of JP 11-349173. (Year: 1999).*

Notice of Reason for Refusal issued in corresponding Japanese Patent Application No. 2016-215619 dated Sep. 12, 2017, with translation (6 pages).

Office Action issued in corresponding Chinese Application No. 201610736685.5 dated Jul. 21, 2017 (13 pages).

Office Action issued in corresponding Chinese Application No. 201610736692.5 dated Jul. 31, 2017 (10 pages).

Office Action issued in corresponding Chinese Application No. 201380062043.6 dated Feb. 29, 2016 (11 pages).

Office Action issued in corresponding U.S. Appl. No. 14/443,017 dated Sep. 20, 2017 (22 pages).

Office Action issued in corresponding U.S. Appl. No. 15/609,842 dated Oct. 6, 2017 (15 pages).

International Search Report issued in PCT/JP2013/080166 dated Jan. 28, 2014 (4 pages).

Written Opinion of the International Searching Authority issued in PCT/JP2013/080166 dated Jan. 28, 2014 (4 pages).

International Preliminary Report on Patentability issued in PCT/JP2013/080166 dated Jul. 9, 2015 (7 pages).

Written Opinion of the International Searching Authority issued in PCT/JP2013/080166 dated Jan. 28, 2014 (5 pages).

Office Action issued in corresponding U.S. Appl. No. 15/609,842 dated Feb. 23, 2018 (14 pages).

* cited by examiner

PAPER SHEET CONVEYANCE DEVICE AND SEPARATION/COLLECTION DEVICE

BACKGROUND

Technical Field

One or more embodiments of the present invention relates generally to a paper sheet conveyance device for conveying a paper sheet, such as a bill or the like, by using the airstream generated in the conveyance duct, a paper sheet conveyance device for conveying a paper sheet by being pushed from behind by the conveyance subsidiary body which moves in the conveyance duct by receiving the airstream in the conveyance duct, and a separation/collection device which is provided in the paper sheet conveyance device and which separates the paper sheet from the conveyance subsidiary body and collects the paper sheet and the conveyance subsidiary body.

Related Art

In a gaming machine unit facility including a plurality of sets, each of which includes a game ball lending device for lending game balls (pachinko balls or the like) to a player by receiving the inserted bill and a gaming machine, such as a pachinko machine or the like, a conveyance device for conveying the bill inserted into each game ball lending device to a bill housing stacker provided on the edge part of the gaming machine unit facility is provided along the longitudinal direction of the gaming machine unit facility.

The conveyance device for conveying a paper sheet, such as the bill, includes a conveyance device which generates airstream in a cylindrical conveyance duct by using an air blower and conveys the paper sheet by using the airstream (for example, see Patent Literature 1).

In case of the conveyance device using the airstream, it is necessary to form the entire conveyance path cylindrically. Therefore, a paper sheet capturing device for capturing the paper sheet to be conveyed, which is discharged from the game ball lending device, into the conveyance duct, comprises a cylindrical path part having the same cross section as the conveyance path and is configured to send the paper sheet to be conveyed into the path part. In a gaming machine unit facility, the game ball lending device is provided for each gaming machine, and the paper sheet capturing device is attached to the rear surface of each game ball lending device. By connecting the path part of each paper sheet capturing device with the path part of the adjacent paper sheet capturing device via the conveyance duct on the basis of the path part of the paper sheet capturing device attached to the rear surface of the game ball lending device, the conveyance path extending along the longitudinal direction of the gaming machine unit facility is formed.

In case that the paper sheet, such as a bill, is conveyed by the airstream, in the situation in which the paper sheet is unwrinkled, the airstream flows along the sheet and it is difficult to receive the wind pressure which becomes the propulsive force. Further, by causing the phenomenon that the paper sheet clings to the inner wall, it is difficult to convey the paper sheet. Then, the following conveyance device is adopted. In the conveyance device, a cylindrical conveyance subsidiary body which is moved by the airstream generated in the conveyance duct is sent in the conveyance duct, and the paper sheet is conveyed by pushing the paper sheet from behind by the conveyance subsidiary body (for example, see Patent Literature 2).

In this conveyance device, when the paper sheet is collected, the conveyance subsidiary body is sent in the conveyance duct by a conveyance subsidiary body insertion device provided on the starting side of the conveyance duct. Then, by the separation/collection device provided on the ending side of the conveyance duct, the paper sheet is separated from the conveyance subsidiary body and is collected. Further, in order to repeatedly use the separated conveyance subsidiary body, the conveyance duct has a first half path, a U-shaped turning portion and a second half path. Then, the starting portion of the conveyance duct is arranged near the ending portion of the conveyance duct, and the conveyance subsidiary body collected by the separation/collection device provided at the ending portion of the conveyance duct is automatically sent to the conveyance subsidiary body insertion device provided at the starting portion of the conveyance duct.

As shown in FIG. 33, the above-described separation/collection device comprises a separation unit 80 for passing the paper sheet 6 conveyed by being pushed by the conveyance subsidiary body 16 in the downstream direction and for stopping the conveyance subsidiary body 16 by contacting the conveyance subsidiary body 16 therewith; a tubular path part 96 for receiving the paper sheet 6 output from the passing port 84 of the separation unit 80; a circular conveyance belt 98B which is bridged in the extending direction of the path part 96 along the one inner wall of the path part 96; and a sucking port for sucking the air in the path part 96 from the outside via the rear of the conveyance belt 98B, wherein the paper sheet 6 passing through the passing port 84 of the separation unit 80 clings to the conveyance belt 98B by sucking the air in the path part 96 from the sucking port provided behind the conveyance belt 98B and is conveyed by the conveyance belt 98B to discharge the paper sheet 6 from the ending portion of the path part 96.

CITATION LIST

Patent Literature

Patent Literature 1: Japanese Patent No. 4130697

Patent Literature 2: Japanese Patent Application Publication No. 2012-82062

In the conveyance method using the airstream, in order to prevent the paper sheet or the conveyance subsidiary body from being stuck, it is desired that the conveyance path is formed as straightly as possible so as to eliminate the difference in level. However, in the above-described structure in which the conveyance duct which is another component is supported by the path part of the paper sheet capturing device attached to the rear surface of the game ball lending device, it is difficult to hold the conveyance path straightly in the longitudinal direction of the gaming machine unit facility so as to eliminate the difference in level.

That is, the space between the rear surface of the game ball lending device attached to one side of the gaming machine unit facility and the rear surface of the game ball lending device attached to the other side of the gaming machine unit facility, is narrow. Further, in case of the conveyance of the paper sheet using the airstream, the conveyance duct becomes thick and the paper sheet capturing device is large-sized. Therefore, the paper sheet capturing device is pressed by the rear surface of the game ball lending device, and it is difficult to hold the conveyance path straightly.

Further, in case of the gaming machine unit facility in which the game machines are attached on both sides, the paper sheet capturing devices are provided so as to correspond to the game ball lending devices attached to one side of the gaming machine unit facility and the game ball lending devices attached to the other side thereof, respectively. For the convenience of the construction, only the paper sheet capturing device which is provided so as to correspond to one side is fixed to the rear surface of the game ball lending device by the clasps. On the other hand, the paper sheet capturing device which is provided so as to correspond to the other side is attached only by connecting the capturing port for the paper sheet with the bill outlet provided on the rear surface of the game ball lending device, and is not securely fixed to the rear surface of the game ball lending device by the clasps. Therefore, the paper sheet capturing device which is not securely fixed to the rear surface of the game ball lending device by the clasps is pressed by the rear surface of the game ball lending device, and it is difficult to hold the conveyance path straightly.

Further, in the above separation/collection device, at the time when the front edge of the paper sheet 6 is output to the path part 96 from the passing port 84 of the separation unit 80, the conveyance subsidiary body 16 still pushes the paper sheet 6 from behind (FIG. 33(*a*)). Then, at the timing at which the paper sheet 6 is almost entirely output to the path part 96 from the separation unit 80, the conveyance subsidiary body 16 contacts with the separation unit 80 and is stopped. Therefore, in case of the inelastic paper sheet 6, the curled paper sheet 6, the rolled paper sheet 6 and the like, when the front edge portion of the paper sheet 6 is output from the passing port 84 to a certain degree, the front edge portion of the paper sheet 6 clings to the conveyance belt 98B by sucking the air from the rear of the conveyance belt 98B (FIG. 33(*a*) and FIG. 33(*b*)). In the situation in which the paper sheet 6 clings, the rear edge portion of the paper sheet 6 is pushed by the conveyance subsidiary body 16. At this time, because the movement speed of the conveyance subsidiary body 16 is higher than the rotation speed of the conveyance belt 98B, the rear edge portion of the paper sheet 6 is crushed by the conveyance subsidiary body 16 or is involved with the conveyance subsidiary body 16. As a result, the paper sheet 6 is jammed (FIG. 33(*c*)).

Further, in the paper sheet conveyance device for conveying the paper sheet by being pushed from behind by the conveyance subsidiary body, the conveyance subsidiary body moves in the conveyance duct alone since the conveyance subsidiary body is sent in the conveyance duct until the conveyance subsidiary body reaches the paper sheet to be conveyed. After the conveyance subsidiary body reaches the paper sheet, the conveyance subsidiary body moves while the conveyance subsidiary body pushes the paper sheet from behind. Therefore, the suitable strength of the airstream to be flowed before the conveyance subsidiary body reaches the paper sheet is different from that of the airstream to be flowed after the conveyance subsidiary body reaches the paper sheet.

For example, in case that the strength of the airstream is fixed to the strength suitable for the push of the paper sheet, when the conveyance subsidiary body moves alone, the airstream is too strong. Therefore, the posture of the conveyance subsidiary body is not stable. Further, because the conveyance subsidiary body collides with the conveyance path at the U-shaped turning portion, the conveyance path is easily damaged. On the other hand, when the airstream is weak, it is not possible to convey the paper sheet stably.

Further, when the conveyance subsidiary body contacts with the separation unit of the separation/collection device and is stopped, it is desirable to relieve the impact of the collision by weakening the airstream. Further, in case that the airstream is too strong when the paper sheet arrives at the separation/collection device, there are some possibility that the separated paper sheet strongly clings to the conveyance belt of the separation/collection device, and is jammed without being discharged from the separation/collection device.

Further, in case that the separation/collection device is arranged above the conveyance subsidiary body insertion device for inserting the conveyance subsidiary body which stands by in a standby unit into the conveyance duct and the conveyance subsidiary body collected by the separation/collection device is transferred by freely dropping the conveyance subsidiary body below into the standby unit via a guide path which is provided on the side of the conveyance duct, if the airstream flows during the transfer of the conveyance subsidiary body, the airstream flows backward in the guide path. As a result, the conveyance subsidiary body is prevented from being dropped freely.

SUMMARY

One or more embodiments of the invention provide a paper sheet conveyance device for conveying the paper sheet by using the airstream generated in the conveyance duct, comprising the conveyance path which is held straightly.

For example, one or more embodiments of the invention provide a separation/collection device which is provided in the paper sheet conveyance device for generating the airstream in the conveyance duct and for conveying the paper inserted into the conveyance duct by being pushed from behind by the conveyance subsidiary body moving in the conveyance duct by receiving the airstream and which separates the paper sheet from the conveyance subsidiary body and collects the paper sheet and the conveyance subsidiary body, wherein even in case of an inelastic paper sheet, a curled paper sheet, a rolled paper sheet and the like, the paper sheet can be smoothly collected without crushing the rear edge portion of the paper sheet by the conveyance subsidiary body.

As another example, one or more embodiments of the invention provide a paper sheet conveyance device which can adjust the airstream to the suitable strength according to the movement of the conveyance subsidiary body.

Embodiments of the invention are described below.

[1] One or more embodiments provide a separation/collection device that is provided in a paper sheet conveyance device for generating an airstream in a conveyance duct and for conveying a paper sheet inserted into the conveyance duct by being pushed from behind by a conveyance subsidiary body moving in the conveyance duct by receiving the airstream, and that separates and collects the conveyance subsidiary body and the paper sheet at an ending portion of a conveyance path, the separation/collection device comprising:

a separation unit that passes the paper sheet pushed and conveyed by the conveyance subsidiary body, in a downstream direction, and that stops the conveyance subsidiary body by contacting the conveyance subsidiary body;

a tubular path part that receives the paper sheet output from the separation unit;

a rib provided on an inner wall of the path part and that faces one surface of the paper sheet received from the separation unit, in a predetermined downstream area from a position near the separation unit, the rib projecting toward the surface of the paper sheet;

a circular conveyance belt provided on a downstream side of the rib and bridged in an extending direction of the path part along the inner wall of the path part on which the rib is provided;

an actuating unit that rotatably actuates the conveyance belt and moves a first half of the conveyance belt in the downstream direction, the first half facing the surface of the paper sheet; and a sucking port that opens behind the first half of the conveyance belt and sucks an air in the path part from outside, wherein the paper sheet received from the separation unit clings to the first half of the conveyance belt by sucking the air when the paper sheet passes through the predetermined downstream area in which the rib is provided, and the paper sheet is conveyed by the conveyance belt and is discharged from an ending portion of the path part.

According to one or more embodiments, the conveyance subsidiary body which pushes the paper sheet, such as a bill, from behind, is captured and collected by the separation unit. Only the paper sheet moves toward the downstream path part. The rib is provided along the extending direction of the path on the inner wall of the upstream portion of the path part. The conveyance belt for conveying the paper sheet to the ending portion of the path part is bridged on the downstream side of the rib. In the separation/collection device, the paper sheet clings to the conveyance belt by sucking the air in the path part via the sucking port behind the conveyance belt to convey the paper sheet by the conveyance belt. The rib prevents the paper sheet from clinging to the inner wall of the path part due to the sucking of the air before the paper sheet is moved to the conveyance belt.

In the conveyance using the airstream according to one or more embodiments, the paper sheet is moved by being pushed from behind by the conveyance subsidiary body in a free state. In order to convey the paper sheet by the conveyance belt, it is necessary to press the sheet paper to the conveyance belt. In case that the sheet paper is pressed by the roller arranged so as to oppose to the conveyance belt, it is difficult to suitably insert the sheet paper which is moved at a high speed in the free state, between the conveyance belt and the roller. In the separation/collection device according to one or more embodiments of the present invention, because the paper sheet clings to the conveyance belt by sucking the air via the sucking port behind the conveyance belt to convey the paper sheet, it is possible to suitably convey the paper sheet which is separated by the separation unit and which is in the free state, by the conveyance bolt. Further, because the rib is provided on the inner wall of the upstream portion of the path part, it is possible to prevent the inelastic paper sheet from clinging to the inner wall of the path part and being jammed.

[2] Further, one or more embodiments provide the separation/collection device of [1], wherein in the rib, a mound is formed near an end portion of the rib on the separation unit side.

In one or more embodiments of the present invention, because the paper sheet output from the separation unit is moved along the mound shape of the rib, the paper sheet is guided in the direction in which the paper sheet is apart from the inner wall provided on the side from which the air is sucked. Thereby, even though the front edge of the paper sheet is folded, the paper sheet is prevented from clinging to the inner wall. As a result, it is possible to move the paper sheet toward the downstream side of the path part.

[3] Further, one or more embodiments provide the separation/collection device of [1] or [2], wherein the conveyance belt comprises a plurality of conveyance belts provided apart from each other, and the rib comprises ribs provided on positions corresponding to the plurality of conveyance belts, respectively.

In one or more embodiments of the present invention, because each conveyance belt is arranged on the extended line of each rib, it is possible to smoothly move the paper sheet from the ribs to the conveyance belts.

[4] Further, one or more embodiments provide the separation/collection device of any one of [1] to [3], wherein a second rib is provided on an inner wall of the path part opposed to the inner wall on which the rib is provided, the second rib to opposes the rib and extend in the extending direction of the path part, and the paper sheet received from the separation unit passes between the rib and the second rib.

In one or more embodiments of the present invention, because the second rib which faces to the rib is provided on the wall surface which opposes to the rib, it is possible to guide the paper sheet so as to move the paper sheet between the rib and the second rib. Further, by the second rib, the paper sheet is guided in the direction in which the paper sheet is close to the conveyance belt. As a result, it is possible to prompt the paper sheet to cling to the conveyance belt.

[5] Further, one or more embodiments provide the separation/collection device of any one of [1] to [4], further comprising a pair of discharge rollers that sandwich the paper sheet conveyed by the conveyance belt at the ending portion of the path part, and that are rotatably actuated in a direction of sending the paper sheet, wherein the pair of discharge rollers change an interval between shafts of the discharge rollers and are pressed into contact with each other by an elastic member.

In one or more embodiments of the present invention, in case that the paper sheet discharged from the ending portion of the path part is further conveyed by the external conveyance device, even though the situation in which the external conveyance device strongly draws the paper sheet at a higher speed than the speed of the paper sheet discharged from the path part, is caused, the relative interval between a pair of the rollers is changed to release the drawing force. Therefore, it is possible to avoid the jamming of the paper sheet.

[6] In another aspect, one or more embodiments provide a paper sheet conveyance device for conveying a paper sheet by an airstream generated in a tubular conveyance path, the paper sheet conveyance device comprising:

a frame member that supports the conveyance path and are provided along an installation route of the conveyance path;

pedestal units attached to the frame member and that slide along a longitudinal direction of the frame member; and a plurality of paper sheet capturing devices that send out the paper sheet to be conveyed into the conveyance path and are provided in the conveyance path, wherein each of the paper sheet capturing devices comprises a path part that forms a part of the conveyance path, the conveyance path is formed by joining a plurality of conveyance ducts and the path parts of the paper sheet capturing devices, and the pedestal unit is provided for each of the paper sheet capturing devices and holds each of the paper sheet capturing devices.

In one or more embodiments of the present invention, the slidable pedestal units are attached to the upper surface of the frame member provided along the installation route of the conveyance path, and the paper sheet capturing device is held by the pedestal unit. Because the conveyance path is formed by joining the path parts of the paper sheet capturing devices and a plurality of conveyance ducts, by holding the paper sheet capturing device by the pedestal unit attached to the frame member, the conveyance path is indirectly supported by the frame member. Further, by sliding the pedestal unit, it is possible to easily adjust the position of the pedestal unit to the installation position of the paper sheet capturing device.

[7] Further, one or more embodiments provide the paper sheet conveyance device of [6], wherein the paper sheet capturing device conveys bills discharged from a plurality of play media lending devices provided in a game machine unit facility by capturing the bills in the conveyance path extending in a longitudinal direction of the game machine unit facility, the frame member is attached and fixed in the game machine unit facility along the longitudinal direction of the game machine unit facility, the plurality of paper sheet capturing devices are provided on positions corresponding to the plurality of play media lending devices, and the pedestal unit slides to a position corresponding to the paper sheet capturing device and holds the paper sheet capturing device.

In the paper sheet conveyance device according to one or more embodiments of the present invention, the bills discharged from a plurality of play media lending devices provided in a game machine unit facility, are captured in the conveyance path extending along the longitudinal direction of the game machine unit facility, and are conveyed by using the airstream. A plurality of paper sheet capturing devices are provided on the positions corresponding to the installation positions of a plurality of play media lending devices. The position of the pedestal unit is adjusted to the paper sheet capturing device, and holds the paper sheet capturing device.

[8] Further, one or more embodiments provide the paper sheet conveyance device of [6] or [7], wherein the conveyance path comprises a first half path; a turning portion that turns at an end edge portion of the first half path; and a second half path provided along the first half path above the first half path after the conveyance path is turned at the turning portion, the first half path is formed by the conveyance duct, the second half path is formed by joining the path parts of the paper sheet capturing devices and the conveyance ducts, the frame member is provided between the first half path and the second half path, the pedestal unit is provided on an upper surface of the frame member and holds the paper sheet capturing device from below, and a hook member is hung from the frame member, and the first half path is held by the hook member under the frame member.

In one or more embodiments of the present invention, the frame member is provided between the first half path and the second half path provided along the first half path above the first half path. The pedestal unit is provided on the upper surface of the frame member to hold the paper sheet capturing device which forms a part of the second half path, from below. The first half path is held by the hook member which is hung from the frame member, under the frame member. It is possible to effectively hold both of the first half path and the second half path arranged one above the other, by one frame member.

[9] Further, one or more embodiments provide the paper sheet conveyance device of any one of [6] to [8], wherein in the paper sheet capturing device, a side surface portion is openable, and the pedestal unit holds only a lower portion of the paper sheet capturing device and does not prevent the side surface portion from being opened.

In one or more embodiments of the present invention, in the situation in which the pedestal unit holds the paper sheet capturing device, the jamming of the paper sheet can be removed by opening the side surface portion of the paper sheet capturing device.

[10] Further, one or more embodiments provide the paper sheet conveyance device of [7], wherein the frame member and the paper sheet capturing device are held by a holding member attached to a rear surface portion of the play media lending device.

In one or more embodiments of the present invention, because the frame member and the paper sheet capturing device are held by the holding member attached to the rear surface portion of the play media lending device so as to adjust the distance from the rear surface portion, even though the installation positions of the play media lending devices of the gaming machine unit facility are irregular to a certain degree, the frame member can be straightly provided in the longitudinal direction of the gaming machine unit facility. Further, it is possible to attach the paper sheet capturing device to the rear surface portion of the play media lending device so as to match the frame member provided straightly.

[11] Further, one or more embodiments provide the paper sheet conveyance device of any one of [6] to [10], wherein the paper sheet is conveyed when a rear edge of the paper sheet is pushed by a conveyance subsidiary body that moves in the conveyance path by receiving the airstream.

In one or more embodiments of the present invention, the airstream moves the conveyance subsidiary body, and the paper sheet is conveyed by being pushed forwardly from the rear edge of the paper sheet by the conveyance subsidiary body.

[12] In another aspect, one or more embodiments provide paper sheet conveyance device for generating an airstream in a conveyance duct and for conveying a paper sheet inserted into the conveyance duct by being pushed from behind by a conveyance subsidiary body moving in the conveyance duct by receiving the airstream, the paper sheet conveyance device comprising:

an air volume adjustment unit that adjusts a strength of the airstream according to a position of the conveyance subsidiary body moving in the conveyance path.

[13] Further, one or more embodiments provide the paper sheet conveyance device of [12], wherein the air volume adjustment unit controls the airstream to be weaker when the conveyance subsidiary body pushes and moves the paper sheet from behind than when the conveyance subsidiary body moves toward the paper sheet in the conveyance duct.

[14] Further, one or more embodiments provide the paper sheet conveyance device of [12] or [13], further comprising a separation/collection device for separating and collecting the conveyance subsidiary body and the paper sheet at an ending portion of the conveyance duct, or the separation/collection device of any one of [1] to [5], wherein after the conveyance subsidiary body arrives at an position before the separation/collection device by a predetermined distance, the air volume adjustment unit controls the airstream so as to be weaker than before.

[15] Further, one or more embodiments provide the paper sheet conveyance device of [14], wherein the separation/collection device comprises:

a separation unit that passes the paper sheet pushed and conveyed by the conveyance subsidiary body, in a downstream direction, and that stops the conveyance subsidiary body by contacting the conveyance subsidiary body with the separation unit;

a tubular path part that receives the paper sheet output from the separation unit;

a circular conveyance belt bridged in an extending direction of the path part along an inner wall of the path part and that faces one surface of the paper sheet received from the separation unit;

an actuating unit that rotatably actuates the conveyance belt and moves a first half of the conveyance belt in the downstream direction, the first half facing the surface of the paper sheet; and a sucking port that opens behind the first half of the conveyance belt and sucks air in the path part from outside, wherein the paper sheet received from the separation unit is conveyed while the paper sheet clings to the conveyance belt by sucking the air, and is discharged from an ending portion of the path part, an air blower for generating the airstream sucks the air fed into an upstream side of the conveyance duct, via the sucking port, after the conveyance subsidiary body arrives at the separation unit, the air volume adjustment unit controls the airstream to be weaker than before, and the separation/collection device actuates the conveyance belt after a predetermined time elapses since the conveyance subsidiary body arrives at the separation unit.

[16] Further, one or more embodiments provide the paper sheet conveyance device of [15], further comprising: a conveyance subsidiary body insertion device that sends out the conveyance subsidiary body that stands by in a standby unit into the conveyance duct, wherein the separation/collection device is arranged above the conveyance subsidiary body insertion device and transfers the conveyance subsidiary body collected by the separation unit to the standby unit of the conveyance subsidiary body insertion device by dropping the conveyance subsidiary body downwardly after the conveyance subsidiary body is withdrawn toward a side of the conveyance duct, and the separation/collection device carries out an operation for transferring the conveyance subsidiary body collected by the separation unit, to the standby unit after the air volume adjustment unit stops the airstream.

In the separation/collection device according to one or more embodiments of the present invention, it is possible to suitably separate the conveyance subsidiary body which is moved by receiving the airstream in the conveyance duct from the paper sheet conveyed by being pushed from behind by the conveyance subsidiary body, and collect the conveyance subsidiary body and the paper sheet. In particular, even in case of an inelastic paper sheet, a curled paper sheet, a rolled paper sheet and the like, it is possible to smoothly collect the paper sheet without crushing the rear edge portion of the paper sheet by the conveyance subsidiary body.

Further, in the paper sheet conveyance device according to one or more embodiments of the present invention, because the conveyance path can be held straightly, it is possible to avoid the jamming of the paper sheet and the like, which is caused due to the difference in level.

Further, the airstream is adjusted to the suitable strength according to the position of the conveyance subsidiary body.

DETAILED DESCRIPTION

Hereinafter, embodiments of the present invention will be explained with reference to the accompanying drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
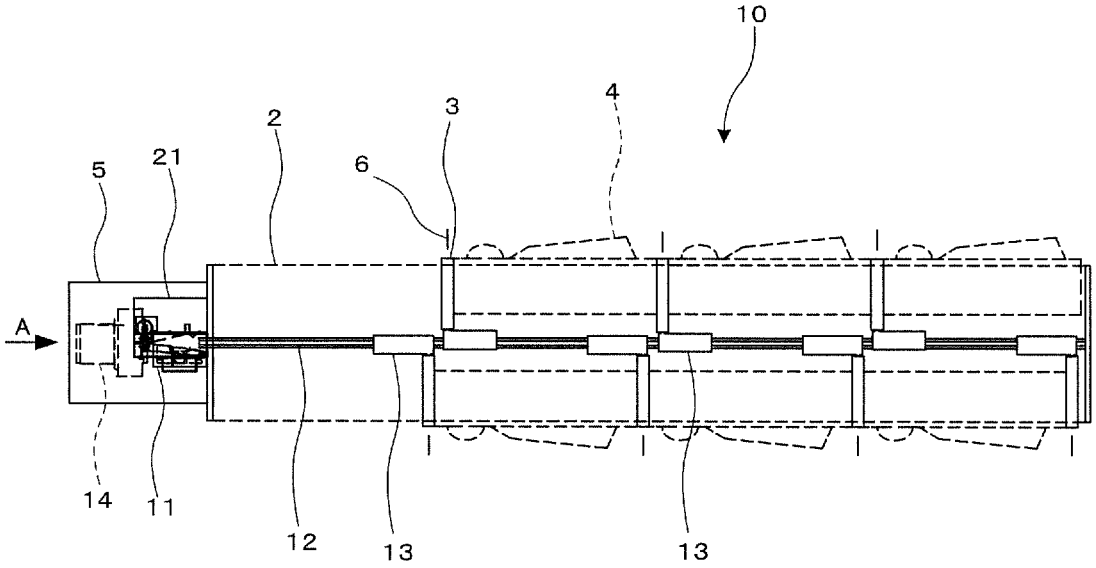
FIG. 1 This is a plan view showing the schematic structure of the paper sheet conveyance device including the separation/collection device according to one or more embodiments of the present invention.
Figure 2:
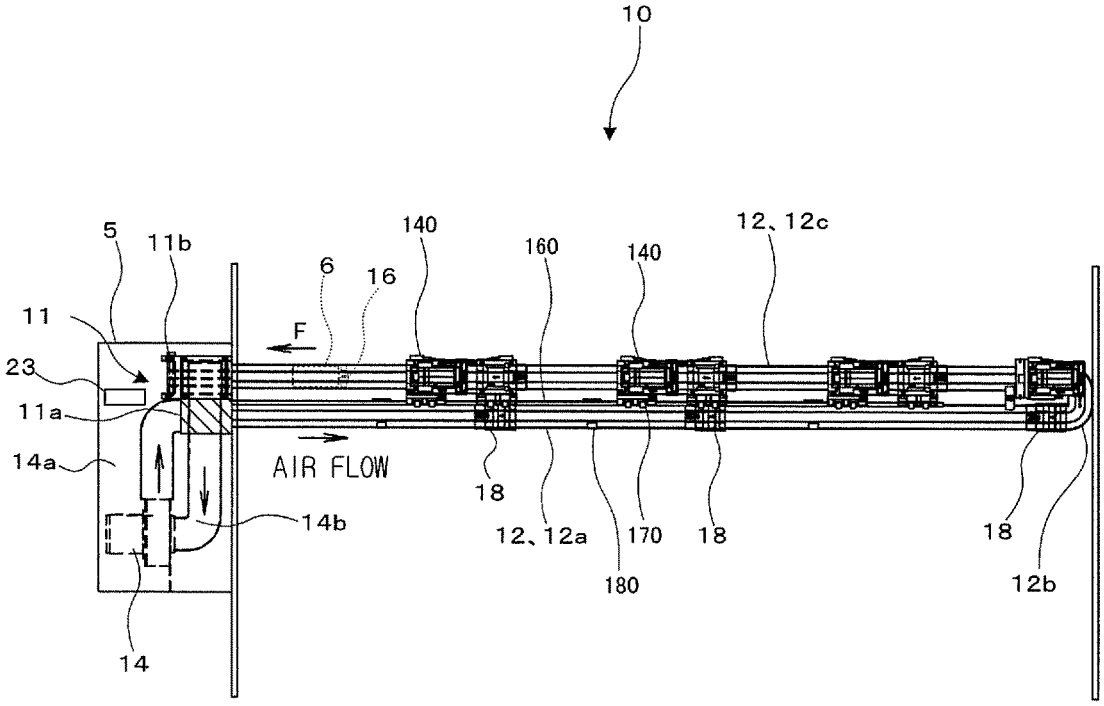
FIG. 2 This is a front view showing schematic structure of the paper sheet conveyance device including the separation/collection device according to one or more embodiments of the present invention.

FIG. 1 is a plan view showing the schematic structure of the paper sheet conveyance device 10 including the separation/collection device 70 according to one or more embodiments of the present invention. FIG. 2 is a front view of the paper sheet conveyance device 10. In one or more embodiments, the paper sheet conveyance device 10 is provided in a gaming machine unit facility 2 including a plurality of sets, each of which includes a game ball lending device 3 for lending game balls (pachinko balls or the like) to a player by receiving the inserted bill as the play media lending device and a game machine 4, such as a pachinko machine or the like, so as to provide the above sets back-to-back on the front and rear faces of the gaming machine unit facility 2. The paper sheet conveyance device 10 conveys the bills 6 to the bill housing stacker 5 provided on the edge part of the gaming machine unit facility 2, as the bill conveyance device by capturing the bills 6 discharged from the rear surface of each game ball lending device 3.

The paper sheet conveyance device 10 comprises a conveyance duct 12 which functions as the conveyance path for the bill (paper sheet), and an airstream generation device (blower) 14 for generating the airstream which flows in the conveyance duct 12 in the extending direction thereof. In the paper sheet conveyance device 10, the conveyance subsidiary body 16 which can move in the conveyance duct 12 by receiving the airstream, is inserted into the conveyance duct 12 on the upstream side of the bill 6 to be conveyed, and the bill 6 is conveyed to the downstream side by being pushed from behind by the conveyance subsidiary body 16 in the conveyance duct 12.

In one or more embodiments, as shown in FIG. 2, in the bill housing stacker 5 provided on one edge part of the gaming machine unit facility 2, the airstream generation device 14 and the bill separation/conveyance subsidiary body circulation device 11 are provided. The bill separation/conveyance subsidiary body circulation device 11 has the function as the conveyance subsidiary body insertion device 40 for sending out the conveyance subsidiary body 16 into the conveyance duct 12, and the function as the separation/collection device 70 for separating the bill 6 from the conveyance subsidiary body 16 which pushes the bill from behind and conveys the bill and for collecting the bill 6 and the conveyance subsidiary body 16. Further, the bill separation/conveyance subsidiary body circulation device 11 has the function for circulating the collected conveyance subsidiary body 16 by returning it to the conveyance subsidiary body insertion device 40. The bill 6 collected by the separation/collection device 70 is contained in the bill containing unit 21 (See FIG. 1) of the bill housing stacker 5.

The air blowing side (the air blowing path 14*a*) of the airstream generation device 14 is connected with the airstream inlet side (the blowing path connection port 46) of the conveyance subsidiary body insertion device 40. The airstream outlet side (the conveyance duct connection port 45) of the conveyance subsidiary body insertion device 40 is connected with the starting portion of the conveyance duct 12. The conveyance duct 12 comprises a first half path 12*a* extending from the airstream outlet side of the conveyance subsidiary body insertion device 40 to the other edge part of the gaming machine unit facility 2, a turning portion 12*b* which turns in a U-shaped form at the other edge part, and a second half path 12*c* extending along the first half path 12*a* above the first half path 12*a* so as to return to the bill housing stacker 5 after turning at the turning portion 12*a*. The ending portion of the second half path 12*c* is connected with the airstream inlet side (the conveyance duct connection port 72) of the separation/collection device 70. The air sucking side (the air sucking path 14*d*) of the airstream generation device 14 is connected with the airstream outlet side (the air sucking path connection portion 76) of the separation/collection device 70.

The airstream generation device 14 generates the airstream by rotating the fan with a motor. The airstream generated by the airstream generation device 14 flows in the starting portion of the conveyance duct 12 from the air blowing path 14*a* via the conveyance subsidiary body insertion device 40. After the airstream passes through the first half path 12*a*, the turning portion 12*b* and the second half path 12*c*, the airstream flows so as to be sucked to the sucking side of the airstream generation device 14 via the air sucking path 14*b*.

Each of the first half path 12*a* and the second half path 12*c* of the conveyance duct 12 is divided into a plurality of conveyance ducts, each of which has the predetermined length, for example, the length corresponding to the width of one set of the gaming machine 4 and the play ball lending device 3, which is provided in the gaming machine unit facility 2. By connecting the required number of the above conveyance ducts using the connection units 18, the path length can be adjusted according to the longitudinal length of the gaming machine unit facility 2. Further, in the construction process, the conveyance duct 12 is used by cutting it to the necessary length.

In the second half path 12*c* of the conveyance duct 12, the bill capturing devices 140 are provided on the positions corresponding to the play ball lending devices 3 as the paper sheet capturing device for capturing the bill 6 discharged from the rear surface of each game ball lending device 3 into the conveyance duct 12. The bill capturing devices 140 are provided so as to pair the bill capturing device 140 for capturing the bill 6 from the play ball lending device 3 arranged on the front face of the gaming machine unit facility 2 with the bill capturing device 140 for capturing the bill 6 from the play ball lending device 3 arranged on the rear face of the gaming machine unit facility 2. The bill capturing device 140 has the function for connecting the conveyance ducts 12 which constitute the second half path 12*c*, by being interpolated between the conveyance ducts.

In the gaming machine unit facility 2, the auxiliary frame (frame member) 160 for supporting the conveyance path 12 along the longitudinal direction of the gaming machine unit facility 2 is bridged. The auxiliary frame 160 is bridged along the second half path 12*c* below the second half path 12*c* (between the first half path 12*a* and the second half path 12*c* which are arranged one above the other). The edge portion of the auxiliary frame 160 in the longitudinal direction is fixed to the end plate of the gaming machine unit facility 2 by the attachment clasp 66 (See FIG. 50). On the upper surface side of the auxiliary frame 160, the pedestal unit 170 which is freely movable so as to slide along the longitudinal direction of the auxiliary frame 160 is attached. The pedestal unit 170 holds the lower portion of the bill capturing device 140 from the lower side (See FIG. 2 and FIG. 45). Further, the hook member 180 is attached on the auxiliary frame 160 and is hung, and the first half path 12*a* of the conveyance duct 12 is held by the hook member 180 so as to be clutched. The detail of the method for supporting the conveyance duct 12 by using the auxiliary frame 160 will be explained below.

Figure 3:
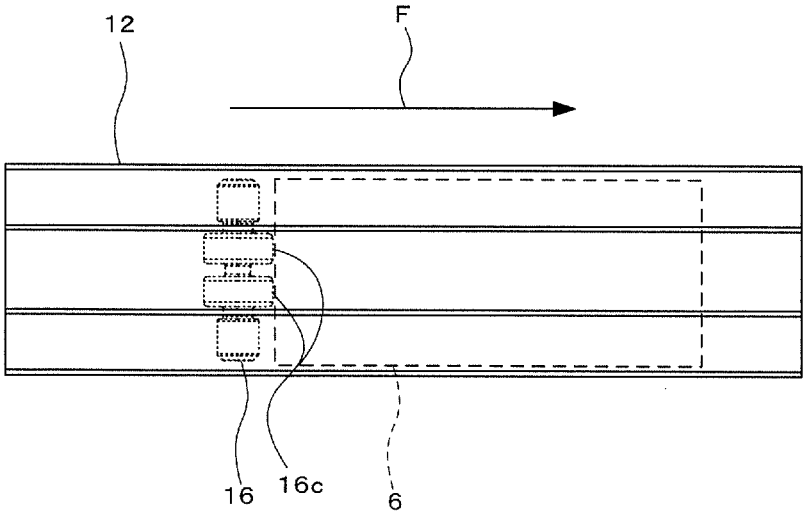
FIG. 3 This is an explanatory view showing the situation in which the bill is pushed from the rear edge side of the bill by the conveyance subsidiary body in the conveyance duct, according to one or more embodiments of the present invention.

In the paper sheet conveyance device 10, the bill 6 which is captured into the second half path 12*c* of the conveyance duct 12 from the bill capturing device 140 stays on the predetermined capturing finish position in a posture along the extending direction of the conveyance duct 12. In order to convey the bill 6 which is captured into the conveyance duct 12 and stays, to the bill housing stacker 5 and to collect the conveyed bill, the conveyance subsidiary body 16 is inserted into the conveyance duct 12 by the conveyance subsidiary body insertion device 40 of the bill separation/conveyance subsidiary body circulation device 11. The conveyance subsidiary body 16 inserted into the conveyance duct 12 moves in the first half path 12*a* toward the turning portion 12*b* by receiving the airstream generated by the airstream generation device 14. Further, after the conveyance subsidiary body 16 is turned at the turning portion 12*b*, the conveyance subsidiary body 16 moves in the second half path 12*c* toward the ending portion of the conveyance duct 12. At this time, as shown in FIG. 3, by pushing the bill 6 from the rear edge side thereof by the conveyance subsidiary body 16 in the conveyance duct 12, the bill 6 is conveyed toward the ending portion of the conveyance duct 12 (in the conveyance direction F shown in the drawing).

The bill separation/conveyance subsidiary body circulation device 11 and the bill capturing devices 140 are controlled and operated by the control unit 23 (See FIG. 10) which comprises a CPU (Central Processing Unit), a ROM (Read Only Memory), a RAM (Random Access Memory) and the like as the main unit. In one or more embodiments, the airstream generation device 14 is always operated, and when a sensor provided in the bill capturing device 140 detects the bill 6 discharged from the rear surface of the game ball lending device 3, the control unit 23 operates the bill capturing devices 140 to capture the bill 6 into the conveyance duct 12. After the capturing operation is finished, the conveyance subsidiary body 16 is inserted into the conveyance duct 12 from the conveyance subsidiary body insertion device 40 of the bill separation/conveyance subsidiary body circulation device 11. Then, the conveyance subsidiary body 16 moves in the conveyance duct 12 by receiving the airstream, and conveys the bill 6 by pushing the bill 6 from behind. When the arrival of the conveyance subsidiary body 16 is detected, the separation/collection device 70 of the bill separation/conveyance subsidiary body circulation device 11 separates the bill 6 from the conveyance subsidiary body 16 and collects the bill 6 and the conveyance subsidiary body 16. The collected conveyance subsidiary body 16 is guided to the conveyance subsidiary body insertion device 40 in order to prepare to send out the conveyance subsidiary body 16 at the next time.

The airstream generation device 14 may be controlled so as to operate only as needed (for example, since the bill capturing devices 140 detects the bill from the game ball lending device 3 until the bill is collected in the bill housing stacker 5).

As described above, because the conveyance subsidiary body 16 moves by receiving the airstream and the bill 6 is conveyed by being pushed from the rear edge side thereof by the conveyance subsidiary body 16, it is not required that the bill 6 itself obtains the propulsive force by receiving the airstream. Therefore, without taking the action, for example, for folding the bill 6 in order to receive the airstream, or the like, it is possible to convey the bill 6 by using the airstream. Further, because the conveyance subsidiary body 16 can effectively obtain the propulsive force from the airstream as compared with the bill 6, it is possible to effectively convey the bill 6.

Next, each shape of the conveyance duct 12 and the conveyance subsidiary body 16 will be explained.

Figure 4:
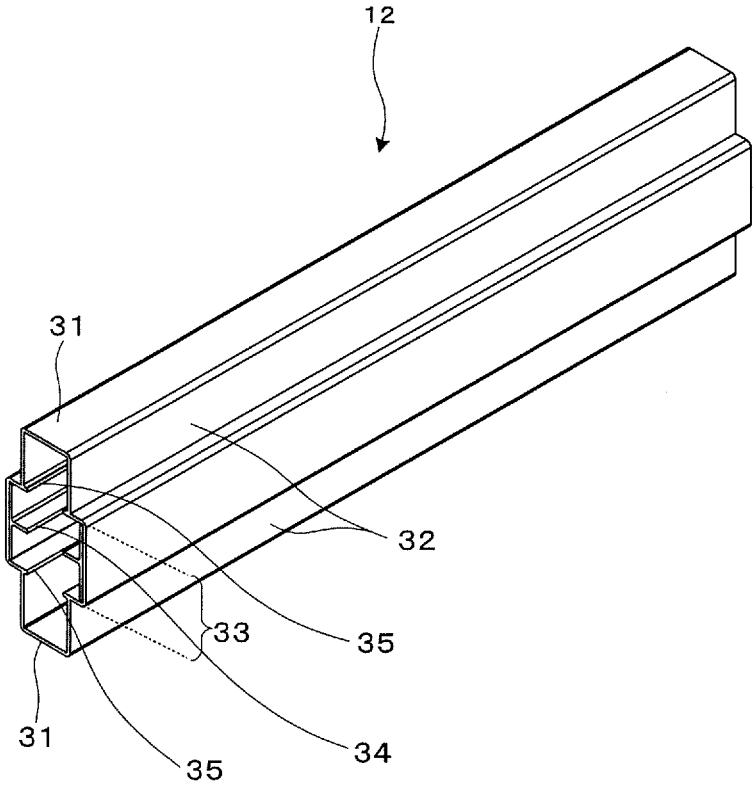
FIG. 4 This is a perspective view showing the conveyance duct in the straight portion (the portion of the first half path and the second half path), according to one or more embodiments of the present invention.
Figure 5:
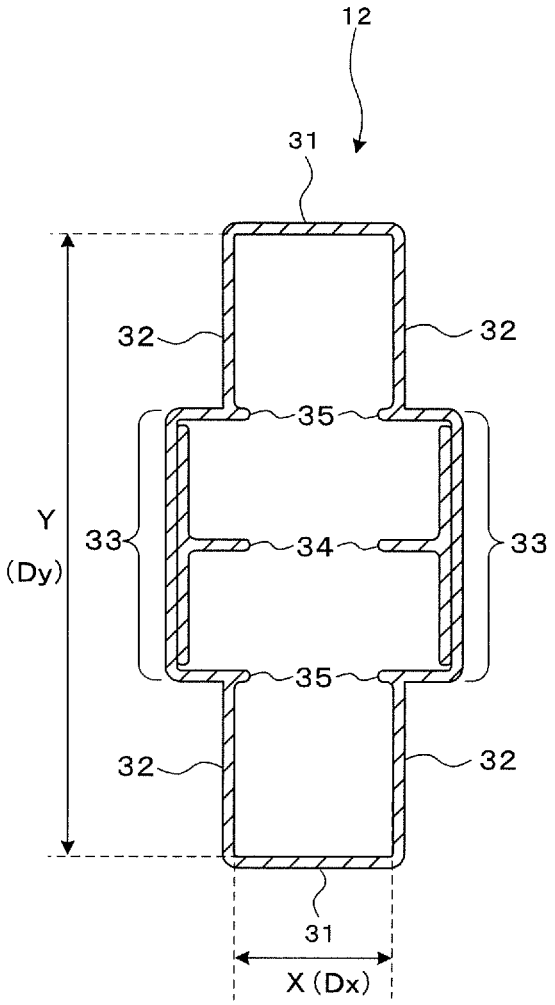
FIG. 5 This is a sectional view of the conveyance duct in the straight portion (the portion of the first half path and the second half path), according to one or more embodiments of the present invention.

FIG. 4 is a perspective view showing the conveyance duct 12 in the straight portion (the portion of the first half path 12*a* and the second half path 12*c*). FIG. 5 is a sectional view showing the cross-sectional shape of the same portion of the conveyance duct 12, which is perpendicular to the extending direction F of the conveyance duct 12 (the conveyance direction F of the bill, the flowing direction of the airstream). The conveyance duct 12 is formed of the resin having the thickness of about 1.5 mm. The conveyance duct 12 is formed, for example, by the extrusion molding method.

The cross section of the straight portion of the conveyance duct 12, which is perpendicular to the extending direction F, is formed so as to have the shape in which each middle portion of the right and left side walls of the vertically long rectangle is squarely expanded outwardly. In detail, the conveyance duct 12 comprises upper and lower wall portions 31, right and left side wall portions 32 and expanding portions 33 which are squarely expanded outwardly on each middle portion of the right and left side wall portions 32 in the up and down direction. The short side direction in the cross section having the substantially rectangle, which is perpendicular to the extending direction of the conveyance duct 12 (conveyance direction F), is referred to as X direction (width direction or right and left direction). The long side direction is referred to as Y direction (height direction or up and down direction). With respect to each of X direction and Y direction, the direction toward the center of the conveyance duct 12 is referred to as the inside direction and the direction toward the inner wall from the center is referred to as the outside direction.

Each expanding portion 33 is separated into two sections which are an upper section and a lower section by the separation wall 34 which is erected in the inside direction of the conveyance duct 12. Each separation wall 34 is formed by fixing the T-shaped member to the inner wall of the expanding portion 33.

In each side wall portion 32, a plurality of ribs 35 which project toward the inside direction of the conveyance duct 12 are formed along the conveyance direction. In one or more embodiments, the ribs 35 which project toward the inside of the conveyance duct 12 are formed along the conveyance direction at each boundary position between the side wall portion 32 and the expanding portion 33. The separation wall 34 and the rib 35 have the same height, and the edge portion of the separation wall 34 functions as the rib.

The side wall portions 32 are a pair of inner walls which face to the surface of the conveyed bill 6. The bill 6 has a rectangular shape. In the conveyance duct 12, the bill 6 is conveyed so as to set the long side thereof to the conveyance direction F. In other words, the bill 6 is conveyed as follows. The surface of the bill 6 faces to the side wall portion 32 of the conveyance duct 12. Further, one short side of the bill 6 is the front edge portion in the conveyance direction and the other short side is the rear edge portion.

The interval Dy between the upper and the lower wall portions 31 of the conveyance duct 12 is slightly longer than the short side of the bill 6. Further, the interval Dx between the right and the left side wall portions 32 (the part in which the ribs 35, the expanding portions 33 and the separation walls 34 are not formed (which is referred to as the reference plane part)) is set to about 21 mm. The expanding portions 33 which are provided on the right and the left side wall portions 32, are expanded about 6 mm from the side wall portions 32 (the reference plane part) in the outside direction, respectively. Each rib 35 and the edge portion of each separation wall 34 project about 2 mm from each side wall portion 32 (the reference plane part) in the inside direction. The height of the rib 35 may be optionally set.

Figure 6:
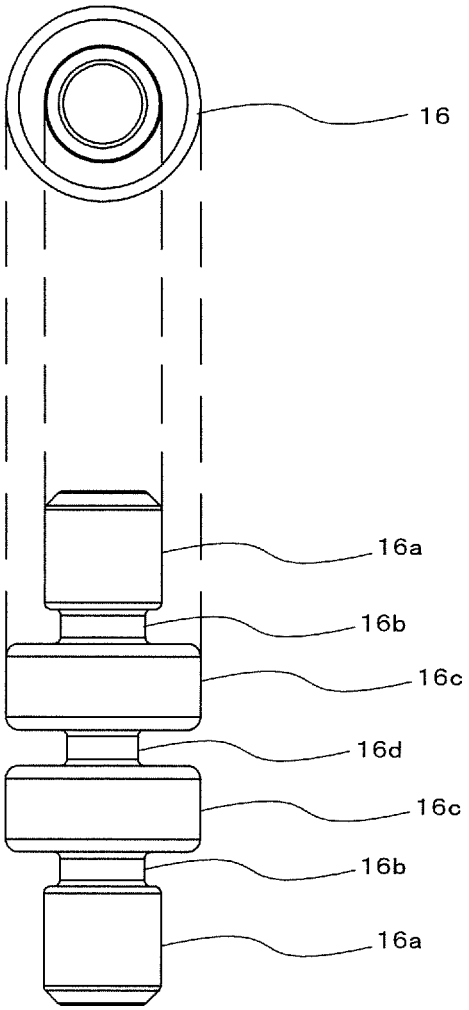
FIG. 6 This is a view showing the plane face and the front face of the conveyance subsidiary body, according to one or more embodiments of the present invention.

FIG. 6 shows the plane face and the front face of the conveyance subsidiary body 16. The conveyance subsidiary body 16 is formed in a pillar shape in which the diameter of the circular cross section varies according to each portion. The conveyance subsidiary body 16 is inserted in the conveyance duct 12 so as to set the central axis of the column to the Y direction (height direction) of the conveyance duct 12. The conveyance subsidiary body 16 is formed in a vertical symmetry and comprises a head portion 16*a*, a neck portion 16*b* having the diameter which is slightly smaller than that of the head portion, a large-diameter portion 16*c* having the diameter which is larger than that of the head portion 16*a*, a narrow portion 16*d* having the same diameter as the neck portion 16 and arranged in the middle in the up and down direction, the large-diameter portion 16*c*, the neck portion 16*b* and the head portion 16*a*, from the top. The conveyance subsidiary body 16 is lightweight and durable. For example, the conveyance subsidiary body 16 is made of plastic or the like, and is hollowed. As long as the conveyance subsidiary body 16 is lightweight and durable, the conveyance subsidiary body 16 may be made of styrene form, extruded polystyrene foam, or the like.

Figure 7:
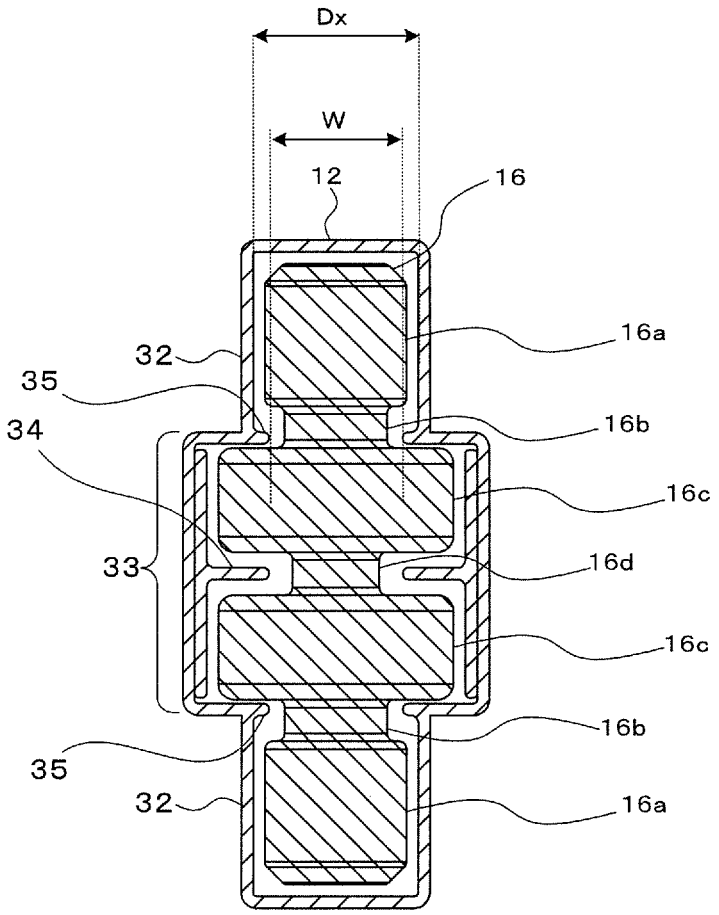
FIG. 7 This is a sectional view showing the situation in which the conveyance subsidiary body is inserted into the conveyance duct, along the central axis of the conveyance subsidiary body, according to one or more embodiments of the present invention.

FIG. 7 is a sectional view showing the situation in which the conveyance subsidiary body 16 is inserted into the conveyance duct 12, and showing the cross section which is perpendicular to the extending direction F, and is taken along the central axis of the conveyance subsidiary body 16. The diameter of each portion of the conveyance subsidiary body 16 corresponds to the inner edge shape of the conveyance duct 12. That is, the cross section taken along the central axis of the conveyance subsidiary body 16 has a shape which corresponds to the inner edge shape of the conveyance duct 12 in the cross section perpendicular to the extending direction F, so as to almost close the inner space of the conveyance duct 12 and to provide the predetermined clearance between the inner wall and the conveyance subsidiary body 16.

As described above, because the conveyance subsidiary body 16 closes almost the whole of the cross section of the conveyance duct 12 by having the shape corresponding to the inner edge shape of the conveyance duct 12 (almost the same shape in which the slight clearance is provided), it is possible to move the conveyance subsidiary body 16 by effectively receiving the airstream. Further, the conveyance subsidiary body 16 has the function for preventing the airstream from flowing from the upstream side to the downstream side of the conveyance subsidiary body 16 and for avoiding the air turbulence on the downstream side.

The bill 6 tends to cling to the side wall portions 32 by receiving the airstream in the conveyance duct 12. That is, there is few possibility that the interval between one surface of the bill 6 and the side wall portion 32 which faces to the one surface is equal to the interval between the other surface and the side wall portion 32 which faces to the other surface. When one interval becomes narrower than the other, the flow velocity of the airstream becomes large in the narrower interval as compared with the wider interval. Therefore, the pressure in the narrower interval is lower than the pressure in the wider interval. By the pressure difference, the bill 6 clings to and is pressed to the side wall portion 32 on the narrower interval side. Then, the interval becomes narrower on the narrower interval side, and the phenomenon that the bill 6 clings to the side wall portion 32 is caused.

When the bill 6 strongly clings to side wall portion 32, it is difficult to convey the bill 6 by being pushed by the conveyance subsidiary body 16. However, as described above, the conveyance subsidiary body 16 has the function for blocking (weakening) the airstream which flows to the downstream side thereof. Therefore, the clinging force for the bill 6 is weakened and the smooth conveyance can be realized.

Two large-diameter portions 16*c* of the conveyance subsidiary body 16 are engaged with two expanding portions 33 each of which is separated by the separation wall 34 of the conveyance duct 12. In one or more embodiments, each expanding portion 33 is separated into two sections by the separation wall 34 and the expanding portions 33 are provided in the middle of the conveyance duct 12 in Y direction.

Therefore, the conveyance subsidiary body 16 can be moved so as to maintain a stable posture. Further, because the posture of the conveyance subsidiary body 16 becomes stable, the large-diameter portions 16*c* of the conveyance subsidiary body 16 suitably contact with the rear edge of the bill 6 and can give the stable conveyance force to the bill 6. Further, it is hard to involve the bill 6 between the conveyance duct 12 and the conveyance subsidiary body 16.

In the conveyance subsidiary body 16, by providing the large-diameter portions 16*c*, the area for receiving the airstream is spread. Therefore, it is possible to effectively receive the force for moving the conveyance subsidiary body 16. Further, because the airstream is effectively received by providing the large-diameter portions 16*c*, the diameter of each head portion 16*a* can be small. By reducing the size of each head portion 16*a*, the interval between a pair of the side wall portions 32 which face to each other in the conveyance duct 12 (width (Dx)) can become narrower, and it is possible to prevent the bill 6 from being laid.

Further, by a plurality of ribs 35 provided on each side wall portion 32, it is possible to prevent the bill 6 from clinging to side wall portions 32. That is, by reducing the contact area between the bill 6 and the side wall portion 32, the friction force is reduced. It is possible to prevent the static electricity from being caused. Further, even in case that the bill 6 clings to the side wall portion 32, the bill 6 is supported by the edge portion of the rib 35. Therefore, around the rib 35, the space between the side wall portion 32 and the bill 6 is secured, and the clinging force is weakly suppressed. Further, because the bill 6 is supported by the separation wall 34, the bill 6 is prevented from being fit into the concave of the expanding portion 33.

A plurality of the ribs 35 and the edge portion of the separation wall 34, which project toward the inner side from each side wall portion 32, have the function for narrowing the substantial path width W for the bill 6 in the width direction (X direction) of the conveyance duct 12 as compared with the interval Dx between the reference plane parts. Thereby, it is difficult to lay the bill 6 in the conveyance duct 12, and the posture of the bill 6 is maintained along the Y direction. In particular, by providing a plurality of ribs 35, the bill 6 is suitably prevented from being laid. Further, the bill 6 is effectively prevented from clinging to the side wall portion 32. It is possible to widen the Dx by providing the ribs 35. Thereby, the sectional area of the conveyance duct 12 can be spread and the conveyance subsidiary body 16 can easily receive the airstream.

In case of the conveyance subsidiary body 16 according to one or more embodiments, because the diameter of the large-diameter portion 16*c* is the largest, as shown in FIG. 3, the large-diameter portions 16*c* contact with the rear edge portion of the bill 6 to push the bill 6.

Figure 8:
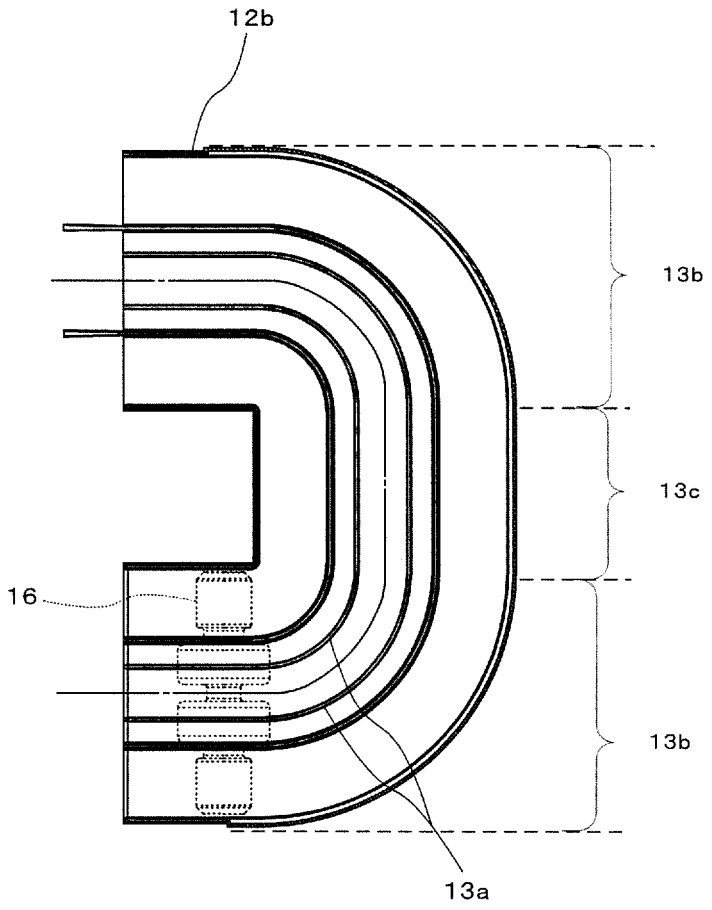
FIG. 8 This is a front view showing the turning portion of the conveyance duct, according to one or more embodiments of the present invention.
Figure 9:
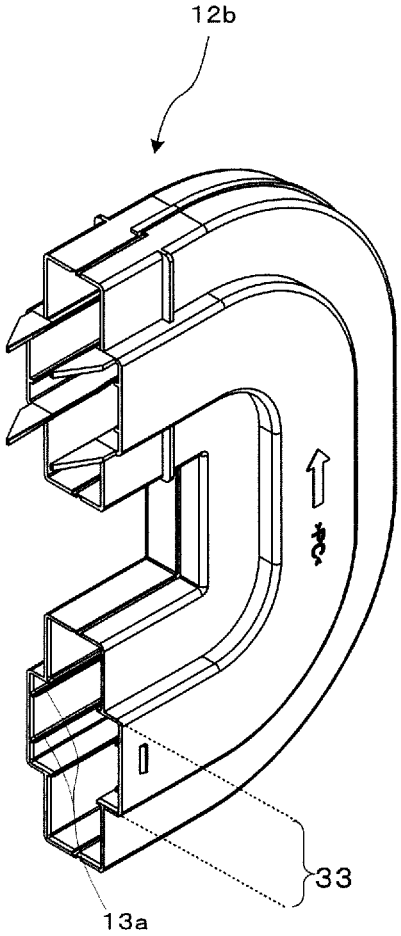
FIG. 9 This is a perspective view showing the turning portion of the conveyance duct, according to one or more embodiments of the present invention.

FIG. 8 is a sectional view of the turning portion 12*b*. FIG. 9 is a perspective view of the turning portion 12*b*. The turning portion 12*b* has the shape in which the conveyance duct 12 is connected with an arc part 13*b* extending so as to draw the arc having the center angle of 90 degrees by setting the radius direction to the Y direction, a straight part 13*c* and an arc part 13*b* formed in the arc having the center angle of 90 degrees. The turning portion 12*b* changes the course of the conveyance subsidiary body 16 by 180 degrees. Also in the turning portion 12*b*, the ribs 35 and the expanding portions 33 are formed. However, in order to prevent the conveyance subsidiary body 16 from being caught when the conveyance subsidiary body 16 moves curvedly along the arc part 13*b*, the separation wall 34 is not provided. Further, in the part which overlaps with the locus of the conveyance subsidiary body 16 which passes through the turning portion 12*b*, the ribs 35 and the expanding portions 33 are provided so as to release them (so as to have the wider clearance as compared with the straight portion). Thereby, it is possible to reduce the rotation radius in the arc part 13*b* of the turning portion 12. The length of the straight part 13*c* may be suitably determined according to the necessary distance between the first half path 12*a* and the second half path 12*c*, which is determined by, for example, each size of the bill separation/conveyance subsidiary body circulation device 11 and the bill capturing device 140, and the like. In each expanding portion 33 of the turning portion 12*b*, two ribs 13*a* are provided so as to correspond to the large-diameter portions 16*c* of the conveyance subsidiary body 16. Therefore, the position of the conveyance subsidiary body 16 is regulated in the middle in the X direction.

Next, the bill separation/conveyance subsidiary body circulation device 11 will be explained.

Figure 10:
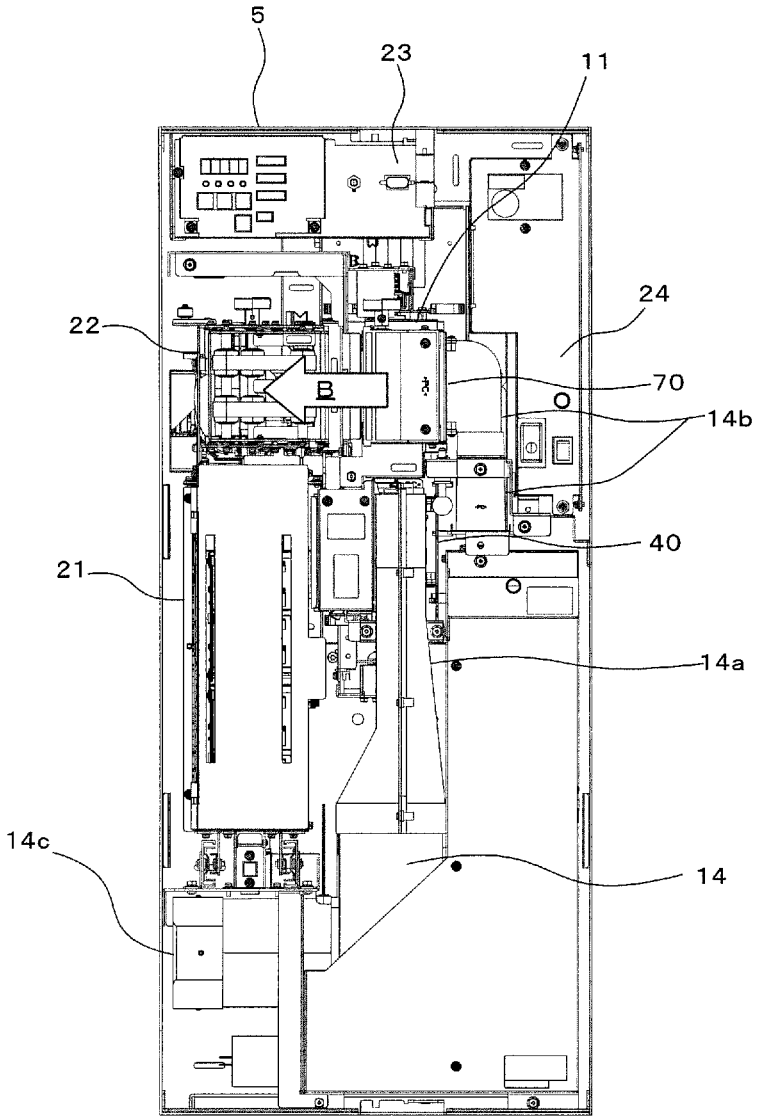
FIG. 10 This is a front view showing the bill housing stacker in the situation in which the front cover is removed, according to one or more embodiments of the present invention.
Figure 11:
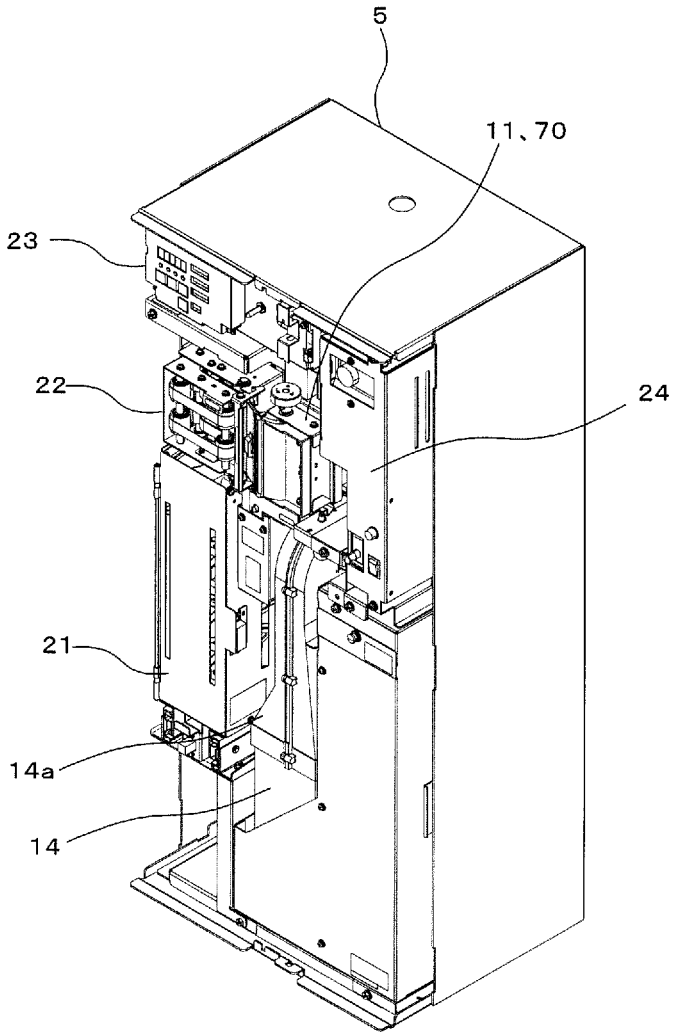
FIG. 11 This is a perspective view showing the bill housing stacker in the situation in which the front cover is removed, according to one or more embodiments of the present invention.
Figure 12:
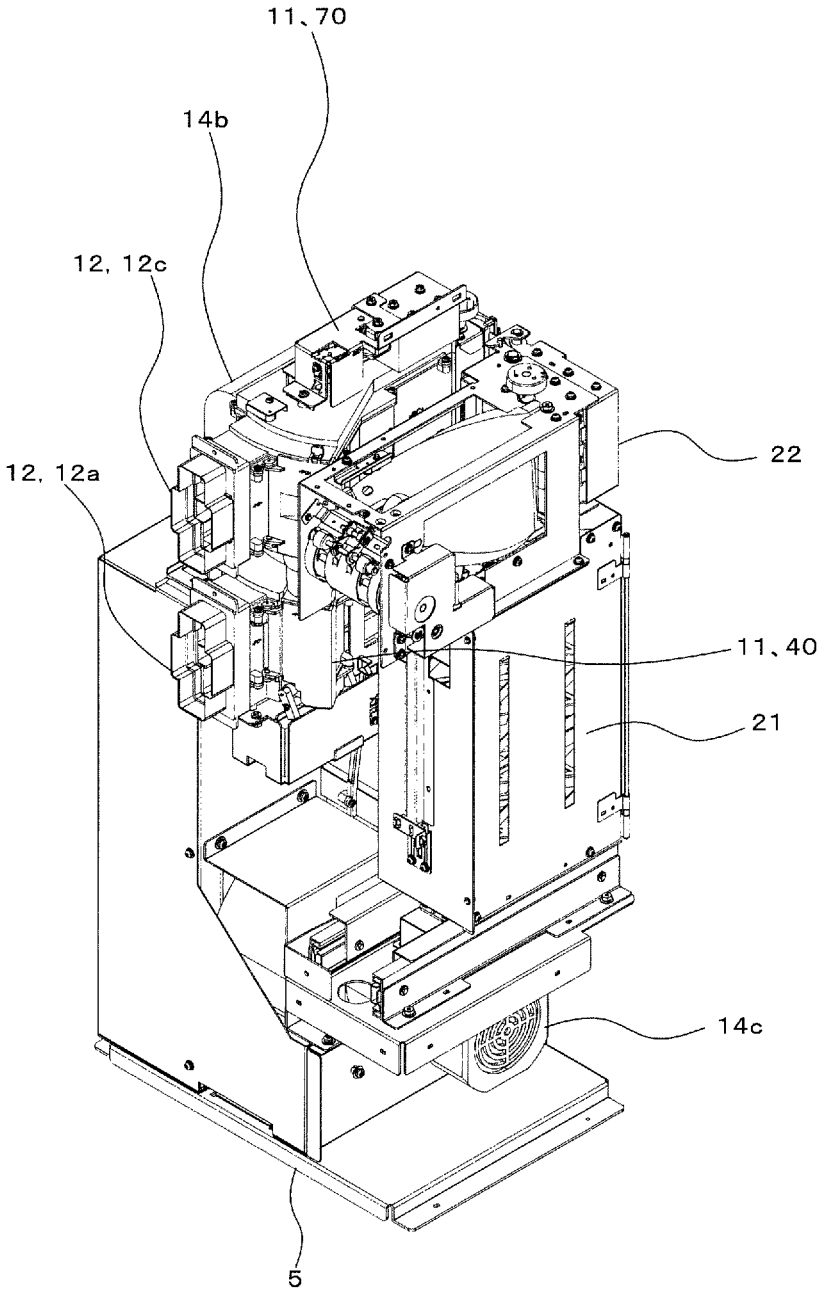
FIG. 12 This is a perspective view showing the attachment situation in which the bill separation/conveyance subsidiary body circulation device, the airstream generation device and the like are attached in the bill housing stacker from which some parts are removed, according to one or more embodiments of the present invention.
Figure 13:
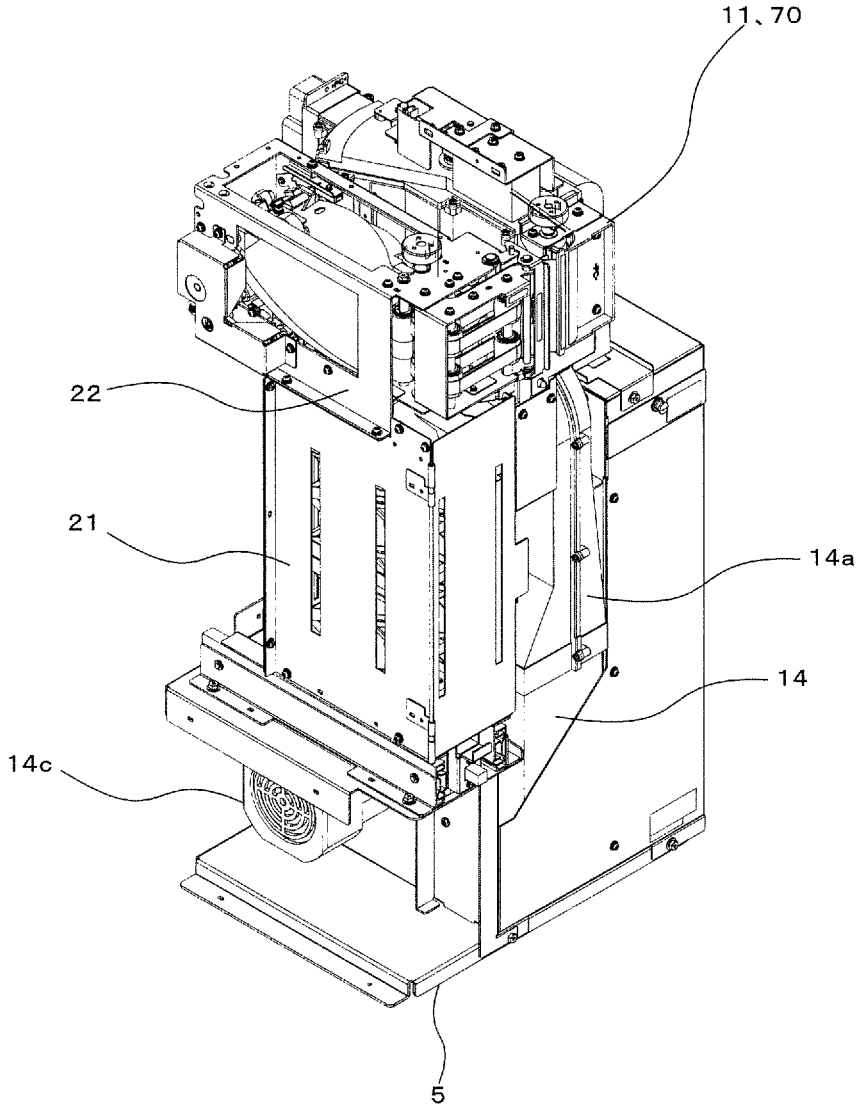
FIG. 13 This is a perspective view showing the attachment situation viewed in the direction different from that of FIG. 12, in which the bill separation/conveyance subsidiary body circulation device, the airstream generation device and the like are attached in the bill housing stacker from which some parts are removed, according to one or more embodiments of the present invention.

FIG. 10 is a front view of the bill housing stacker 5 in the situation in which the front cover is removed (the situation which is viewed from the arrow A of FIG. 1). FIG. 11 is a perspective view of the bill housing stacker 5 in the situation in which the front cover is removed. FIG. 12 and FIG. 13 are perspective views showing the attachment situation in which the bill separation/conveyance subsidiary body circulation device 11, the airstream generation device 14 and the like are attached in the bill housing stacker 5 from which some parts are removed.

The bill housing stacker 5 has a vertically long rectangular parallelepiped shape. In the lower portion of the inside thereof, the airstream generation device 14 and the motor 14*c* thereof are arranged. In the upper portion thereof, the bill separation/conveyance subsidiary body circulation device 11 is attached. The air blowing path 14*a* of the airstream generation device 14 extends upwardly and is connected with the conveyance subsidiary body insertion device 40. The air sucking path 14*b* extends further upwardly and is connected with the separation/collection device 70.

In addition, in the bill housing stacker 5, the bill containing unit 21 for containing the bills 6, the bill conveyance unit 22 for conveying the bill 6 separated and collected by the separation/collection device 70 to the bill containing unit 21, the control unit 23 for controlling the operation of each type of equipment in the paper sheet conveyance device 10 and the gaming machine unit facility 2, the power supply unit 24 for supplying the power to each equipment of the gaming machine unit facility 2, and the like are included and arranged. The bill 6 discharged from the bill discharging port provided on the rear end of the separation/collection device 70, passes along the route shown by the arrow B of FIG. 10, and is received by the arranged bill conveyance unit 22.

Figure 14:
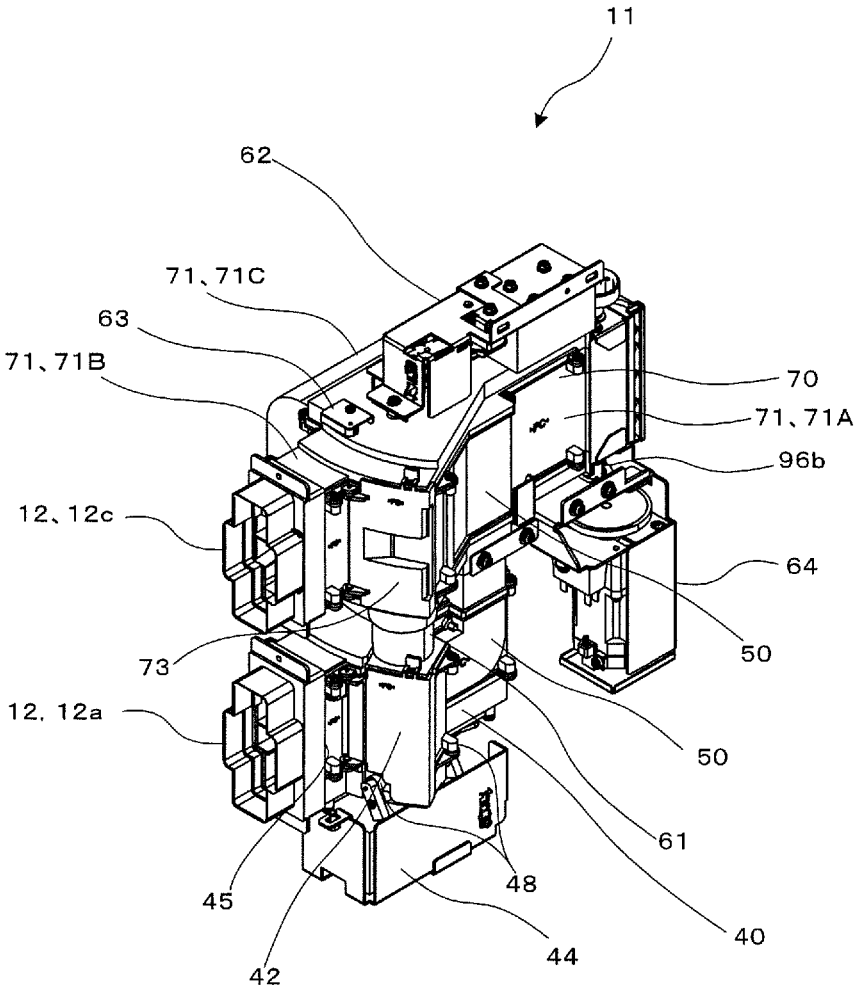
FIG. 14 This is a perspective view showing the overview of the bill separation/conveyance subsidiary body circulation device which is viewed from the side of the conveyance duct connection port, according to one or more embodiments of the present invention.
Figure 15:
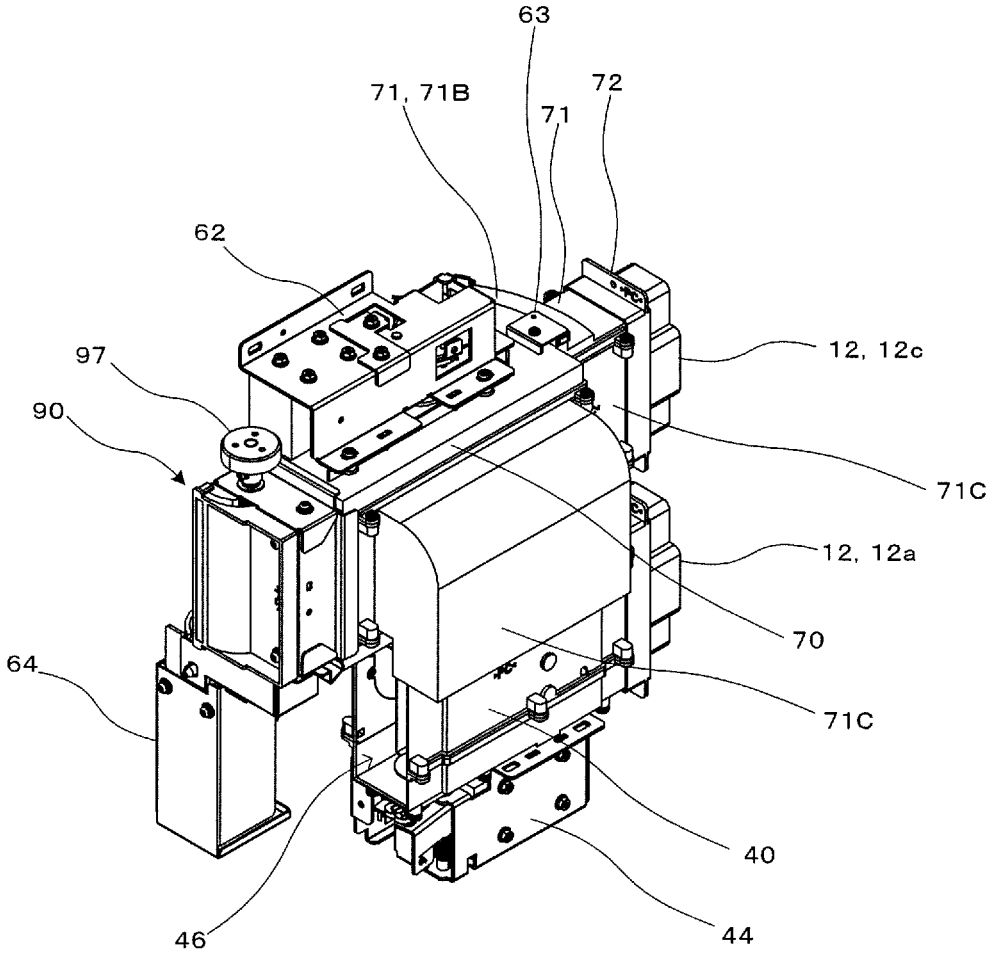
FIG. 15 This is a perspective view showing the overview of the bill separation/conveyance subsidiary body circulation device which is viewed from the side opposite to that of FIG. 14, according to one or more embodiments of the present invention.

FIG. 14 and FIG. 15 show the overview of the bill separation/conveyance subsidiary body circulation device 11. The bill separation/conveyance subsidiary body circulation device 11 is configured so as to unite the conveyance subsidiary body insertion device 40 for sending out the conveyance subsidiary body 16 in the conveyance duct 12 with the separation/collection device 70 which is arranged above the conveyance subsidiary body insertion device 40 and which separates the bill 6 from the conveyance subsidiary body 16 and collects the bill 6 and the conveyance subsidiary body 16.

The conveyance subsidiary body 16 separated and collected by the separation/collection device 70 is dropped via the guide path 61 for connecting the expanding chamber 73 of the separation/collection device 70 with the standby unit 42 of the conveyance subsidiary body insertion device 40, to transfer the conveyance subsidiary body 16 from the separation/collection device 70 to the conveyance subsidiary body insertion device 40.

Firstly, the detail of the separation/collection device 70 will be explained.

Figure 16:
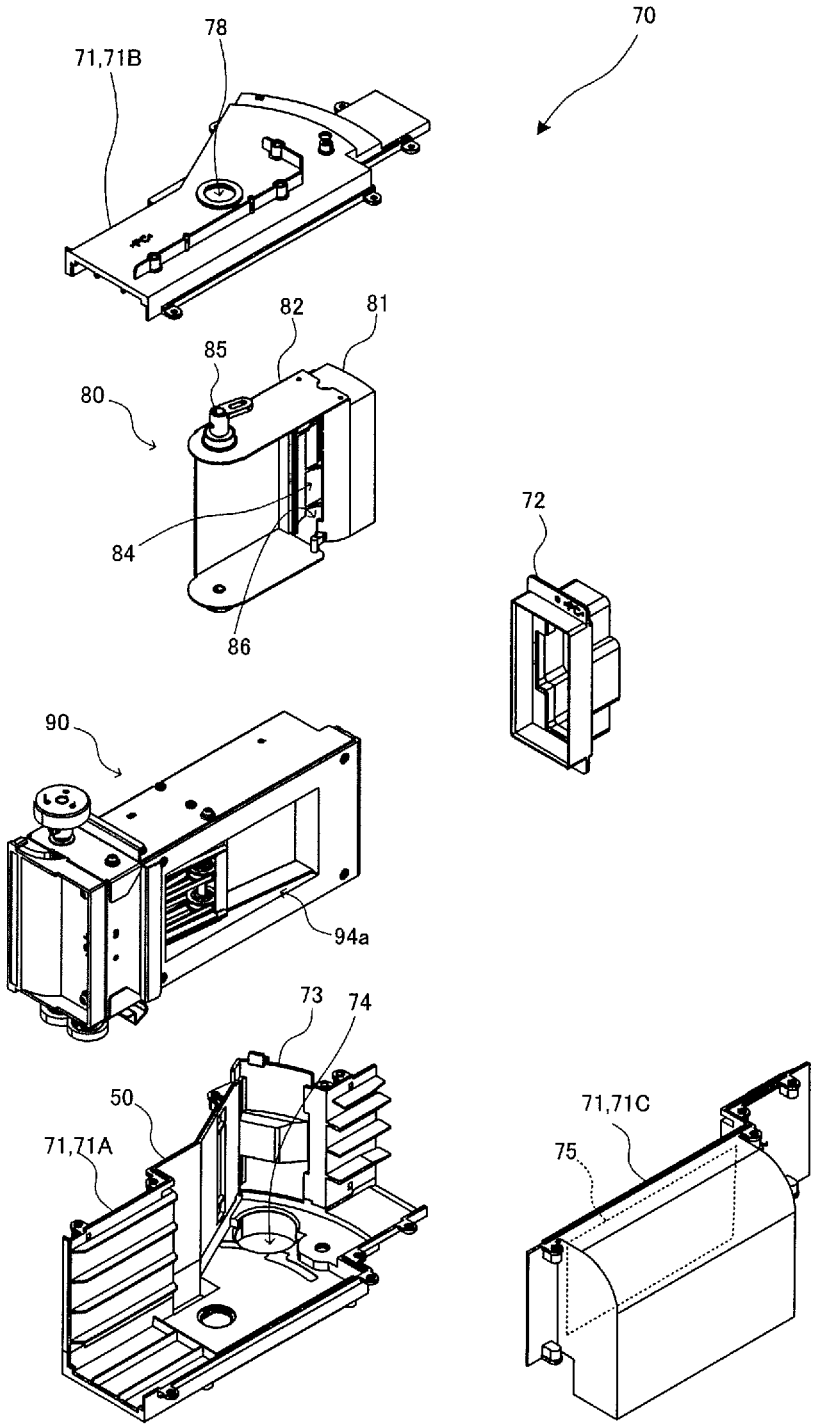
FIG. 16 This is an exploded perspective view of the separation/collection device, according to one or more embodiments of the present invention.

FIG. 16 is an exploded perspective view of the separation/collection device 70. The separation/collection device 70 comprises an outer frame unit 71 having a hollowed cylinder shape by combining a frame part 71A for forming one side wall and the bottom surface, an upper cover part 71B and a side wall duct part 71C for forming the other side wall and for functioning as the sucking duct for sucking the air; the conveyance duct connection part 72 which is fitted to the opening of the front end of the outer frame unit 71 and is connected with the ending portion of the conveyance duct 12; the inner unit 90 which is detachably inserted in the outer frame unit 71 from the opening of the rear end of the outer frame unit 71; and a separation unit 80 which is rotatably attached in the outer frame unit 71. The separation unit 80 has the function for separating the bill 6 from the conveyance subsidiary body 16 by passing the bill 6 pushed and conveyed by the conveyance subsidiary body 16 in the downstream direction and by capturing the conveyance subsidiary body 16. The inner unit 90 comprises a path for receiving the bill 6 separated by the separation unit 80 therein.

The separation unit 80 and the inner unit 90 are set in the outer frame unit 71 at the positional relation shown in FIG. 17 to FIG. 20.

Figure 18:
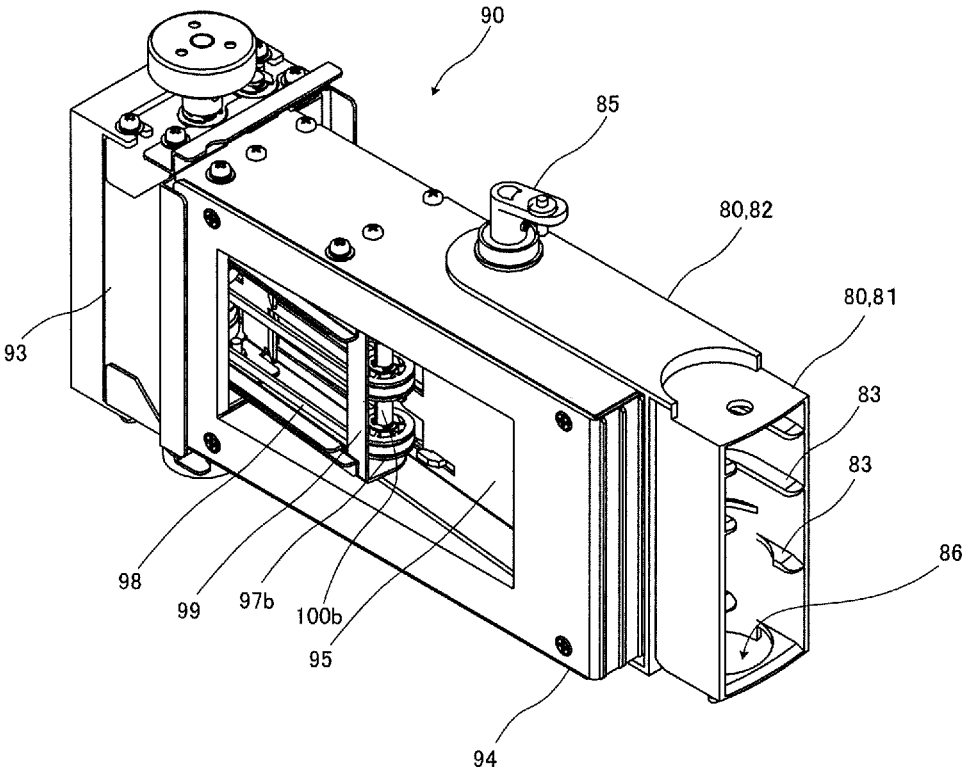
FIG. 18 This is a perspective view of the inner unit and the separation unit positioned on the collection position, which are obliquely viewed from the upstream side, according to one or more embodiments of the present invention.
Figure 19:
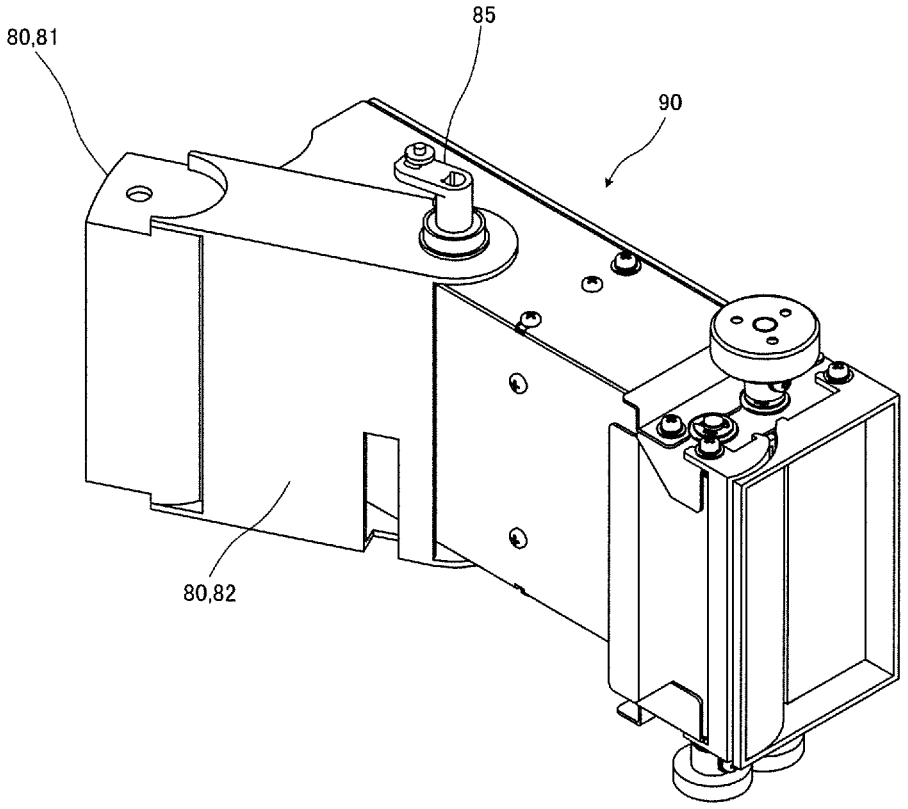
FIG. 19 This is a perspective view of the inner unit and the separation unit positioned on the discharge position, which are obliquely viewed from the downstream side, according to one or more embodiments of the present invention.

The separation unit 80 comprises a holding unit 81 for passing the bill 6 pushed and conveyed by the conveyance subsidiary body 16 in the downstream direction and for stopping the conveyance subsidiary body 16 by contacting therewith, and a supporting unit 82 extending from the holding unit 81. As shown in FIG. 18, the holding unit 81 has the shape formed by dividing the hollowed cylinder into 2 sections along the axis thereof, and has the structure in which the conveyance subsidiary body 16 received from the rectangular opening corresponding to the divided face is stopped by contacting with the inner side of the semi-cylindrical wall portion.

In the inner surface of the semi-cylindrical wall portion of the holding unit 81, the guide rails 83 (See FIG. 18) for regulating the posture of the held conveyance subsidiary body 16 so as not to incline, are provided. In the bottom portion of the holding unit 81, the discharging opening 86 for dropping the conveyance subsidiary body 16 into the guide path 61 is provided. The guide rails 83 are formed so as not to prevent the conveyance subsidiary body 16 from being dropped from the discharging opening 86.

Further, in the middle of the semi-cylindrical wall portion of the holding unit 81, the longitudinal rectangular passing port 84 for passing the bill 6 in the downstream direction is provided (See FIG. 16). The passing port 84 has an opening width which is enough to pass the bills 6 even in the situation in which ten or more bills are bundled.

Figure 17:
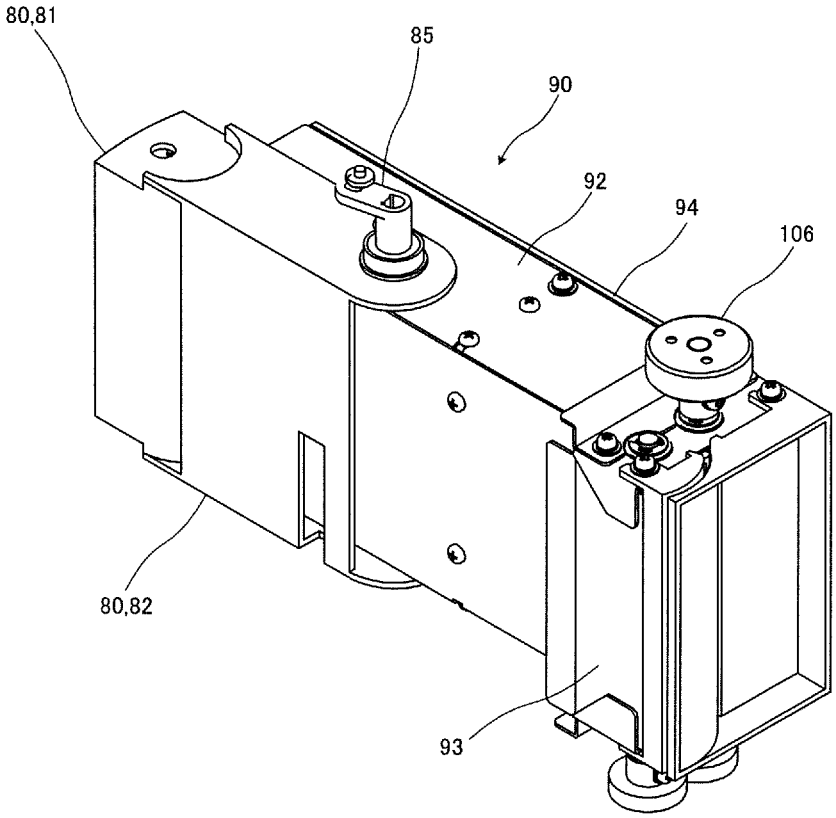
FIG. 17 This is a perspective view of the inner unit and the separation unit positioned on the collection position, which are obliquely viewed from the downstream side, according to one or more embodiments of the present invention.

The supporting unit 82 extends from the holding unit 81 toward the downstream side in the conveyance direction, and forms an arm portion having a C-shaped cross section and having a predetermined length. The supporting unit 82 is rotatably attached to the outer frame unit 71 so as to arrange the holding unit 81 on the upstream side (the conveyance duct connection port 72 side) by inserting the projection shaft 85 provided on the base end side of the supporting unit 82 into the shaft hole 78 (See FIG. 16) of the outer frame unit 71. When the inner unit 90 is inserted into the outer frame unit 71, as shown in FIG. 17, the supporting unit 82 having the C-shaped cross section is fitted to the outer side of the upstream end portion of the inner unit 90.

The outer frame unit 71 has the expanded portion (the expanding chamber 73) having a sector form in which the arc is arranged on the conveyance duct connection port 72 side, in a part of the tubular path having a rectangular cross section. The expanding chamber 73 is a space formed in order to rotate the separation unit 80 within the predetermined angular range around the projection shaft 85 inserted into the shaft hole 78.

Further, the circular dropping opening 74 is provided on the bottom portion of the expanding chamber 73. The separation unit 80 rotates around the projection shaft 85 between the collection position on which the holding unit 81 approaches to the ending portion of the conveyance duct 12 (See FIG. 17, FIG. 18 and FIG. 30(*a*)) and the discharge position on which the holding unit 81 enters the expanding chamber 73 (See FIG. 19, FIG. 20 and FIG. 30(*b*)). On the discharge position, the conveyance subsidiary body 16 is discharged to the conveyance subsidiary body insertion device 40 provided below from the discharging opening 86 provided in the bottom portion of the holding unit 81 via the dropping opening 74 and the guide path 61 (See FIG. 14). The separation unit 80 is actuated by the first actuating unit 62 (See FIG. 15) arranged on the outer frame unit 71 to rotate between the collection position and the discharge position. In one or more embodiments, the first actuating unit 62 is a solenoid actuator.

In the side wall duct part 71C (See FIG. 16), the sucking port 75 is opened so as to face to the side wall of the frame part 71A. The side duct wall part 71C forms a tubular path having an upside down L-shaped form extending outwardly from the sucking port 75. The air sucking path 14*b* is connected with the lower end of the side wall duct part 71C. The sucking port 75 is partitioned into a plurality of small ports (in one or more embodiments, three ports) by the bill sucking prevention walls 77 provided in the side wall duct part 71C (See FIG. 30). Each small port is made small so as not to suck the bill 6 from the sucking port 75 in the situation in which the inner unit 90 is removed.

In addition, on the upper portion of the upstream end portion of the outer frame unit 71, the conveyance subsidiary body detection sensor 63 for detecting the arrival of the conveyance subsidiary body 16 at the holding unit 81 of the separation unit 80, is provided (See FIG. 14).

Figure 21:
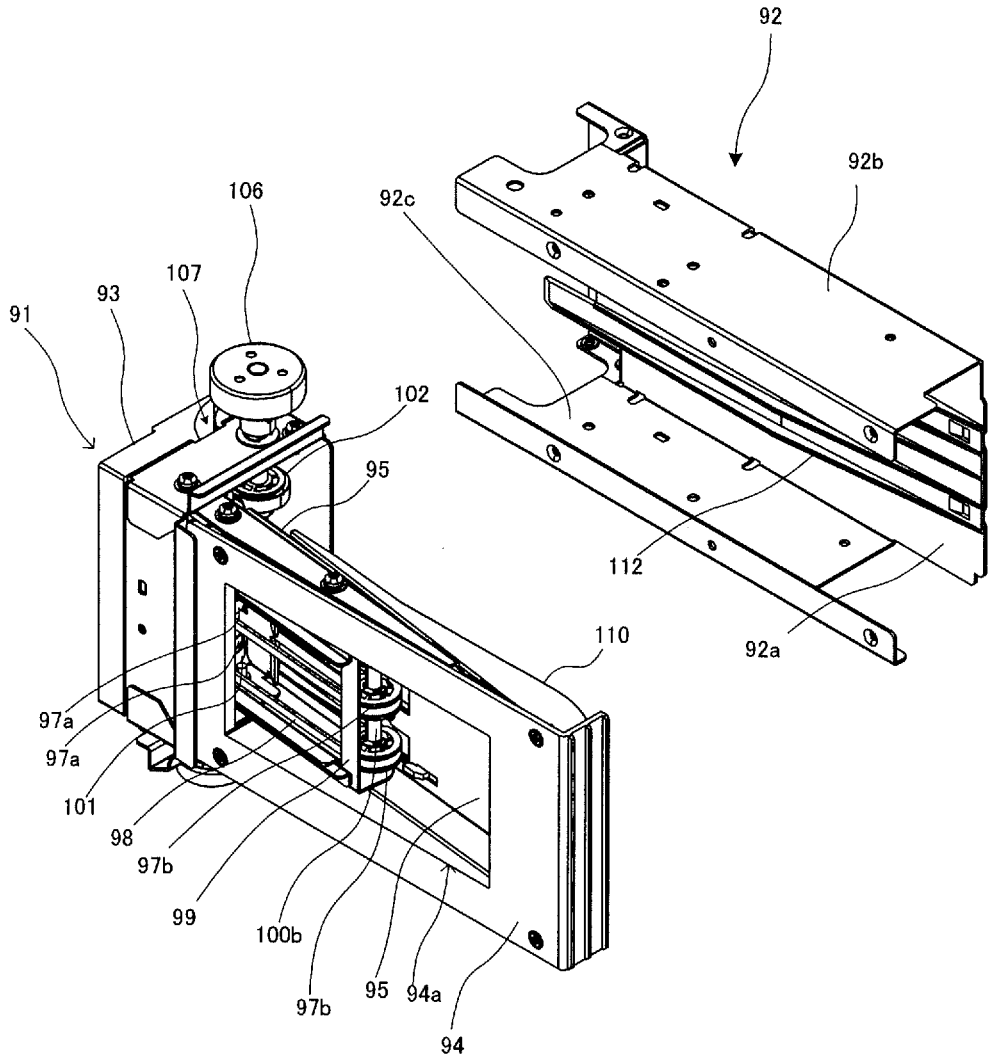
FIG. 21 This is a perspective view showing the situation in which the inner unit main body portion of the inner unit is separated from the inner unit cover portion of the inner unit, according to one or more embodiments of the present invention.
Figure 22:
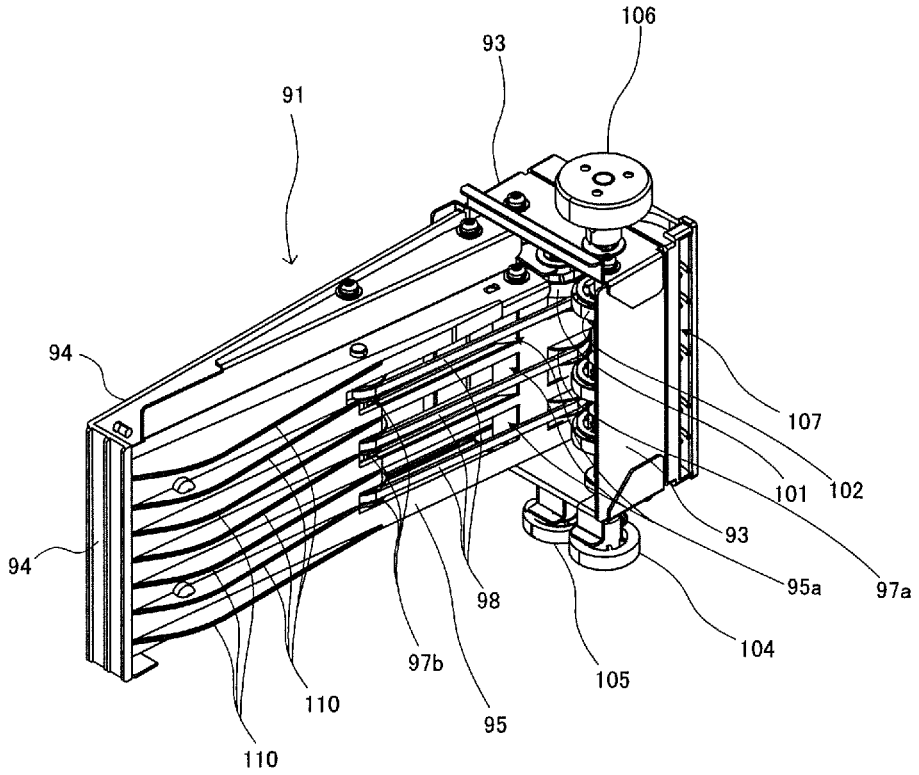
FIG. 22 This is a perspective view showing the inner unit main body portion, according to one or more embodiments of the present invention.
Figure 23:
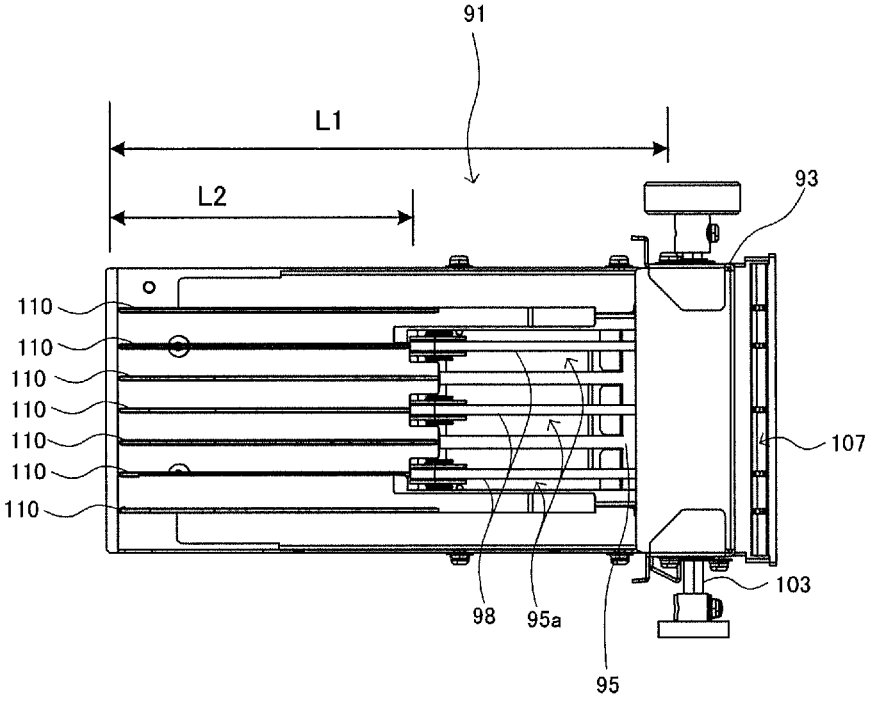
FIG. 23 This is a front view showing the inner unit main body portion, according to one or more embodiments of the present invention.
Figure 24:
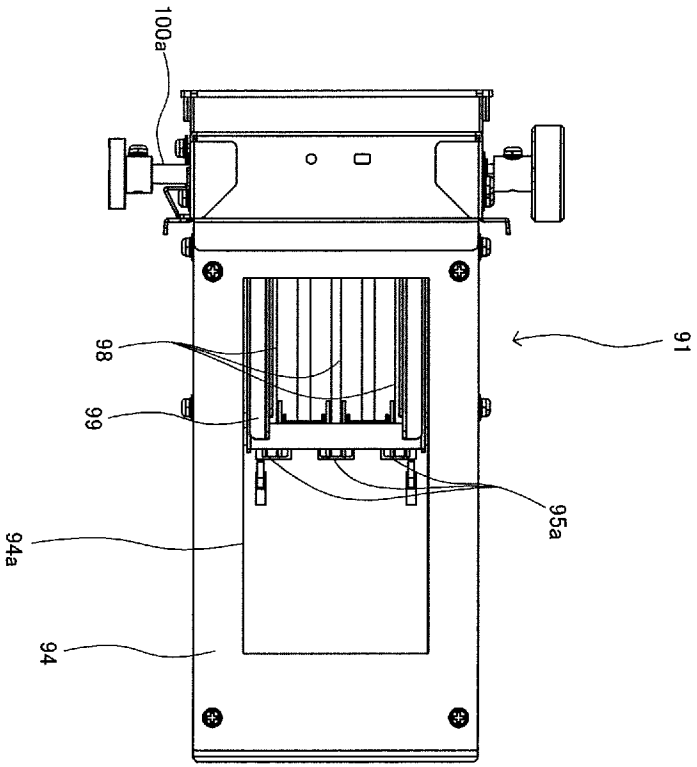
FIG. 24 This is a back view showing the inner unit main body portion, according to one or more embodiments of the present invention.
Figure 25:
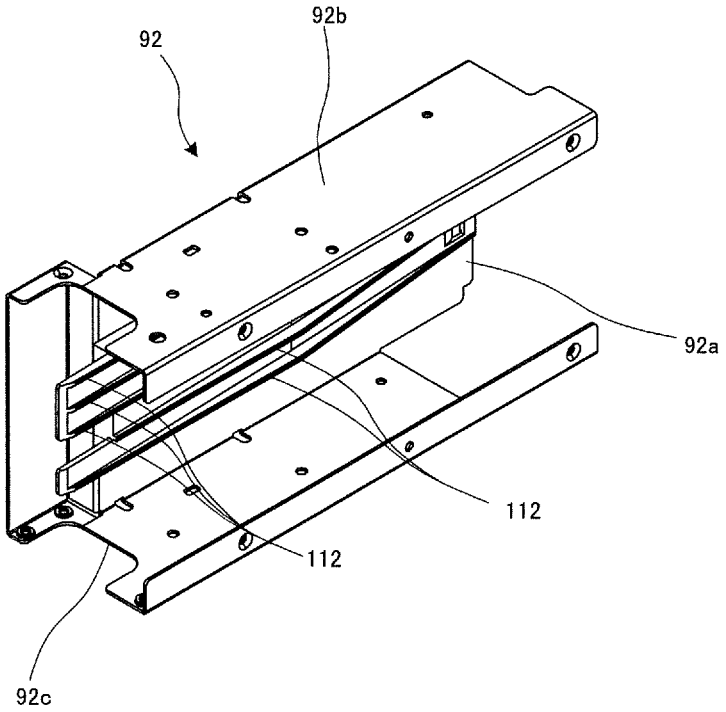
FIG. 25 This is a perspective view showing the inner unit cover portion, according to one or more embodiments of the present invention.
Figure 26:
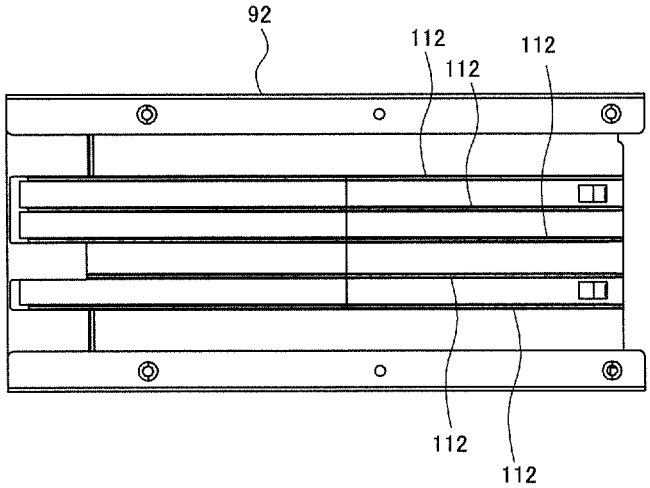
FIG. 26 This is a front view showing the inner unit main body portion, according to one or more embodiments of the present invention.
Figure 27:
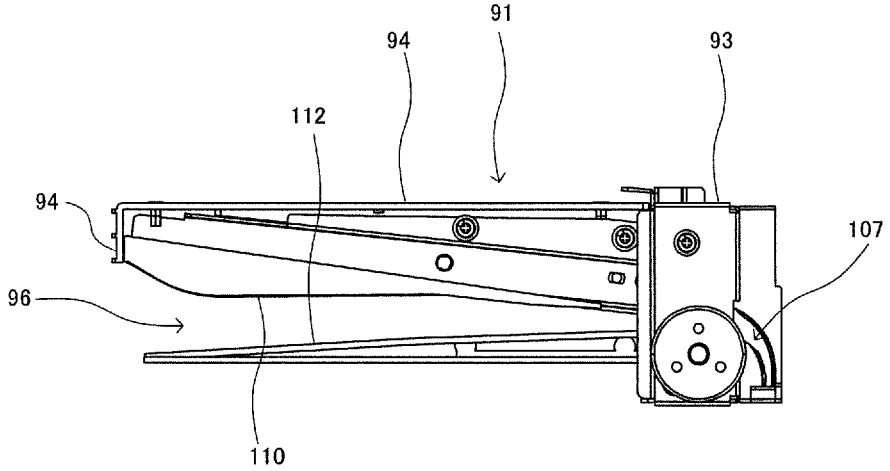
FIG. 27 This is an explanatory view showing the inside of the inner unit and the situation in which the inner unit main body portion faces to the inner unit cover portion in the inner unit, according to one or more embodiments of the present invention.

The inner unit 90 forms the tubular shape having a rectangular cross section. As shown in FIG. 21, the inner unit 90 comprises an inner unit main body portion 91 having conveyance belts 98 and the like, and an inner unit cover portion 92 having a substantially C-shaped cross section and formed by three longitudinal side walls (an upper face 92*b*, a bottom face 92*c* and an opposing wall 92*a*). FIG. 22 is a perspective view of the inner unit main body portion 91. FIG. 23 is a front view of the inner unit main body portion 91. FIG. 24 is a back view of the inner unit main body portion 91. FIG. 25 is a perspective view of the inner unit cover portion 92. FIG. 26 is a front view of the inner unit cover portion 92. FIG. 27 shows the inside of the inner unit 90 and the situation in which the inner unit main body portion 91 faces to the inner unit cover portion 92 in the inner unit 90.

As shown in FIG. 21 and FIG. 22, the inner unit main body portion 91 comprises a basic part 93 forming the downstream end portion, a first side wall 94 extending from the basic part 93 so as to form one side wall in the longitudinal direction of the inner unit 90, and having the tip which is bent inward and extends by the length of ⅖ of the width of the inner unit 90, and a partition wall 95 which extends from the portion in which the tip of the first side wall 94 is bent inward and is terminated, to the basic part 93, and which is inclined gradually apart from the side wall of the first side wall 94 in the longitudinal direction.

In the first side wall 94, as shown in FIG. 16, FIG. 21, FIG. 24 and the like, a large opening 94*a* is provided as the air sucking port. When the inner unit 90 is set by inserting the inner unit 90 into the outer frame unit 71, the opening 94*a* faces to the sucking port 75 of the side wall duct part 71C of the outer frame unit 71.

The inner space of the inner unit 90 is partitioned into two spaces by the partition wall 95. Between the partition wall 95 and the wall face (the opposing wall 92*a*) which is opposite to the partition wall 95 in the inner unit cover portion 92, the path part 96 which is a path for receiving the bill 6 output from the passing port 84 of the separation unit 80 is formed (See FIG. 20). That is, the partition wall 95 which partitions the inner space of the inner unit 90 into two spaces, forms the wall face which faces to one surface of the bill 6 output from the passing port 84 of the separation unit 80. The opposing wall 92*a* forms the wall face which faces to the other surface of the bill 6 output from the passing port 84 of the separation unit 80. The space therebetween becomes the path part 96.

Figure 20:
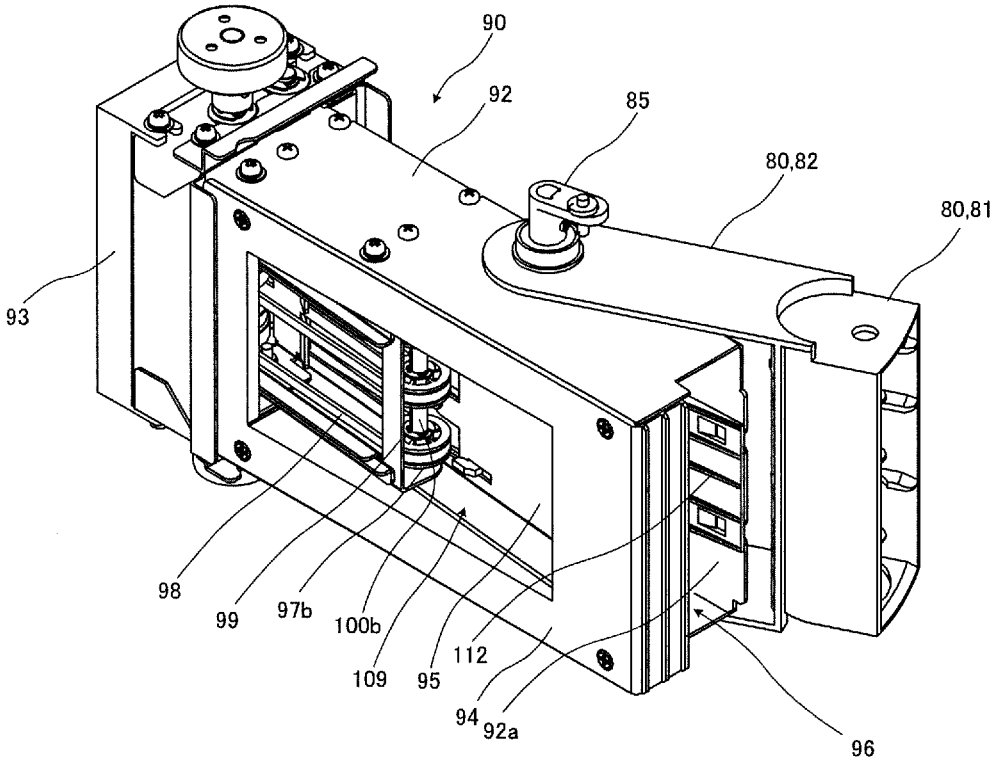
FIG. 20 This is a perspective view of the inner unit and the separation unit positioned on the discharge position, which are obliquely viewed from the upstream side, according to one or more embodiments of the present invention.
Figure 30A:
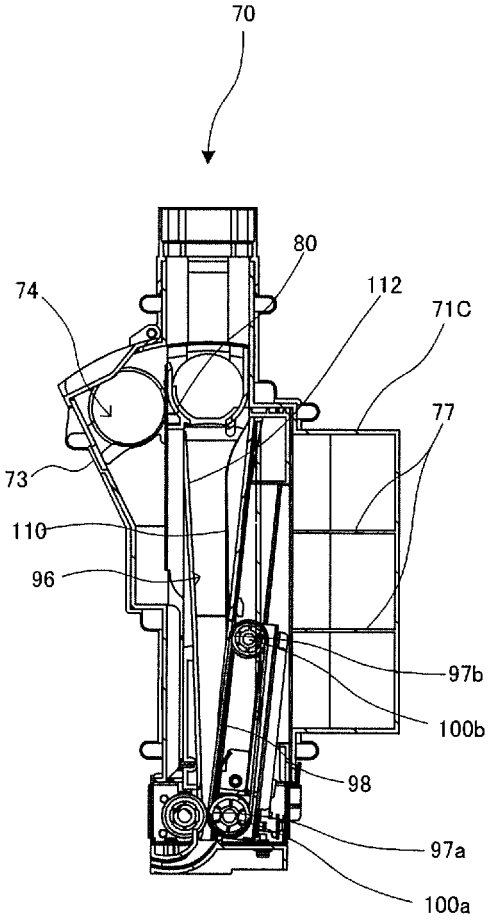
FIGS. 30(*a*) and (*b*) These are explanatory views showing the situation in which the separation unit is positioned on the collection position and the situation in which the separation unit is positioned on the discharge position, so as to compare each other, according to one or more embodiments of the present invention.
Figure 30B:
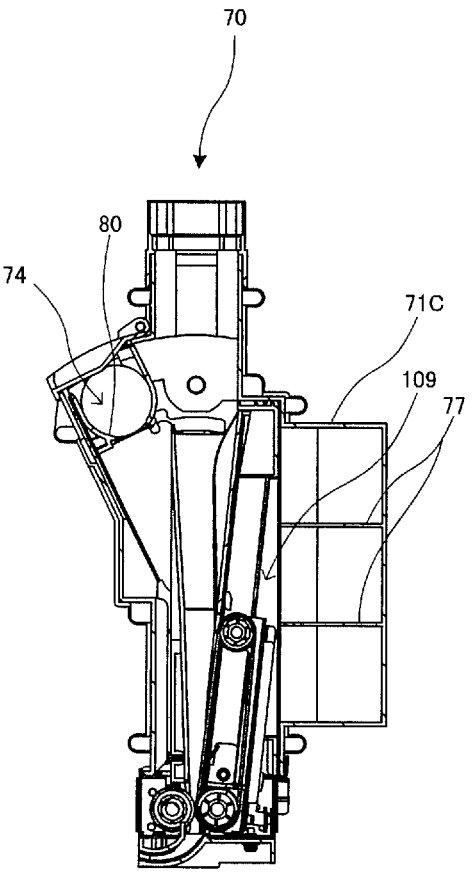

On the other hand, the space between the partition wall 95 and the first wall 94 is an air path 109 for sucking the air (See FIG. 20 and FIG. 30).

In the partition wall 95, three elongated openings 95*a* are provided along the longitudinal direction of the partition wall 95 in the downstream range from the substantially half point of the area between the upstream end of the partition wall 95 and the position just before the basic part 93 arranged on the downstream side, at the predetermined interval in the height direction of the partition wall 95 (See FIG. 22 and FIG. 23).

Figure 28:
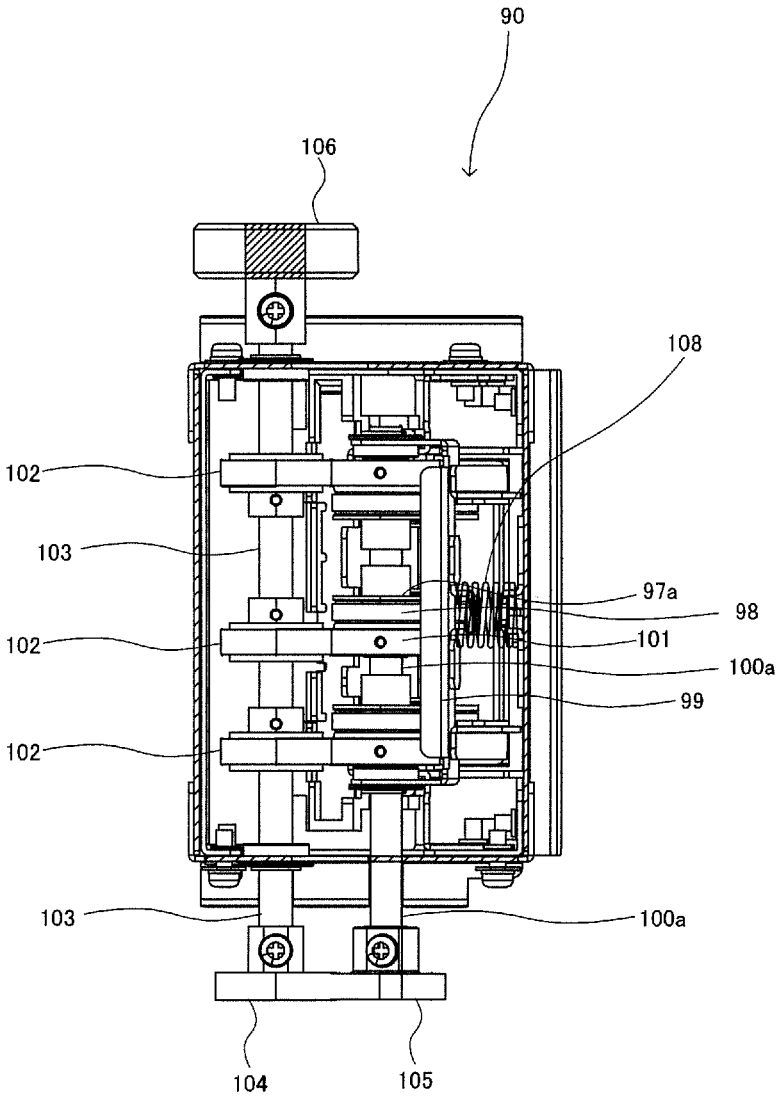
FIG. 28 This is a view showing the inside of the basic part of the inner unit, according to one or more embodiments of the present invention.

Further, in the basic part 93, the downstream pulley 97*a* is provided on the position corresponding to each opening 95*a* near the downstream side of the downstream end of the partition wall 95 (See FIG. 22, FIG. 28 and FIG. 30). Between the partition wall 95 and the first side wall 94, the upstream pulley 97*b* is provided near the upstream end of each opening 95*a* so as to expose a part of the pulley 97*b* from the opening 95*a* to the path part 96 (See FIG. 21, FIG. 22, FIG. 30 and the like).

Between each upstream pulley 97*b* and each downstream pulley 97*a* provided on the position corresponding to this upstream pulley 97*b*, the endless conveyance belt 98 is bridged so as to be wound by using the above pulleys as the both ends. Three conveyance belts 98 are bridged in parallel apart from each other in the up and down direction. The interval between two conveyance belts 98 arranged on the upper and the lower sides among the three conveyance belts 98 is slightly shorter than the length of the short side of the bill 6 (the side along the direction perpendicular to the conveyance direction). Each conveyance belt 98 is bridged so as to pass the first half of the conveyance belt 98 on the path part 96 side of the partition wall 95 and to pass the second half thereof on the first wall 94 side of the partition wall 95. Each conveyance belt 98 is actuated so as to move the first half thereof from the upstream side of the path part 96 to the downstream side thereof.

As shown in FIG. 21, the upstream pulleys 97*b* are provided on the upstream rotation shaft 100*b*. The downstream pulleys 97*a* are provided on the downstream rotation shaft 100*a* (See FIG. 28). The upstream rotation shaft 100*b* and the downstream shaft 100*a* are supported at the both ends of the movable frame 99 for unitedly connecting them. Both the upper and the lower ends of the partition wall 95 are bent to the first wall 94 side. Both ends of the upstream rotation shaft 100*b* are pivotally supported with the movable frame 99 at the above bent portions. The movable frame 99 is provided so as to be shaken around the upstream rotation shaft 100*b*.

Figure 29:
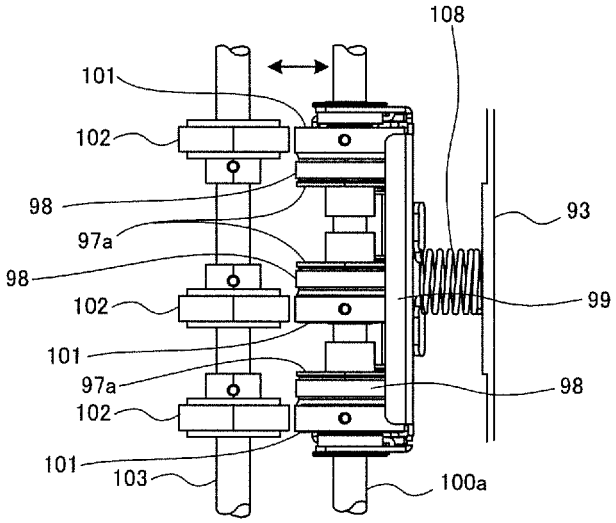
FIG. 29 This is a view showing the structure in which the discharge rollers are closely contacted with the opposing discharge rollers in the basic part of the inner unit, according to one or more embodiments of the present invention.

As shown in FIG. 28 and FIG. 29, in the downstream rotation shaft 100*a*, the discharge rollers 101 are provided, and each of the discharge rollers 101 has substantially the same diameter as the downstream pulley 97*a* and is provided together with each of the downstream rollers 97*a*. In the basic part 93, the opposing discharge rollers 102 are arranged so as to oppose to the discharge rollers 101. The discharge roller 101 and the opposing discharge roller 102 constitute a pair of the rollers for discharging the bill 6 conveyed by the conveyance belts 98 by being sandwiched therebetween. The opposing discharge rollers 102 are provided on the rotation shaft 103 of which both ends are supported by the basic part 93.

The downstream end of the movable frame 99 is biased by the spring 108 so as to push the discharge rollers 101 toward the opposing discharge rollers 102. By shaking the movable frame 97, the shaft interval between the rotation shaft 103 for supporting the opposing discharge rollers 102 and the downstream rotation shaft 100*a* for supporting the discharge rollers 101 can be changed.

The rotation shaft 103 on which the opposing discharge rollers 102 are provided, projects downwardly from the basic part 93, and has the transmission gear 104 on the lower end thereof. Further, the downstream rotation shaft 100*a* also projects downwardly, and has the transmission gear 105 on the lower end thereof. The transmission gear 105 is engaged with the transmission gear 104. The power generated by the separation conveyance actuating unit 64 (See FIG. 14) comprising a motor and the like, is transmitted to the transmission gear 104, and is further transmitted to the transmission gear 105. Thereby, the opposing discharge rollers 102 and the discharge rollers 101 are rotated and the conveyance belts 98 are rotatably actuated.

Further, the rotation shaft 103 projects upwardly from the basic part 93 of the inner unit 90. On the upper end thereof, the handle 106 for manually rotating the rotation shaft 103 is attached. In case that the bill 6 is jammed in the inner unit 90, by manually rotating the handle 106, the jammed bill 6 is discharged from the rear end of the inner unit 90. In the rear end of the inner unit 90, the bill discharge path 107 for bending the course of the discharged bill 6 laterally, is provided (See FIG. 21 and FIG. 22).

On the face of the partition wall 95, which faces to the path part 96, the ribs 110 projecting into the path part 96 are provided (See FIG. 22 and the like). Each rib 110 extends from the upstream end of the partition wall 95 (near the passing port 84 of the separation unit 80) to the position just before the opening 95*a* (that is, the position on which the conveyance belt 98 is bridged). Further, each rib 110 has a mound form which is heightened near the upstream end thereof. Each rib 110 is provided on the position corresponding to each conveyance belt 98 (so as to arrange the conveyance belt 98 on the extended line of the rib 110). Further, each rib 110 is arranged in the middle position of the conveyance belt 98 and the like, and seven ribs 110 are formed at an equal interval so as to cover the entire width of the bill 6.

Further, on the opposing wall 92*a* of the inner unit cover portion 92, the ribs (the opposing ribs 112) extending in the extending direction of the path part 96 so as to oppose to the ribs 110 provided on the partition wall 95, are provided (See FIG. 21). Five opposing ribs 112 are provided so as to oppose to the middle five of the seven ribs 110. The opposing ribs 112 extend from the position near the upstream end of the inner unit 90 (near the passing port 84 of the separation unit 80) to the position near the opposing discharge rollers 102 in the basic part 93, and are gradually heightened toward the downstream side. The bill 6 passing through the passing port 84 of the separation unit 80, moves between the ribs 110 and the opposing ribs 112 in the path part 96 of the inner unit 90 in the downstream direction.

As shown in FIG. 23, the length L1 of the path part 96 of the inner unit 90 is set so as to be slightly longer than the length of the bill 6 in the conveyance direction. The length L2 from the upstream end of the path part 96 (near the passing port 84 of the separation unit 80) to the conveyance belts 98 is set so as to be about ½ of the length of the bill 6 in the conveyance direction. The length L2 may be changed, and may be set within the range from ⅓ to ⅘ of the length of the bill 6 in the conveyance direction. Further, the length L1 of the path part 96 of the inner unit 90 may be lengthened more than that of FIG. 23.

Next, the operation of the separation/collection device 70 will be explained.

When the airstream generation device 14 generates the airstream, the airstream flows into the separation/collection device 70 from the conveyance duct connection port 72 through the conveyance duct 12. Further, the airstream flows into the path part 96 of the inner unit 90 through the passing port 84 of the separation unit 80. The airstream generation device 14 sucks the air from the sucking port 75 of the side wall duct part 71C of the outer frame unit 71 through the air sucking path 14*b*. By sucking the air, the air existing in the path part 96 is discharged outside through the opening 95 provided on the partition wall 95, the air path 109, the opening 94*a* provided in the first side wall 94, the sucking port 75 (the side wall duct part 71C) and the air sucking path 14*b*.

Figure 31A:
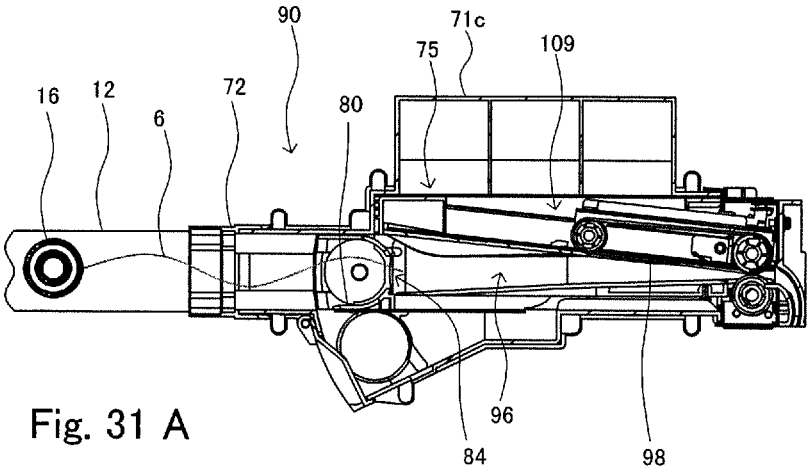
FIGS. 31(*a*)-(*c*) These are views showing each step of the operation in which the separation/collection device separates the bill from the conveyance subsidiary body and collects the bill and the conveyance subsidiary body, according to one or more embodiments of the present invention.
Figure 31B:
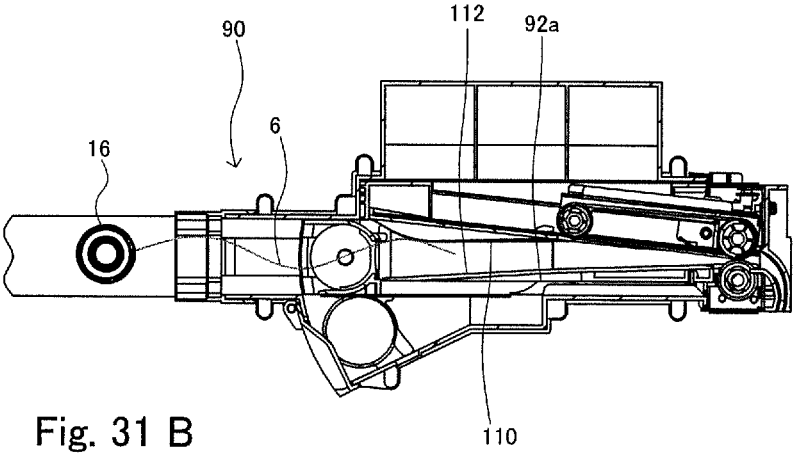
Figure 31C:
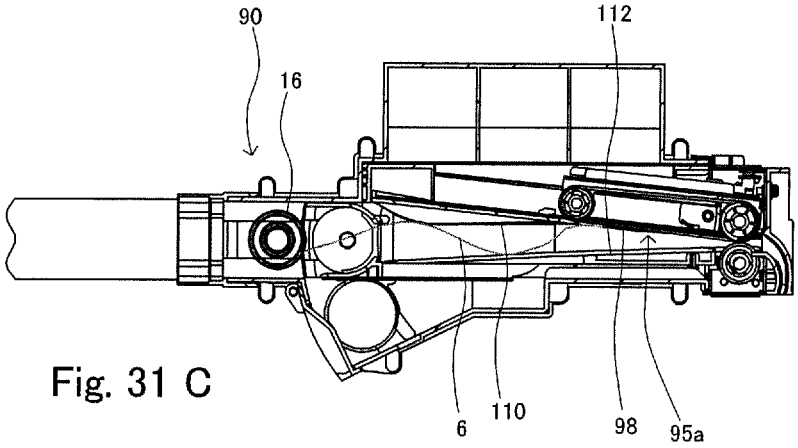

FIG. 31 shows the operation for separating and collecting the bill 6 and the conveyance subsidiary body 16 in the separation/collection device 70. When the bill 6 and the conveyance subsidiary body 16 are separated and collected, the airstream is generated by the airstream generation device 14. Further, the separation unit 80 is set to the collection position, and the conveyance belts 98 are actuated so as to move the first half thereof to the downstream side.

In this situation, when the conveyance subsidiary body 16 which pushes the bill 6 from behind moves near the ending portion of the conveyance duct 12, the front edge of the bill 6 enters the separation unit 80 and moves in the path part 96 provided on the downstream side through the passing port 84 (FIG. 31(*a*)). In the drawing, the situation in which the inelastic bill 6 is conveyed, is shown.

The bill 6 which moves in the path part 96 contacts with the ribs 110, and moves along the ribs 110. Therefore, even when the air in the path part 96 is sucked from the sucking port 75, the front edge of the bill 6 does not cling to the partition wall 95.

The bill 6 which moves in the path part 96, moves along the mound form of each rib 110 toward the opposing ribs 112 (See FIG. 31(*b*)). The bill 6 is guided by the opposing ribs 112 and the ribs 110 and further moves to the downstream side between them.

Then, when the front edge of the bill 6 reaches the area in which the conveyance belts 98 are provided, the front edge portion of the bill 6 clings to the conveyance belts 98 by sucking the air from the opening 95*a* (See FIG. 31(*c*)). At this time, because each rib 110 is provided on the position corresponding to each conveyance belt 98 (on the extended line), the bill 6 is smoothly moved from the end of the ribs 110 to the conveyance belts 98 and clings to the conveyance belts 98. Further, because the opposing ribs 112 are provided so as to be heightened toward the downstream side, the bill 6 is largely jumped and is moved toward the conveyance belt 98. As a result, the bill 6 can securely cling to the conveyance belts 98.

Figure 32A:
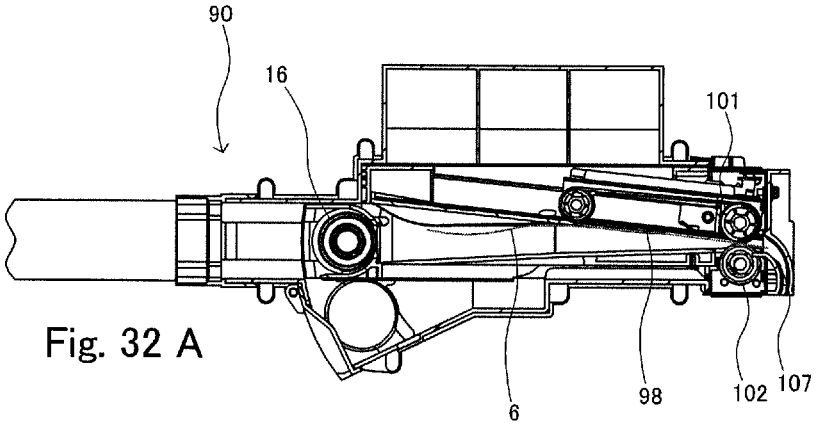
FIGS. 32(*a*) and (*b*) These are views showing each step following those of FIG. 31, according to one or more embodiments of the present invention.
Figure 32B:
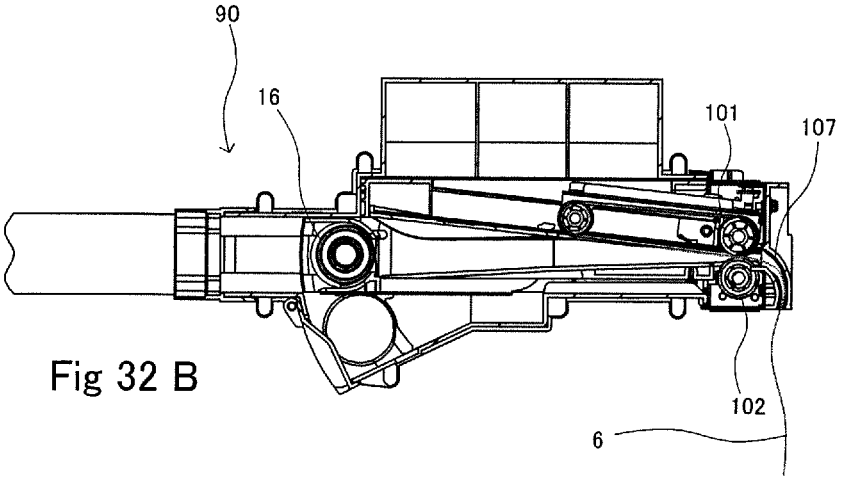

Then, the bill 6 is conveyed by the conveyance belts 98 in the situation in which the bill 6 clings to the conveyance belts 98 (See FIG. 32(*a*)). When the front edge of the bill 6 reaches the downstream end of the conveyance belts 98, the front edge thereof is sandwiched between the discharge rollers 101 and the opposing discharge rollers 102, and the bill 6 is discharged outwardly from the bill discharge path 107 (See FIG. 32(*b*)).

Figure 33A:
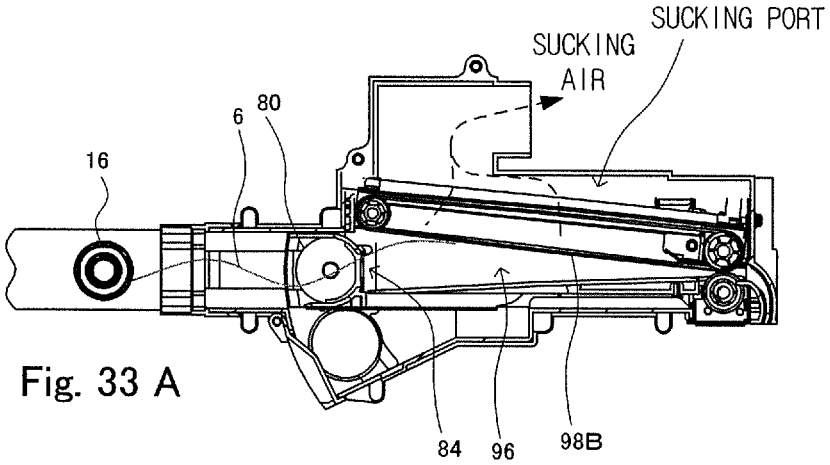
FIGS. 33(*a*)-(*c*) These are views showing each step of the operation in which a conventional separation/collection device separates an inelastic bill from the conveyance subsidiary body and collects the bill and the conveyance subsidiary body.
Figure 33B:
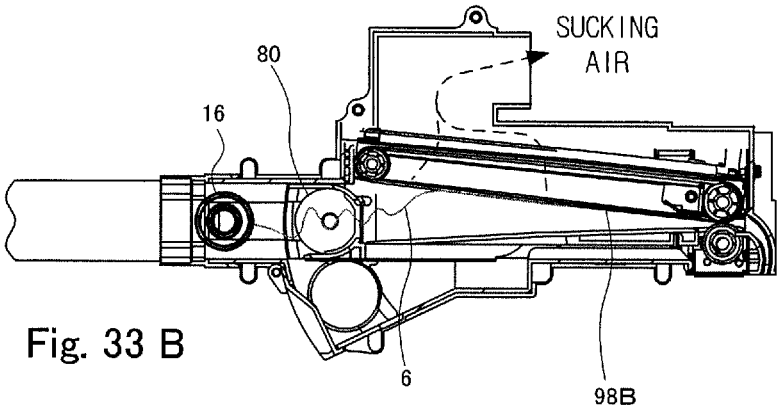
Figure 33C:
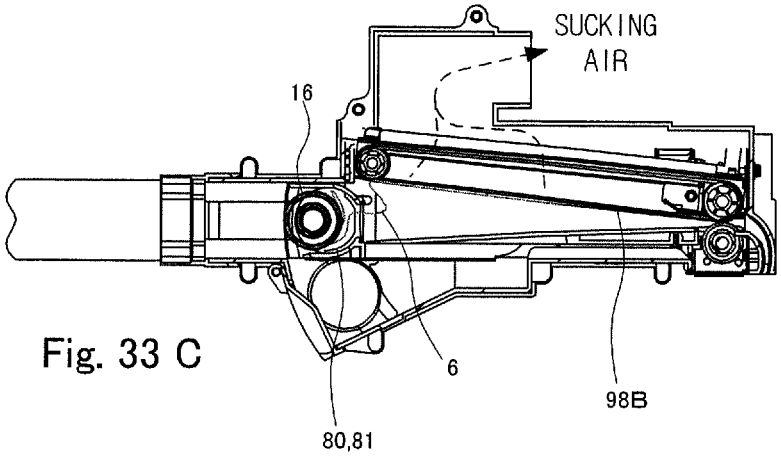

On the other hand, conventionally, because, as shown in FIG. 33, the conveyance belt 98B extends to the position near the passing port 84 of the separation unit 80, as shown in FIG. 33(*a*), in case of the inelastic bill 6, the front edge of the bill 6 clings to the conveyance belt 98B immediately after the front edge of the bill 6 outputs from the passing port 84. Because the movement speed of the conveyance belt 98B is slower than the movement speed of the conveyance subsidiary body 16 which is moved by the airstream, the rear edge of the bill 6 is pushed by the conveyance subsidiary body 16 before the conveyance subsidiary body 16 arrives at the separation unit 80 and is captured. As a result, the part of the bill 6 which has not clung to the conveyance belt 98B yet is folded little by little (See FIG. 33(*b*)).

When the conveyance subsidiary body 16 arrives at the holding unit 81 of the separation unit 80, the bill 6 is crushed and the jamming of the bill 6 is caused (See FIG. 33(*c*)).

In the separation/collection device 70 according to one or more embodiments, because the ribs 110 and the opposing ribs 112 are provided on the upstream inner walls of the path part 96, the bill 6 is prevented from clinging to the wall surface. Further, because the bill 6 is smoothly moved to the downstream side, the above jamming is avoided.

Figure 34:
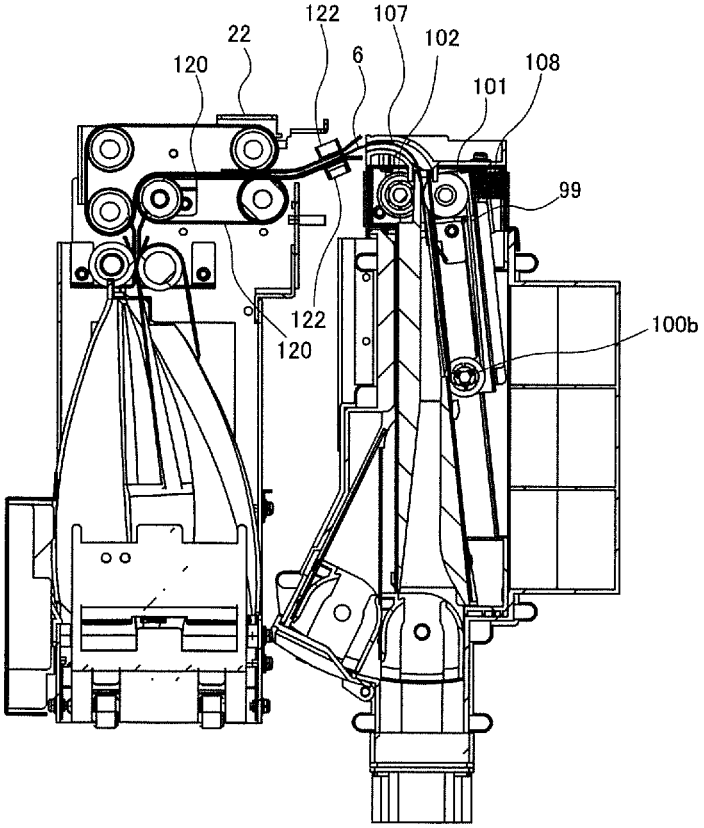
FIG. 34 This is an explanatory view showing the situation in which the bill is conveyed from the separation/collection device to the bill conveyance unit, according to one or more embodiments of the present invention.

As shown in FIG. 34, the bill 6 discharged from the rear end of the inner unit 90 via the bill discharge path 107, reaches the bill conveyance unit 22 in the bill housing stacker 5. Then, the bill 6 is sandwiched by the conveyance belts 120 of the bill conveyance unit 22 to convey the bill 6 to the bill containing unit 21, and is contained therein.

The conveyance speed of the conveyance belts 120 of the bill conveyance unit 22 is faster than the discharge speed at which the bill 6 is discharged by the discharge rollers 101 and the opposing discharge rollers 102 in the inner unit 90 of the separation/collection device 70. Therefore, in the situation in which the front edge of the bill 6 is sandwiched by a pair of the conveyance belts 120 and the rear edge of the bill 6 is sandwiched by the discharge rollers 101 and the opposing discharge rollers 102, the bill 6 is forcedly drawn from the discharge rollers 101 and the opposing discharge rollers 102. At this time, in case that the discharge rollers 101 and the opposing discharge rollers 102 sandwich the bill 6 too strongly, there is some possibility that the bill 6 is jammed.

Therefore, the discharge rollers 101 and the opposing discharge rollers 102 are configured so as to be apart from each other when the pressure having not less than the certain strength is applied to the bill 6. That is, as shown in FIG. 29, the discharge rollers 101 are supported at the downstream portion of the movable frame 99 which is supported by the upstream rotation shaft 100*b* on the upstream side and can be shaken on the downstream side, and the downstream end portion of the movable frame 99 is pressed by the spring 108 toward the opposing discharge rollers 102. Thereby, when the pressure is applied so as to forcedly draw the bill 6 from the discharge rollers 101 and the opposing discharge rollers 102, the discharge rollers 101 and the opposing discharge rollers 102 are slightly displaced so as to be apart from each other. Then, the pressure is released and the jamming of the bill is avoided.

In the separation/collection device 70, after the bill is discharged from the rear end of the inner unit 90, the separation unit 80 rotates to the discharge position by being actuated with the first actuating unit 62. When the separation unit 80 is moved to the discharge position, the held conveyance subsidiary body 16 is dropped from the discharging opening 86 of the bottom portion of the holding unit 81 via the dropping opening 74 of the outer frame unit 71 and the guide path 61, and is collected by being received in the conveyance subsidiary body insertion device 40.

Because the inner unit 90 is detachably attached to the outer frame unit 71, in case that the bill 6 is jammed in the separation/collection device 70, the working can be carried out by extracting the inner unit 90 from the outer frame unit 71. In the situation in which the inner unit 90 is extracted from the outer frame unit 71, there is some possibility that the bill 6 is conveyed via the conveyance duct 12 in business. However, because the opening is partitioned by providing the bill sucking prevention walls 77 on the sucking port 75 of the outer frame unit 71, even though the bill 6 is conveyed to the sucking port 75, the bill 6 is not sucked out from the sucking port 75.

Next, the conveyance subsidiary body insertion device 40 will be explained.

Figure 35:
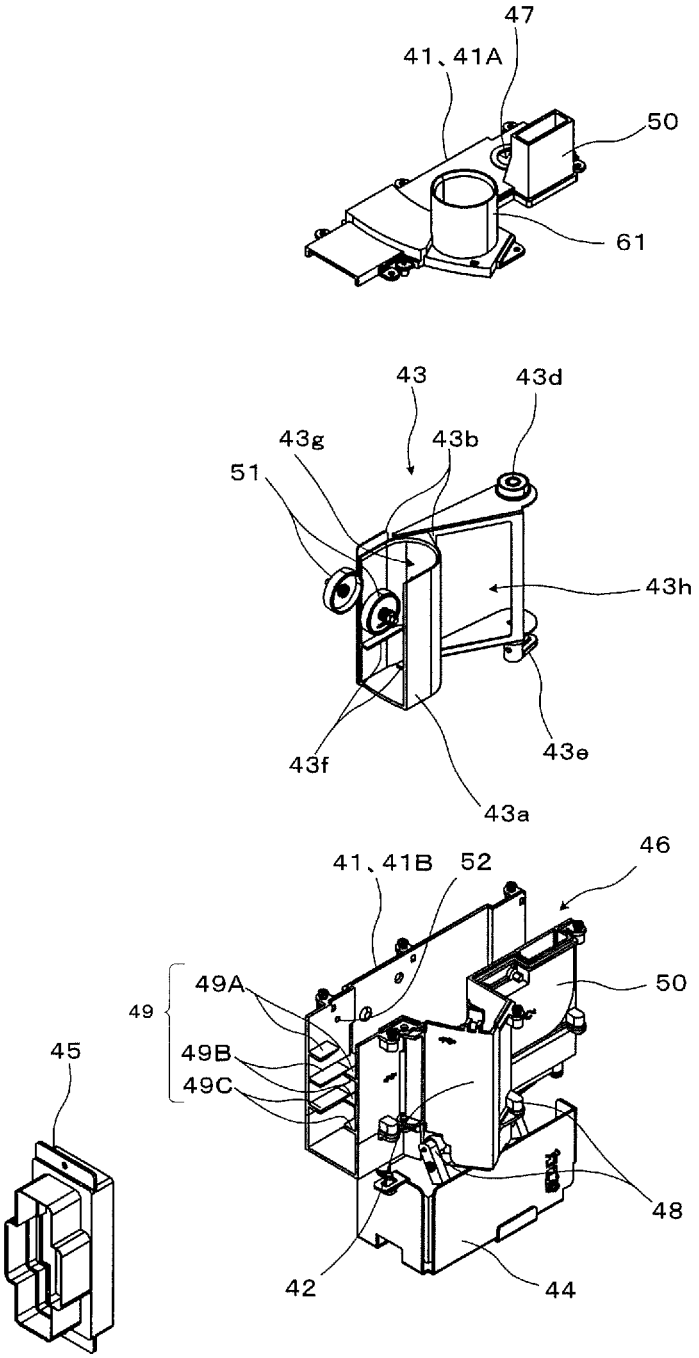
FIG. 35 This is an exploded perspective view of the conveyance subsidiary body insertion device, according to one or more embodiments of the present invention.

FIG. 35 is an exploded perspective view of the conveyance subsidiary body insertion device 40. The conveyance subsidiary body insertion device 40 comprises the sending path 41 and which is a path of the conveyance subsidiary body 16 to be sent out in the conveyance duct 12, the hollowed standby unit 42 which is provided so as to connect with the opening of the side wall of the sending path 41 and which keeps the next conveyance subsidiary body 16 to be sent into the sending path 41 from the above opening, the movable containing unit 43 which holds the conveyance subsidiary body 16 and which is supported so as to reciprocate between the standby unit 42 and the sending path 41 via the opening of the side wall of the sending path 41, the second actuating unit 44 for giving the power to the movable containing unit 43 in order to reciprocate, and the conveyance duct connection port 45 which is connected with the starting portion of the conveyance duct 12. The sending path 41 is configured by combining the upper sending path 41A with the lower sending path 41B.

The sending path 41 is a straight path having the rectangular cross section. One end thereof is connected with the conveyance duct 12 via the conveyance duct connection port 45. The other end thereof is the blowing path connection port 46 connected with the air blowing path 14*a* of the airstream generation device 14. The sending path 41 is configured by the upper sending path 41A for forming the upper surface of the path and the lower sending path 41B for forming the side walls and the bottom surface of the path. In the conveyance subsidiary body insertion device 40, the conveyance duct connection port 45 side is referred to as the downstream side and the blowing path connection port 46 side is referred to as the upstream side.

Figure 37:
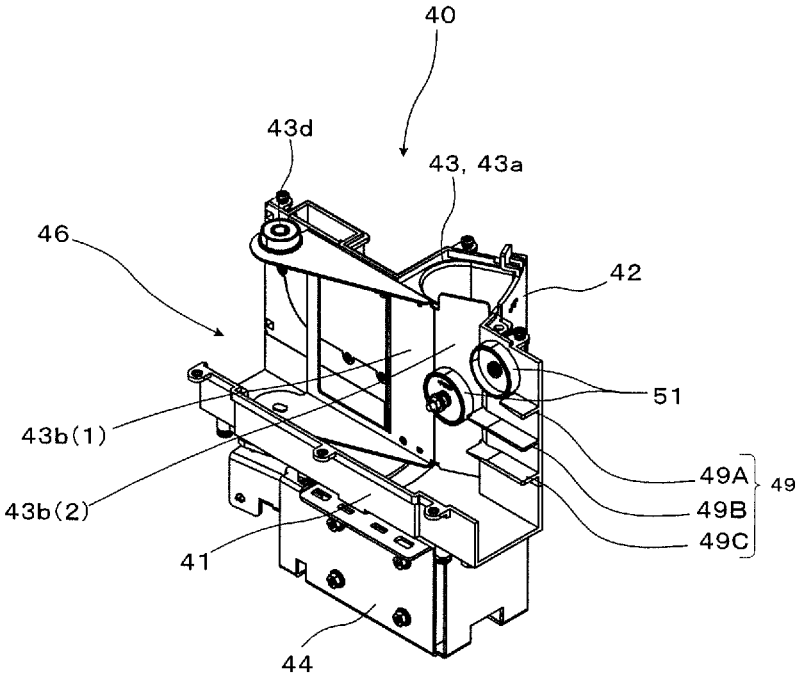
FIG. 37 This is a perspective view showing the conveyance subsidiary body insertion device in which the holding unit of the movable containing unit is positioned on the standby position, in the situation in which the upward sending path is removed, according to one or more embodiments of the present invention.
Figure 38:
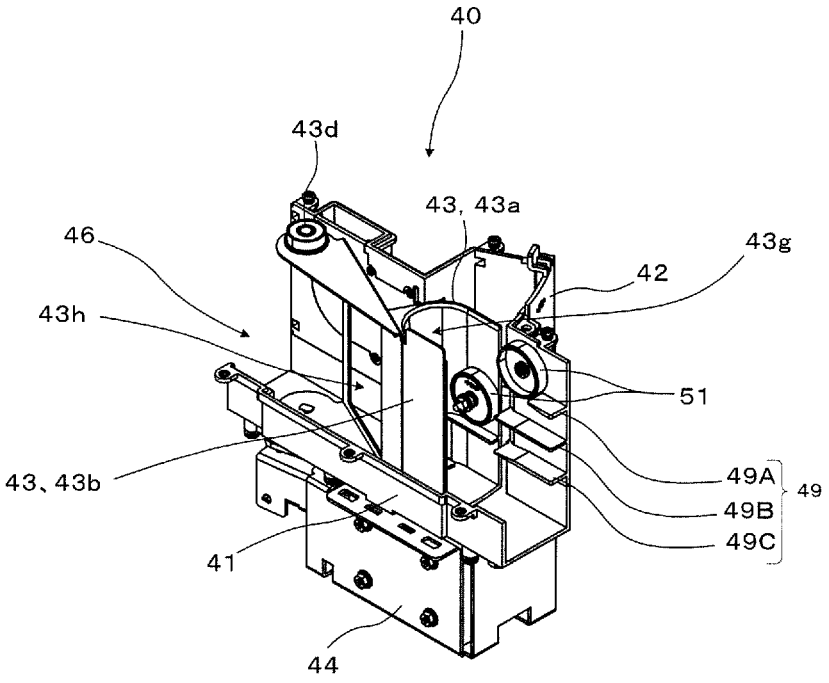
FIG. 38 This is a perspective view showing the conveyance subsidiary body insertion device in which the holding unit of the movable containing unit is positioned on the sending position, in the situation in which the upward sending path is removed, according to one or more embodiments of the present invention.

The movable containing unit 43 comprises a holding portion 43*a* which has a bottom portion and which is formed in the semi-cylindrical shape having the U-shaped cross section, extending in the up and down direction and having an open upper portion, and a support plate 43*b* having the horizontal cross section which is bent in a V-shape (See FIGS. 37 and 38). The support plate 43*b* is attached by joining the side wall of the holding portion 43*a* with the short side portion of the V-shape. On the base end portion of the support plate 43*b* (the end potion of the long side of the V-shape), the shaft projection 43*d* which projects upwardly and which is the center of the rotation of the movable containing unit 43, and the shaft arm portion 43*e* which is arranged in the same axis as the shaft projection 43*d* and which projects downwardly, are provided.

The shaft projection 43*d* is inserted into the shaft hole 47 provided in the upper sending path 41A. The shaft arm portion 43*e* is inserted into the hole provided in the bottom portion of the lower sending path 41B, and is connected with the second actuating unit 44 provided below the sending path 41. The second actuating unit 44 is a solenoid actuator. By extruding and retracting the actuator, the movable containing unit 43 is rotated around the shaft projection 43*d* and the shaft arm portion 43*e*. The movable containing unit 43 rotates between the standby position (the position shown in FIG. 36(*a*)) on which the holding portion 43*a* is contained in the standby unit 42 and the sending position (the position shown in FIG. 36(*b*)) on which the holding portion 43*a* faces to the conveyance duct connection port 45 by moving it into the sending path 41.

The arc portion of the U-shaped holding portion 43*a* is curved at a radius which is slightly larger than that of the large-diameter portion 16*c* of the conveyance subsidiary body 16. On the inner wall of the holding portion 43*a*, the guide portions 43*f* projecting toward the inside direction are provided in order to hold the conveyance subsidiary body 16 in a standing posture.

Further, near the middle of the curved part of the U-shaped holding portion 43*a*, an air blowing hole 43*g* for blowing the air is provided. Further, also in the long side portion of the V-shaped support plate 43*b*, an air blowing hole 43*h* for blowing the air is provided.

The lower end of the guide path 61 is connected with the ceiling surface of the standby unit 42. When the movable containing unit 43 is positioned on the standby position shown in FIG. 36(*a*), the movable containing unit 43 receives the conveyance subsidiary body 16 which is dropped from the dropping opening 74 of the separation/collection device 70 via the guide path 61, in the holding portion 43*a* to hold the conveyance subsidiary body 16.

In the standby unit 42, the conveyance subsidiary body sensor 48 for detecting the conveyance subsidiary body 16 which stands by on the standby position, is provided. In one or more embodiments, as the conveyance subsidiary body sensor 48, a transmission-type of optical sensor which is arranged so as to block the light by the conveyance subsidiary body 16 which stands by on the standby position and not to block the light in case that the conveyance subsidiary body 16 does not exist on the standby position, is used.

On the side wall of the standby unit 42, the opening for connecting with the duct 50 is provided. The duct 50 is connected with the standby unit 42 and the expanding chamber 73 of the separation/collection device 70. The airstream flows from the standby unit 42 to the expanding chamber 73 of the separation/collection device 70 via the duct 50.

Figure 36A:
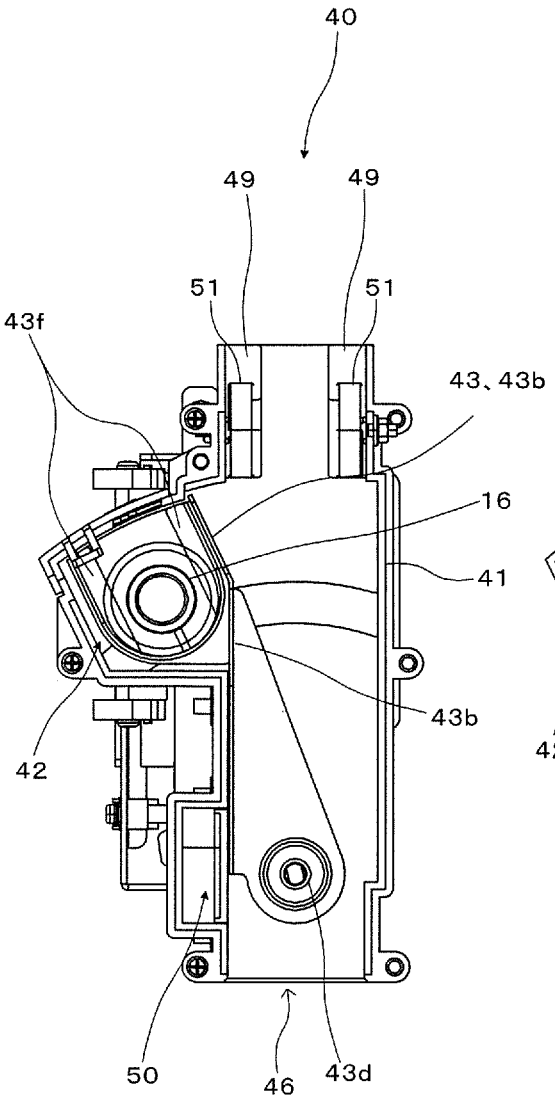
FIGS. 36(*a*) and (*b*) These are explanatory views showing the situation in which the holding unit of the movable containing unit is positioned on the standby position and the situation in which the holding unit is positioned on the sending position, as to compare each other, according to one or more embodiments of the present invention.
Figure 36B:
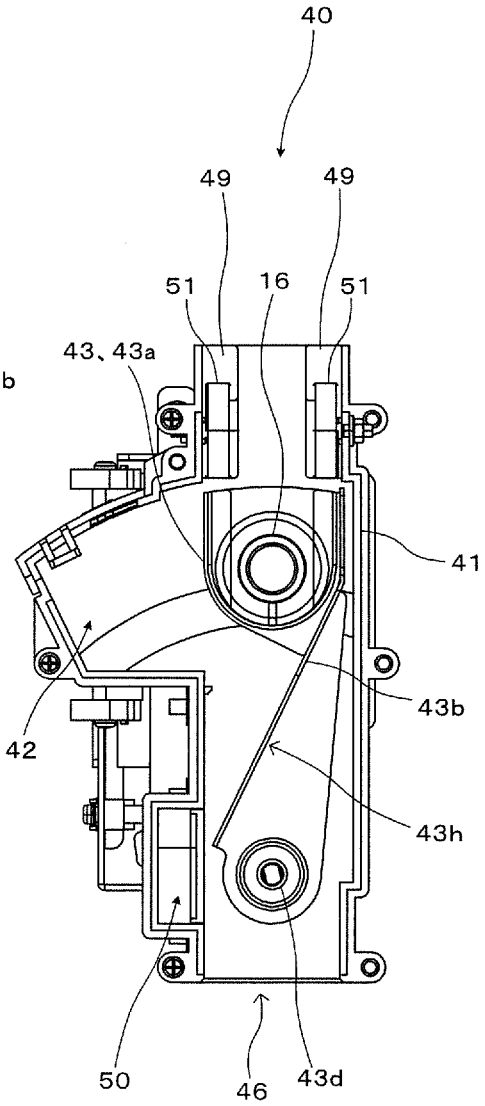

As shown in FIG. 36(*a*) and FIG. 37, in the situation in which the holding portion 43*a* of the movable containing unit 43 is positioned on the standby position, the long side portion of the support plate 43*b* which is bent in the V-shape (FIG. 37:43*b*(1)) contacts with the side wall of the sending path 41. Further, the short side portion thereof (FIG. 37:43*b* (2)) blocks the opening for connecting the sending path 41 with the standby unit 42. Thereby, the airstream which flows from the blowing path connection port 46 is not wastefully discharged from the standby unit 42 via the duct 50. As a result, the airstream can effectively flow to the conveyance duct 12. Further, in this situation, because the support plate 43*b* contacts along the side wall of the sending path 41, the airstream which flows from the blowing path connection port 46 sufficiently flows toward the conveyance duct connection port 45.

As shown in FIG. 36(*b*) and FIG. 38, when the holding portion 43*a* of the movable containing unit 43 is moved to the sending position, the conveyance subsidiary body 16 which is held by the holding portion 43*a* of the movable containing unit 43 is moved so as to be positioned in the sending path 41. At this time, the airstream which flows from the blowing path connection port 46 flows toward the conveyance duct connection port 45 (the downstream side) via the air blowing hole 43*h* provided in the support plate 43*b* and the air blowing hole 43*g* provided in the holding portion 43*a*. By this airstream, the conveyance subsidiary body 16 is released from the holding portion 43*a*, is moved in the sending path 41 and is sent to the conveyance duct 12 from the conveyance duct connection port 45.

As described above, in the conveyance subsidiary body insertion device 40, because the conveyance subsidiary body 16 is moved from the standby position to the sending position by rotating the movable containing unit 43 in the situation in which the conveyance subsidiary body 16 is held by the holding portion 43*a* of the movable containing unit 43, it is possible to send out the conveyance subsidiary body 16 into the sending path 41 in the situation in which the stable posture is maintained.

On the right and the left inner walls of the upstream part of the sending path 41 from the holding portion 43*a* which is positioned on the sending position, the guide rails 49 projecting toward the inside direction are provided on the extended lines of the ribs 35 which are provided on the edge parts and the like of the expanding portion 33 of the conveyance duct 12 connected with the conveyance duct connection port 45. In the guide rails 49, the upper guide rails 49A, the middle guide rails 49B and the lower guide rails 49C are provided on the positions corresponding to the neck portions 16*b* and the narrow portion 16*d* so as to sandwich each large-diameter portion 16*c* of the conveyance subsidiary body 16 vertically (See FIG. 35 and FIG. 37).

The middle guide rails 49B and the lower guide rails 49C extend from the downstream end of the sending path 41 to the position just before the movable containing unit 43 (the holding portion 43*a*) which is positioned on the sending position. The upper guide rails 49A are shortened on the upstream side as compared with the middle guide rails 49B and the lower guide rails 49C (See FIG. 35 and FIG. 37). On the upstream side of each short upper guide rail 49A, the posture correction mechanism 51 is provided so as to face to each middle guide rail 49B. In one or more embodiments, the posture correction mechanism 51 is circular rotation members which rotate along the sending direction of the conveyance subsidiary body 16, and is supported so as to be rotatable by inserting the rotation shaft into the bearing hole 52 (See FIG. 35) provided in the side wall of the sending path 41. The posture correction mechanism 51 is provided so as to arrange the lowest point thereof under the lower surface of the upper guide rail 49A.

Figure 39A:
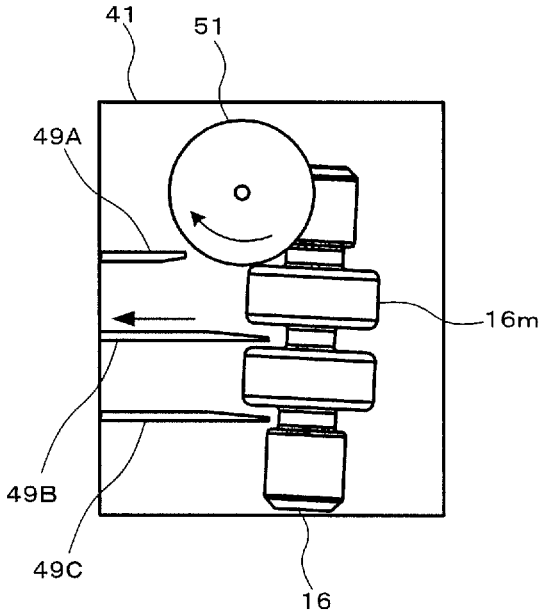
FIGS. 39(*a*) and (*b*) These are explanatory views showing the situation in which the posture correction mechanism corrects the posture of the conveyance subsidiary body, according to one or more embodiments of the present invention.
Figure 39B:
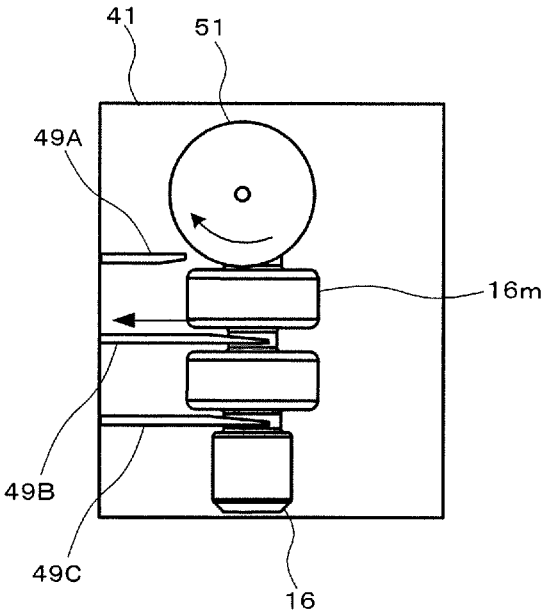

As shown in FIG. 39(*a*), there is some possibility that the conveyance subsidiary body 16 sent out from the holding portion 43*a* of the movable containing unit 43 which is moved to the sending position, is sent out in the situation in which the posture thereof is slightly changed (in one or more embodiments, the posture is inclined backwardly). The middle guide rails 49B and the lower guide rails 49C regulate the lower limit position of the conveyance subsidiary body 16 by contacting with the lower surface of each large-diameter portion 16*c* of the conveyance subsidiary body 16. The upper surface of the upper large-diameter portion 16*c* of the conveyance subsidiary body 16 contacts with the posture correction mechanisms 51 which can freely rotate, and the conveyance subsidiary body 16 moves so as to be guided by the above rotation. Thereby, as shown in FIG. 39(*b*), the posture of the conveyance subsidiary body 16 is gradually corrected to a straightly erected posture. The conveyance subsidiary body 16 of which the posture is corrected is sent out toward the starting portion of the conveyance duct 12 so as to maintain the posture thereof while the positions of the large-diameter portions 16*c* are regulated between the upper guide rails 49A and the middle guide rails 49B and between the middle guide rails 49B and the lower guide rails 49C, respectively.

Because the posture correction mechanism 51 is the circular rotation members which can freely rotate, even though the posture correction mechanism 51 contacts with the conveyance subsidiary body 16 in a changed posture, the posture of the conveyance subsidiary body 16 can be smoothly corrected without sticking the conveyance subsidiary body 16. Further, because the lowest point of the posture correction mechanism 51 is arranged under the lower surface of each upper guide rail 49A, after the conveyance subsidiary body 16 passes through the posture correction mechanism 51, the conveyance subsidiary body 16 can be moved without being stuck in the upstream end of one upper guide rail 49A while the position of the conveyance subsidiary body 16 is regulated by being smoothly inserted between the guide rails 49A to 49C.

Next, the operation of the bill separation/conveyance subsidiary body circulation device 11 will be explained.

The bill separation/conveyance subsidiary body circulation device 11 is controlled and operated by the control unit 23 which comprises the CPU, the ROM, the RAM and the like, as the main unit. When the control unit 23 recognizes that the bill 6 is captured in the conveyance duct 12 by any one of the bill capturing devices 140 provided so as to correspond to the game ball lending devices 3, in accordance with the detection signal of the sensor provided in each bill capturing device 140, the control unit 23 confirms whether the conveyance subsidiary body 16 stands by in the standby unit 42 of the conveyance subsidiary body insertion device 40 by using the detection signal of the conveyance subsidiary body sensor 48. Further, the conveyance belts 98 of the separation/collection device 70 are actuated by actuating the separation conveyance actuating unit 64.

When it is confirmed that the conveyance subsidiary body 16 stands by, the holding portion 43*a* of the movable containing unit 43 is moved to the sending position by actuating the second actuating unit 44. Then, the conveyance subsidiary body 16 held by the holding portion 43*a* of the movable containing unit 43 is sent out into the conveyance duct 12 through the sending path 41 by riding on the airstream flowing from the airstream generation device 14.

After the predetermined time elapses, the control unit 23 moves the holding portion 43*a* of the movable containing unit 43 to the standby position in the standby unit 42 by controlling the second actuating unit 44. The conveyance subsidiary body 16 sent from the conveyance subsidiary body insertion device 40 moves in the conveyance duct 12 by the airstream. Then, the conveyance subsidiary body 16 contacts with the rear edge of the bill 6 captured in the conveyance duct 12 by the bill capturing device 140, and conveys the bill 6 by being pushed from behind.

The control unit 23 monitors whether the conveyance subsidiary body 16 arrives at the holding unit 81 of the separation unit 80 of the separation/collection device 70 and is stopped, in accordance with the detection signal of the conveyance subsidiary body detection sensor 63. When the above arrival and the above stop are confirmed, the control unit 23 activates the first activating unit 62 to move the holding unit 81 of the separation unit 80 to the discharge position.

The conveyance subsidiary body 16 is dropped downwardly from the discharging opening 86 of the holding unit 81 moved to the discharge position, via the dropping opening 74 of the outer frame unit 71 and the guide path 61, and is moved into the standby unit 42. Then, the conveyance subsidiary body 16 is received and held by the holding portion 43*a* of the movable containing unit 43. When the control unit 23 confirms that the conveyance subsidiary body 16 stands by on the standby position of the standby unit 42 in accordance with the output signal of the conveyance subsidiary body sensor 48, the control unit 23 moves the holding unit 81 of the separation unit 80 to the collection position by actuating the first actuating unit 62. By carrying out the above operation, one operation sequence for circulatedly using the conveyance subsidiary body 16 in the bill separation/conveyance subsidiary body circulation device 11 is finished.

The bill 6 separated by the separation/collection device 70 is contained in the bill containing unit 21 of the bill housing stacker 5 as described above.

As described above, according to the bill separation/conveyance subsidiary body circulation device 11, one conveyance subsidiary body 16 can be circulatedly used in the paper sheet conveyance device 10. Further, because the operation for circulatedly using the conveyance subsidiary body 16 and separating and collecting the bill 6 is automatically controlled as described above, the work burden is suppressed.

Next, the bill capturing device 140 will be explained.

Figure 40:
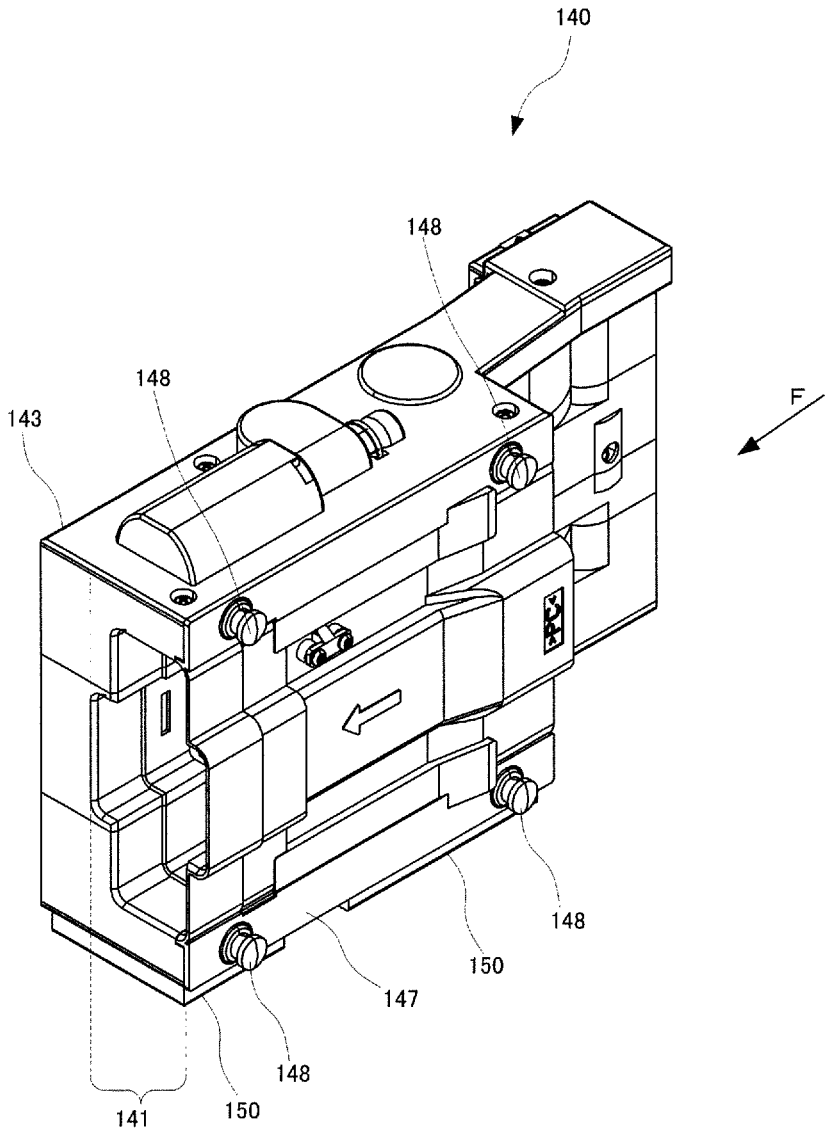
FIG. 40 This is a perspective view showing the bill capturing device, according to one or more embodiments of the present invention.
Figure 41:
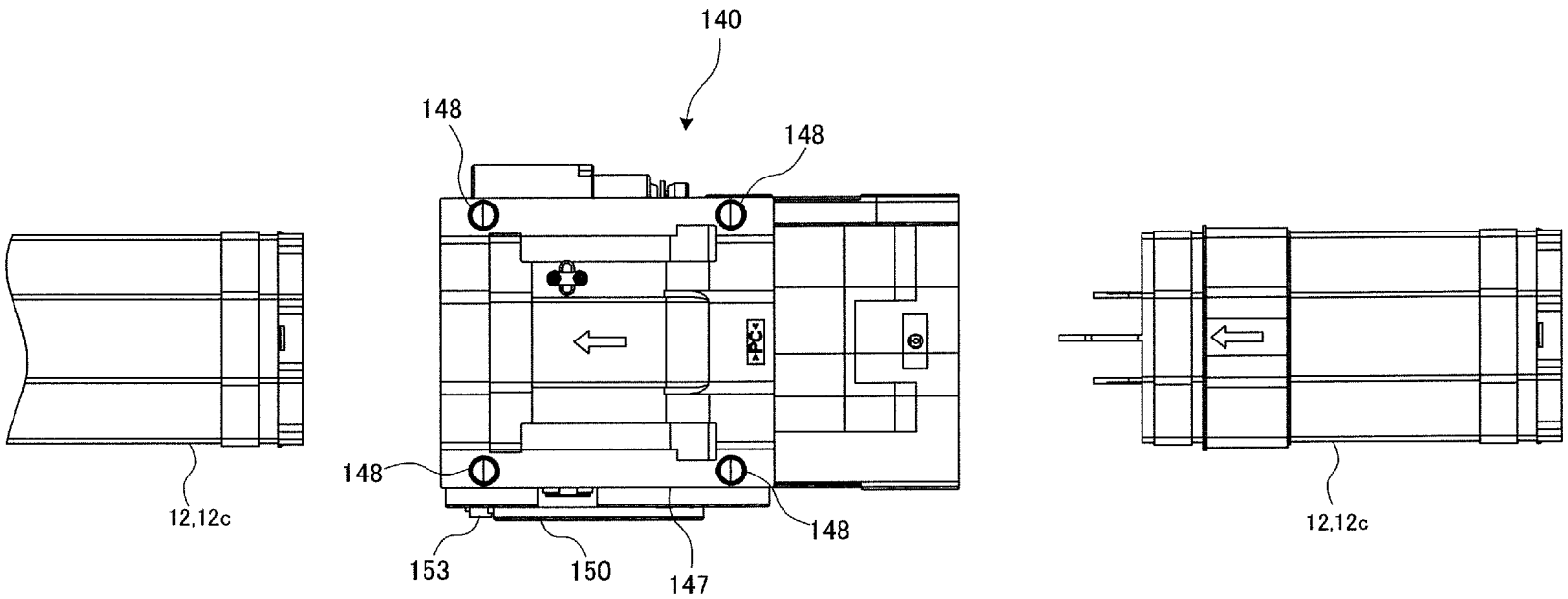
FIG. 41 This is a front view showing the bill capturing device and the conveyance ducts which are connected therewith, according to one or more embodiments of the present invention.
Figure 42:
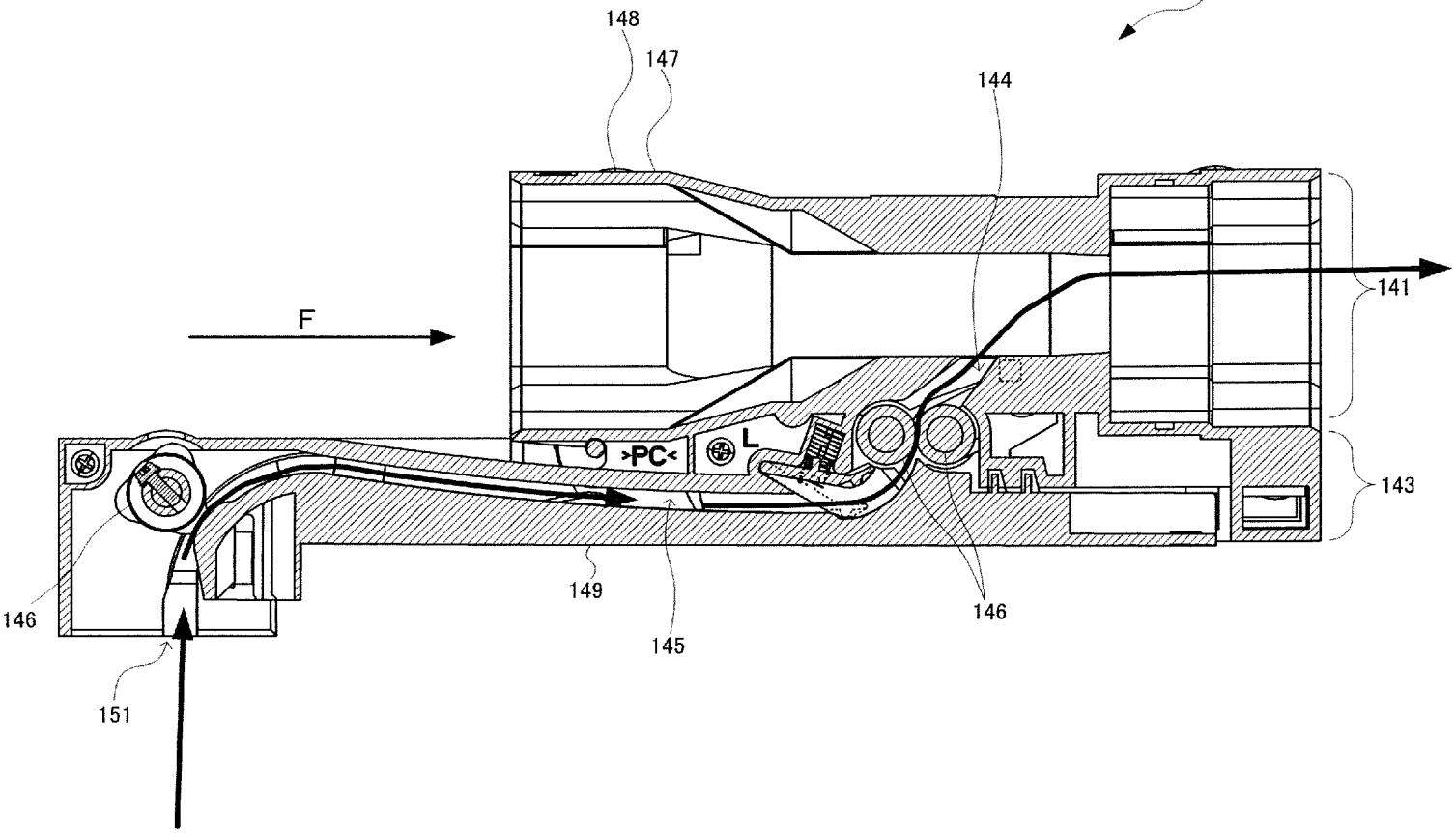
FIG. 42 This is a sectional view showing the inner structure of the bill capturing device, according to one or more embodiments of the present invention.

FIG. 40 is a perspective view of the bill capturing device 140. FIG. 41 is a front view showing the bill capturing device 140 and the conveyance duct 12 which is connected therewith. FIG. 42 is a sectional view showing the inner structure of the bill capturing device 140. The bill capturing device 140 comprises a tubular path part 141 which forms a part of the conveyance path (the second half path 12*c*) by connecting the conveyance ducts 12 at the both ends, and a main body part 143 having a mechanism for sending the bill 6 into the path part 141. The arrow F shown in the drawings indicates the conveyance direction of the bill 6 in the conveyance duct 12 and the path part 141 (the direction of the airstream).

Figure 44:
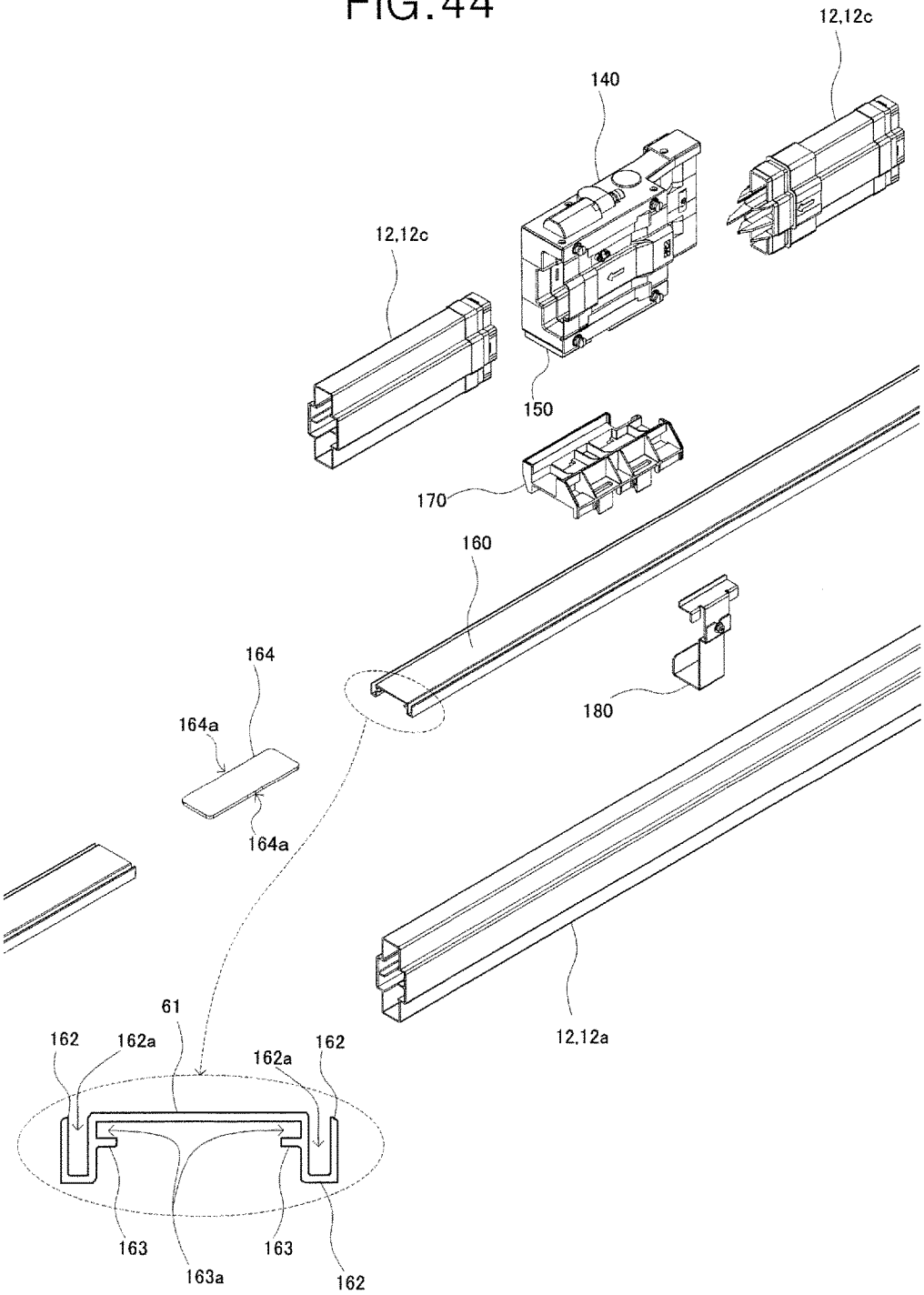
FIG. 44 This is an exploded view of the conveyance path supported by the auxiliary frame, according to one or more embodiments of the present invention.
Figure 45:
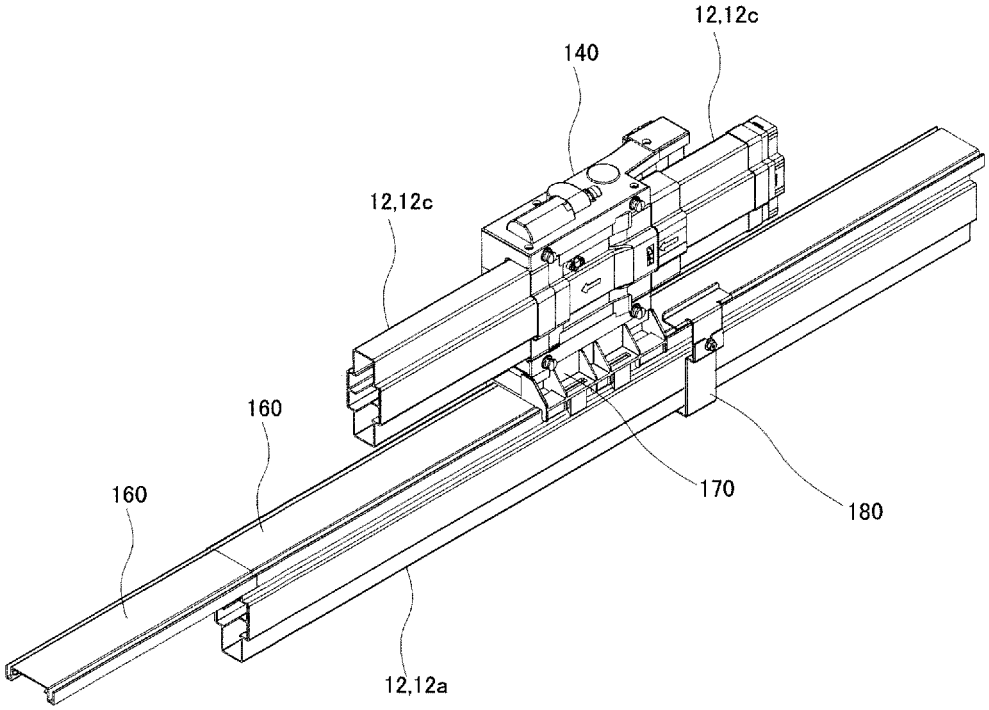
FIG. 45 This is a perspective view showing the conveyance path which is formed by assembling parts of FIG. 44, according to one or more embodiments of the present invention.

As shown in FIG. 41, FIG. 44 and FIG. 45, the conveyance ducts 12 (12*c*) are connected at the both ends of the path part 141 of the bill capturing device 140. The path part 141 forms a part of the conveyance path (the second half path 12*c*). The path part 141 has an inside shape corresponding to the inside shape of the conveyance duct 12.

As shown in FIG. 42, the main body part 143 of the bill capturing device 140 comprises a standby path 145 for keeping the bill 6 received from the game ball lending device 3 on standby, conveyance rollers 146 for sending the bill 6 received from the game ball lending device 3 into the path part 141 via the standby path 145, and the like. The bill capturing device 140 has a bill receiving port 151 for receiving the bill 6 discharged from the rear surface of the game ball lending device 3. The bill receiving port 151 is an inlet port of the standby path 145. The bill capturing device 140 can keep one bill 6 on standby in the standby path 145. The conveyance rollers 146 are actuated by motors which are not shown in the drawings.

In the side wall of the path part 141, the insertion port 144 for capturing the bill 6 in the path part 141 is provided as the outlet port of the standby path 145. In the path part 141, the path frame 147 for forming the wall surface on the side opposite to the wall surface on which the insertion port 144 is provided, is detachably attached by the nighlatches 148, and the like. The path frame 147 can be detached in order to deal with the jamming of the bill 6 in the path part 141 of the bill capturing device 140, and the like.

Figure 43:
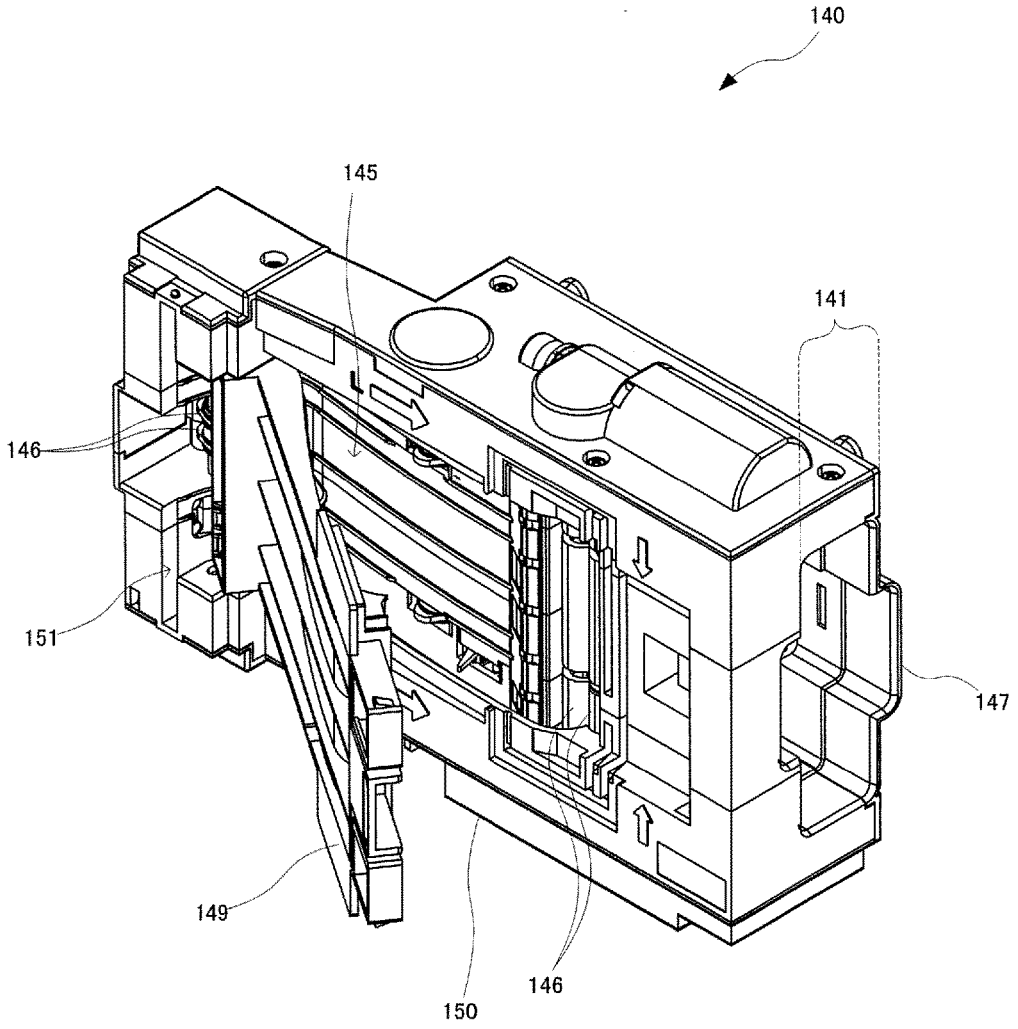
FIG. 43 This is a perspective view showing the bill capturing device in the situation in which the door is open, according to one or more embodiments of the present invention.

Further, in order to deal with the case in which the bill 6 is jammed in the standby path 145 of the bill capturing device 140, as shown in FIG. 43, on the side wall of the main body part 143, a door 149 for opening and closing the side wall of the main body part 143 is provided. The door 149 forms one path wall of the standby path 145.

A part of the lower portion of the bill capturing device 140 projects downwardly. The part is a bottom part 150 to be fit into the concave part 174 of the pedestal unit 170 which will be explained.

Next, the support of the conveyance duct 12 using the auxiliary frame 160 will be explained.

FIG. 44 is an exploded view of the conveyance path supported by the auxiliary frame 160. FIG. 45 shows the situation in which the parts shown in FIG. 44 are assembled. The auxiliary frame 160 extends in the longitudinal direction of the flat portion 161 having an elongated plate shape, and has a cross section perpendicular to the longitudinal direction, in which upward U-shaped groove portions 162 are formed at both ends of the flat portion 161 in the width direction. The auxiliary frame 160 is formed at a high rigidity.

One auxiliary frame 160 is formed so as to have the desired length by joining a plurality of the auxiliary frames 160 each of which has a suitable length, with one or more connection members 164. The connection member 164 is a high rigid plate having the width which is slightly narrower than the width of the flat portion 161 of the auxiliary frame 160. On the middle portion of the connection member 164 in the longitudinal direction, the stop portion 164*a* is provided so as to be slightly widened. In the auxiliary frame 160, the project portions 163 which project toward the middle of the auxiliary frame 160 in the width direction from the groove portions 162 which are provided on the both ends of the auxiliary frame 160 in the width direction, are provided so as to form the space 163*a* for inserting the connection member 164 along the back surface of the flat portion 161.

One end of the connection member 164 is pressed into the space 163*a* of the end portion of one auxiliary frame 160 to be joined, until the approximate half of the stop portion 164*a* enters the space 163*a*. Next, the other end of the connection member 164 is pressed into the space 163*a* of the end portion of the other auxiliary frame 160 to be joined, until the other half of the stop portion 164*a* enters the space 163*a*.

Then, by pressing the connection member 164 into the space 163*a* until two auxiliary frames 160 are tightly joined, two auxiliary frames 160 are connected. By pressing the stop portion 164*a* which is slightly widened into the space 163*a*, the connection member 164 cannot be easily extracted from the space 163*a* of the auxiliary frame 160. As a result, the auxiliary frames 160 are tightly connected.

Figures 50, 50A, 50B:
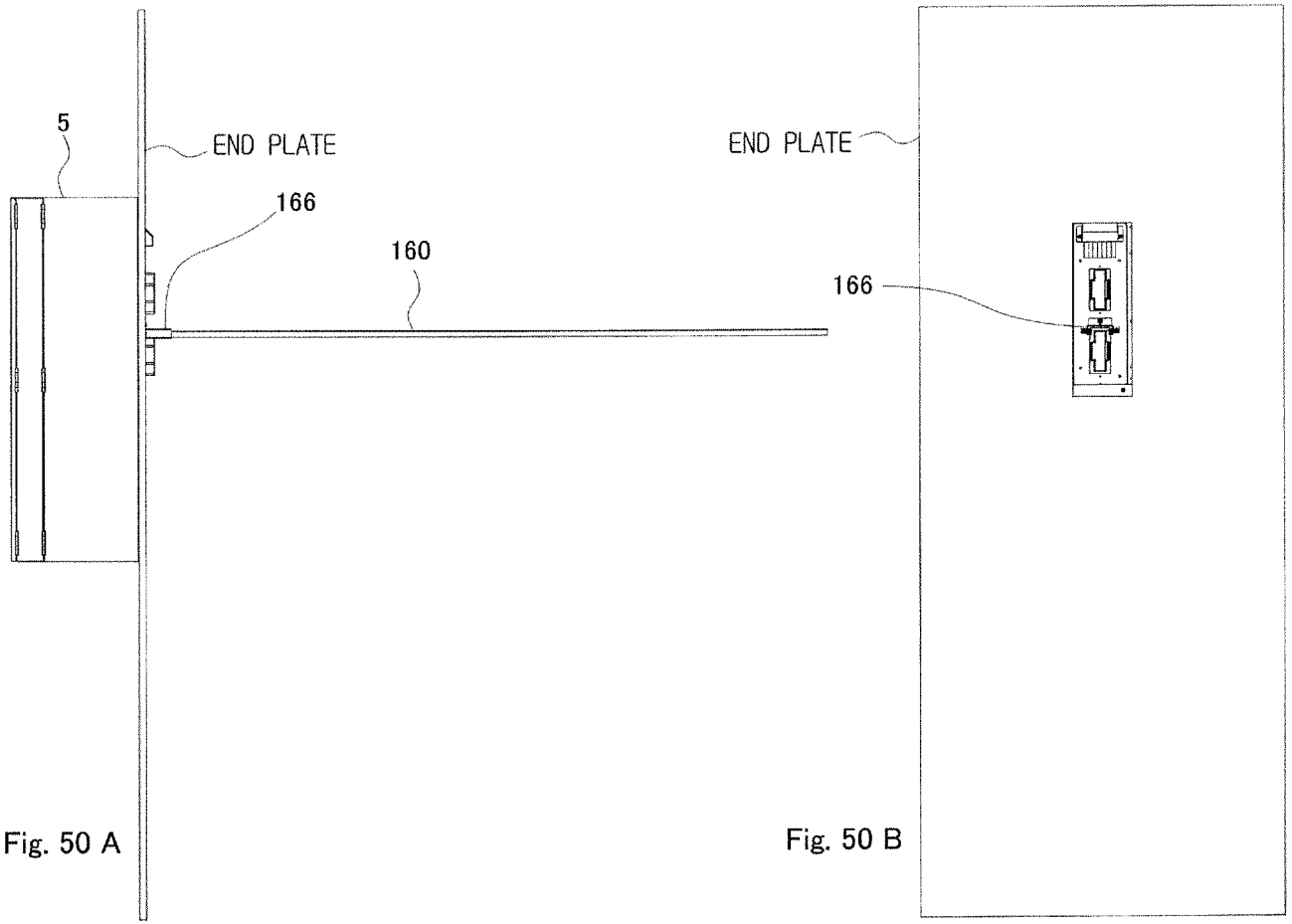
FIGS. 50(*a*) and (*b*) These are views showing the frame member of which the edge portion is fixed to the end plate by the attachment clasp, according to one or more embodiments of the present invention.

In the gaming machine unit facility 2, the auxiliary frame 160 joined as described above, is bridged along the longitudinal direction of the gaming machine unit facility 2. Then, as shown in FIG. 50, the edge portion of the auxiliary frame 160 is fixed to the inner side of the end plate of the gaming machine unit facility 2 by the attachment clasp 166.

On the upper surface side of the auxiliary frame 160, the pedestal unit 170 which is movable so as to freely slide along the longitudinal direction of the auxiliary frame 160 is attached. The pedestal unit 170 supports the bill capturing device 140 from the lower side by mounting the lower portion of the bill capturing device 140.

Figure 46:
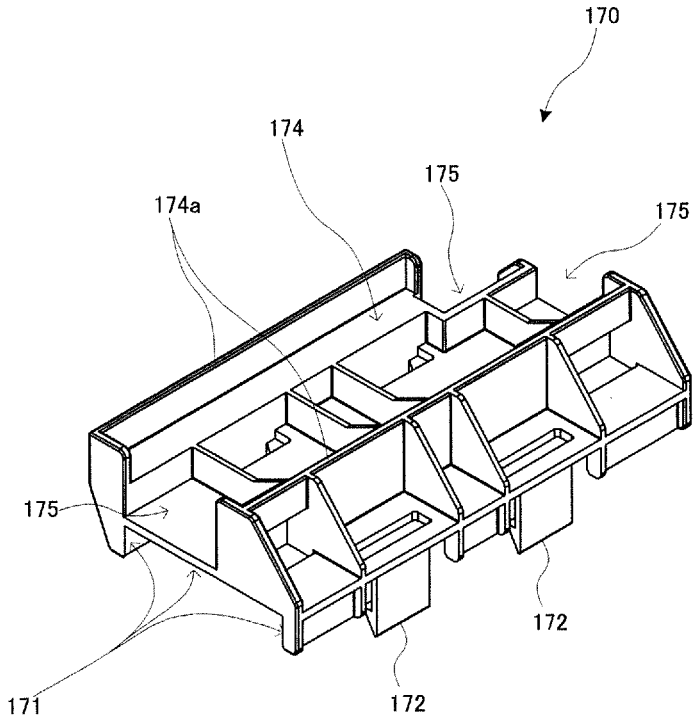
FIG. 46 This is a perspective view of the pedestal unit, according to one or more embodiments of the present invention.
Figure 47:
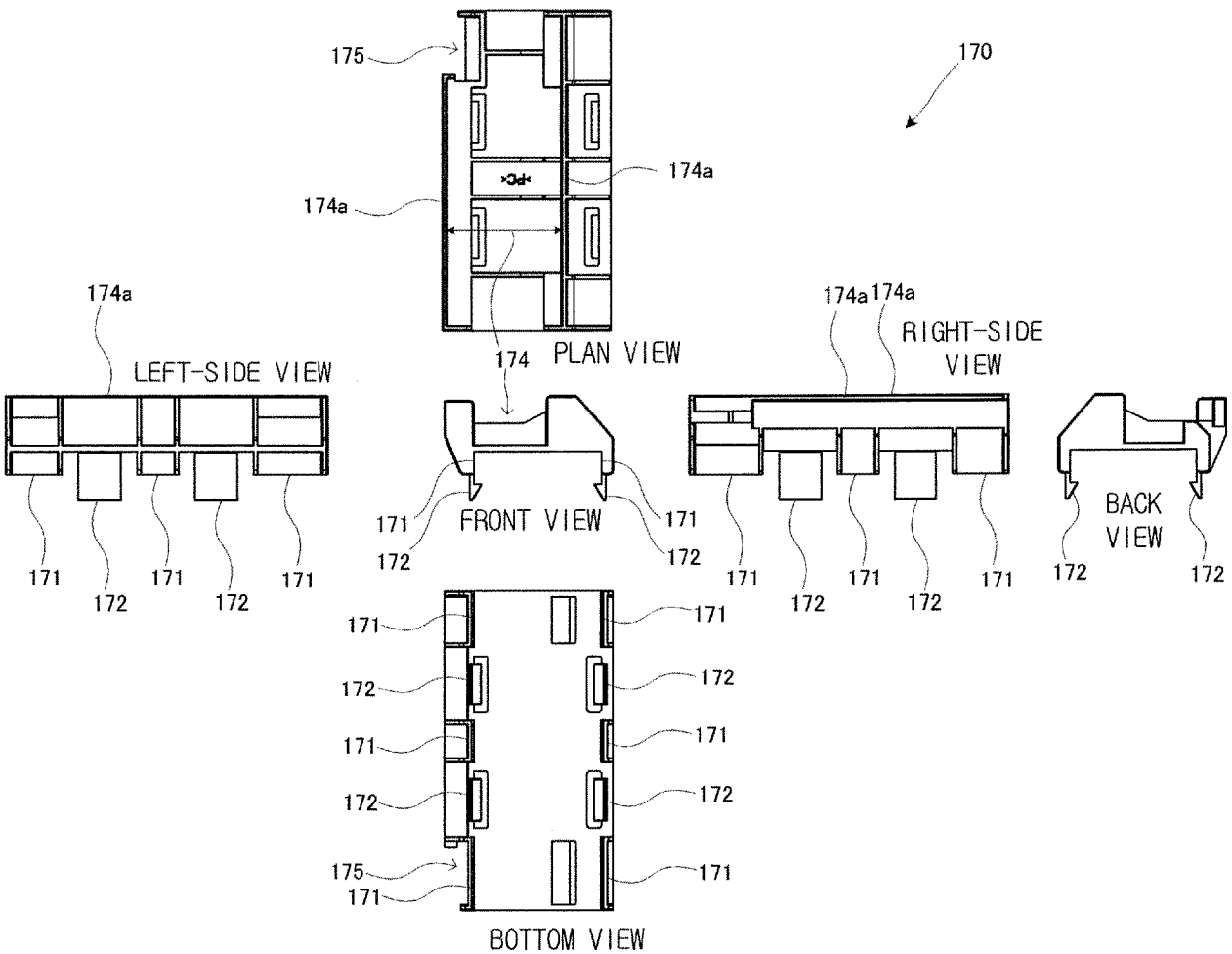
FIG. 47 This is a six-view orthographic projection of the pedestal unit, according to one or more embodiments of the present invention.

FIG. 46 is a perspective view of the pedestal unit 170. FIG. 47 is a six-view orthographic projection of the pedestal unit 170. On the lower portion of the pedestal unit 170, the outer engaging portion 171 is formed in the downward U-shape so as to stride across the auxiliary frame 160 from the upper surface side of the auxiliary frame 160. Further, on the lower portion of the pedestal unit 170, the pawl portions 172 for engaging with the lower ends of the groove portions 162 on the both ends of the auxiliary frame 160 in the width direction by extending downwardly along the outer sides of the groove portions 162, are provided.

On the upper surface side of the pedestal unit 170, the concave part 174 into which the lower portion of the bill capturing device 140 (the bottom part 150) is fit to support the bill capturing device 140 from the lower side, is provided. The concave part 174 has walls 174*a* which stands from the upper surface of the pedestal unit 170 so as to surround the bottom part 150 of the bill capturing device 140. On the lower surface of the bill capturing device 140, the connector 153 (See FIG. 41) for connecting the cables of the motor and the sensor of the bill capturing device 140 is provided. On the upper surface of the pedestal unit 170, the notch 175 for passing the connector 153 and the cables which are connected with the connector 153 is provided.

The pedestal unit 170 strides across the upper surface of the auxiliary frame 160 and is attached by engaging the pawl portions 172 with the lower ends of the groove portions 162 of the auxiliary frame 160. Therefore, while the pedestal unit 170 is movable so as to freely slide along the longitudinal direction of the auxiliary frame 160, the pedestal unit 170 cannot be easily extracted from the auxiliary frame 160.

Figure 48A:
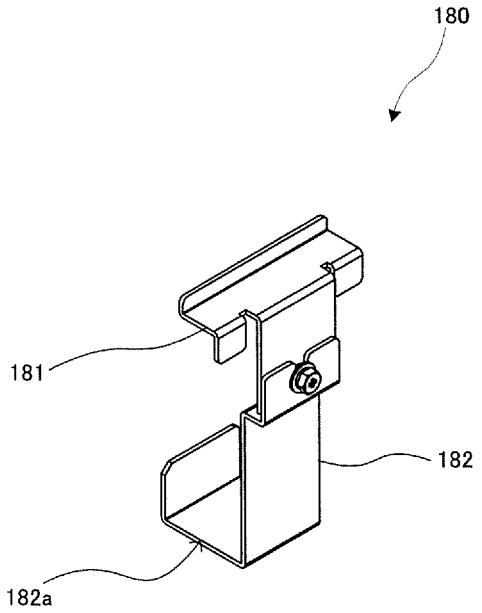
FIGS. 48(*a*) and (*b*) These are views showing the hook member, according to one or more embodiments of the present invention.
Figure 48B:
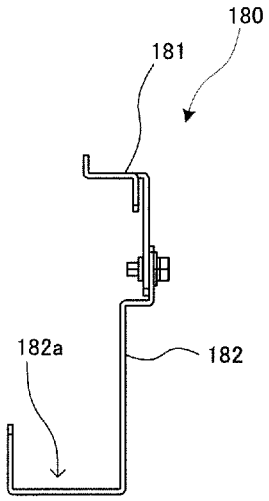
Figure 49:
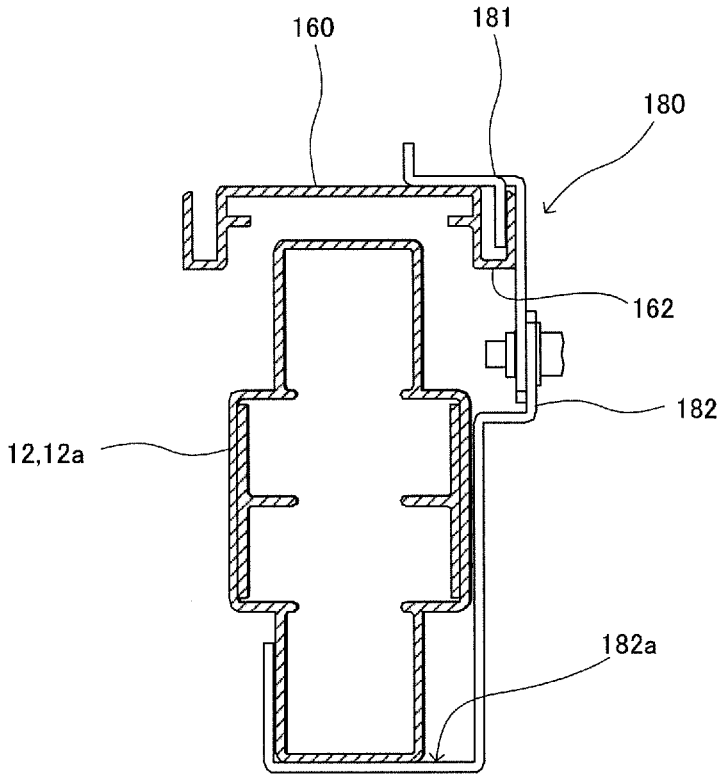
FIG. 49 This is a view showing the situation in which the hook member is attached on the auxiliary frame and the conveyance duct is held by the hook member, according to one or more embodiments of the present invention.

FIG. 48 shows the hook member 180. FIG. 48(*a*) is a perspective view of the hook member 180. FIG. 48(*b*) shows the side surface thereof. Further, FIG. 49 shows the situation in which the hook member 180 is attached on the auxiliary frame 160 and the conveyance duct 12 is held by the hook member 180.

The hook member 180 comprises a hung part 181 for being hung in the groove portion 162 of the auxiliary frame 160 and an arm part 182 extending downwardly from the hung part 181. The lower portion of the arm part 182 is bent and forms a holding portion 182*a* in the upward U-shape. As shown in FIG. 49, the hook member 180 is hung from the auxiliary frame 160 by attaching the hung portion 181 to the groove portion 162 of the auxiliary frame 160. Then, the conveyance duct 12 is held by the arm part 182 of the hung hook member 180 under the auxiliary frame 160 so as to clasp the conveyance duct 12.

Figure 51A:
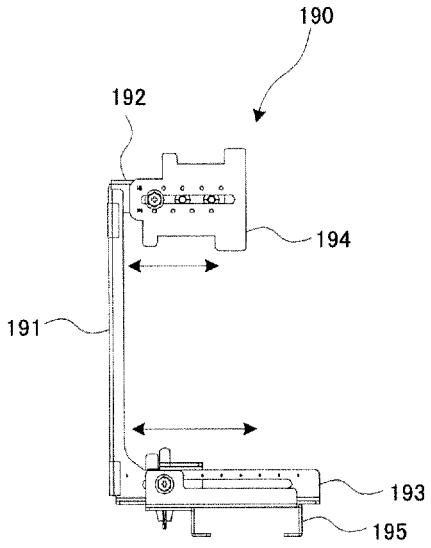
FIGS. 51(*a*) and (*b*) These are views showing the attachment clasp which is attached to the upper portion of the rear surface of the game ball lending device and which holds the bill capturing device and the auxiliary frame, according to one or more embodiments of the present invention.
Figure 51B:
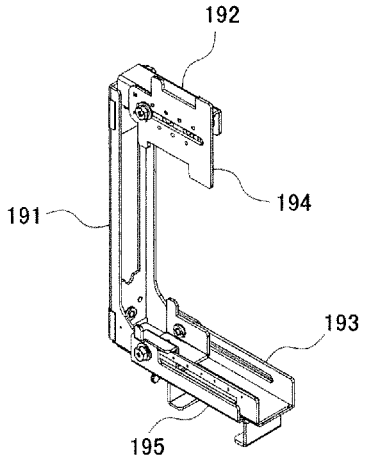

FIG. 51 shows the attachment clasp 190 which is attached to the upper portion of the rear surface of the game ball lending device 3 and which holds the bill capturing device 140 and the auxiliary frame 160 as the holding member. FIG. 51(*a*) shows the side surface of the attachment clasp 190. Further, FIG. 51(*b*) is a perspective view of the attachment clasp 190. The attachment clasp 190 comprises a base part 191 having a vertically elongated channel structure attached to the rear surface of the game ball lending device 3, an upper arm part 192 extending horizontally from the upper end portion of the base part 191, and a lower arm part 193 extending horizontally in the same direction as the upper arm part 192 from the lower end portion of the base part 191 and extending longer than the upper arm part 192.

On the upper arm part 192, the bill capturing device holding clasp 194 for holding the upper portion of the bill capturing device 140 is attached so as to slide in the horizontal direction along the upper arm part 192, and the position of the bill capturing device holding clasp 194 can be adjusted. Further, on the lower arm part 193, the auxiliary frame holding clasp 195 for holding the auxiliary frame 160 is attached so as to slide in the horizontal direction along the lower arm part 193, and the position of the auxiliary frame holding clasp 195 can be adjusted.

Figure 52A:
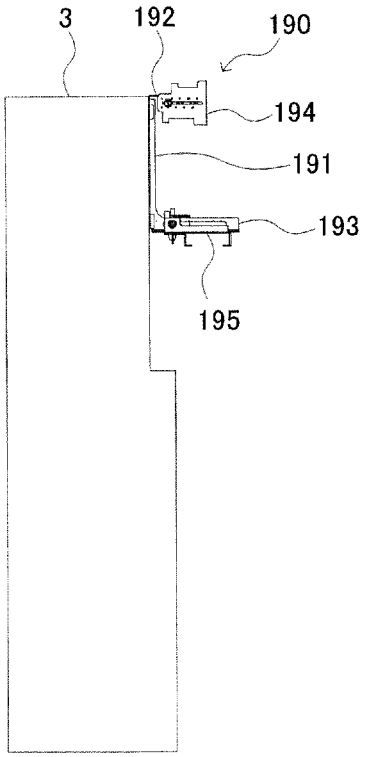
FIGS. 52(*a*) and (*b*) These are views showing the situation in which the attachment clasp is fixed to the rear surface of the game ball lending device, according to one or more embodiments of the present invention.
Figure 52B:
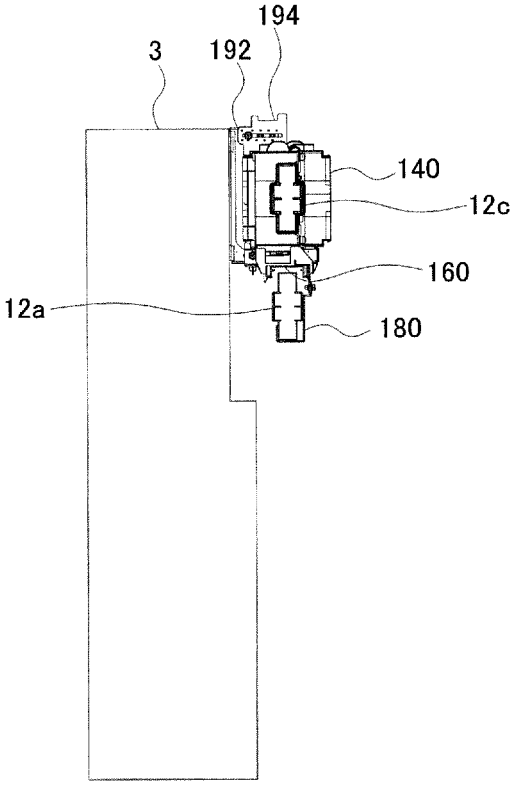
Figure 53:
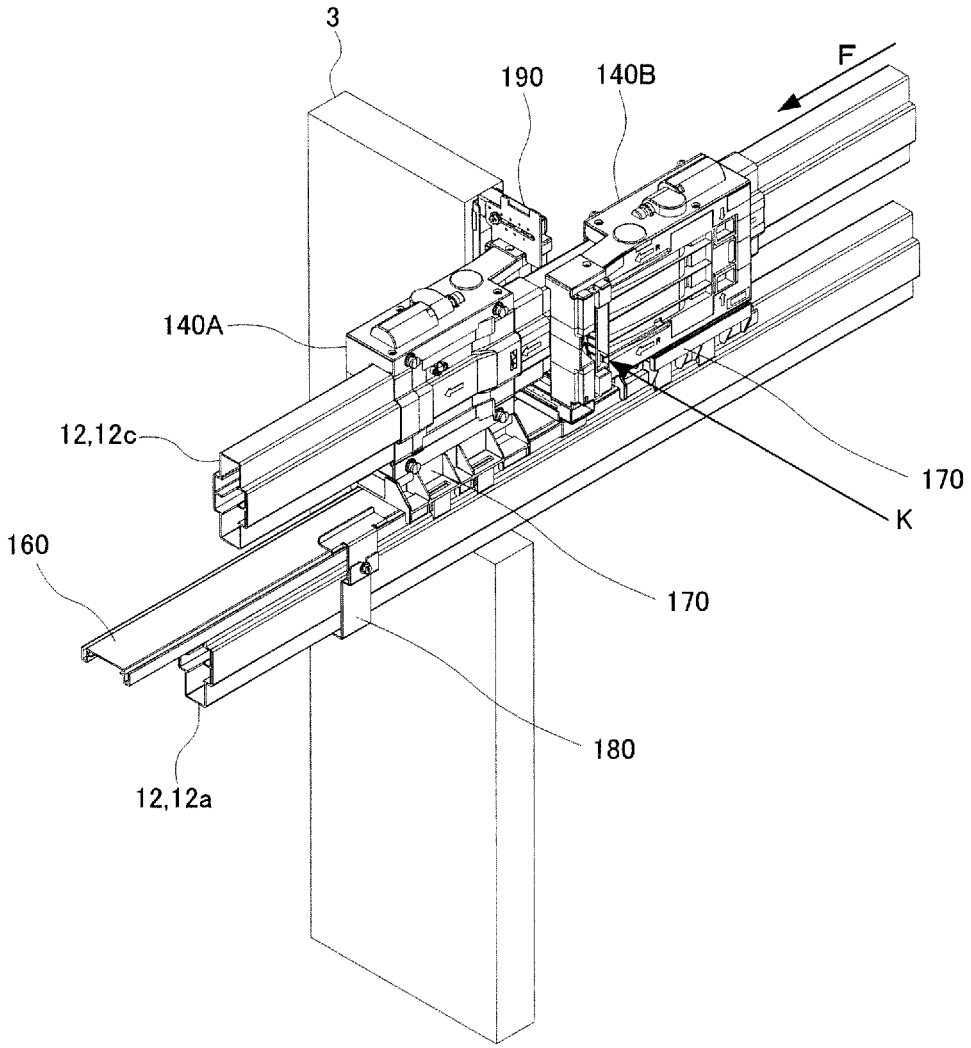
FIG. 53 This is a perspective view showing the situation in which the bill capturing device, the auxiliary frame and the like are attached to the attachment clasp fixed to the rear surface of the game ball lending device, according to one or more embodiments of the present invention.

FIG. 52(*a*) shows the situation in which the attachment clasp 190 is fixed to the rear surface of the game ball lending device 3. FIG. 52(*b*) shows the situation in which the bill capturing device 140, the auxiliary frame 160 and the like are attached to the attachment clasp 190 from FIG. 52(*a*). Further, FIG. 53 is a perspective view showing the situation in which the bill capturing device 140, the auxiliary frame 160 and the like are attached to the attachment clasp 190 fixed to the rear surface of the game ball lending device 3.

The attachment clasp 190 is attached to the upper portion of the rear surface of the game ball lending device 3 so as to arrange the base part 191 vertically along the rear surface of the game ball lending device 3 and to project the upper arm part 192 and the lower arm part 193 from the rear surface of the game ball lending device 3 toward the direction in which the rear surface of the game ball lending device 3 faces (which is the width direction of the gaming machine unit facility 2 and the width direction of the auxiliary frame 160). The auxiliary frame 160 is held by the auxiliary frame holding clasp 195 provided on the lower portion of the attachment clasp 190. Even though the installation positions of the game ball lending devices 3 in the width direction of the gaming machine unit facility 2 are irregular, the auxiliary frame 160 can be straightly provided in the longitudinal direction of the gaming machine unit facility 2 by adjusting the attachment position of the auxiliary frame holding clasp 195 with respect to the lower arm part 193.

As described above, the pedestal unit 170 is attached to the upper surface side of the auxiliary frame 160 which is straightly provided in the longitudinal direction of the gaming machine unit facility 2, and the bill capturing device 140 is mounted on the pedestal unit 170. In detail, the bill capturing device 140 is mounted on the pedestal unit 170 so as to fit the bottom part 150 of the bill capturing device 140 into the concave part 174 of the pedestal unit 170. Next, by sliding and moving the bill capturing device 140 with the pedestal unit 170, the position of the bill capturing device 140 is adjusted so as to connect the bill insertion port of the bill capturing device 140 with the bill discharging port of the rear surface of the game ball lending device 3. Then, in the situation in which the position of the bill capturing device 140 is adjusted, the bill capturing device 140 is fixed by the bill capturing device holding clasp 194 of the upper arm part 192 of the attachment clasp 190. At this time, by sliding and moving the bill capturing device holding clasp 194 with respect to the upper arm part 192, the position of the bill capturing device holding clasp 194 is adjusted with respect to the bill capturing device 140, and the bill capturing device 140 is fixed.

Because the pedestal unit 170 is slid and moved along the auxiliary frame 160 as described above, it is possible to easily adjust the position of the bill capturing device 140 so as to connect the bill insertion port of the bill capturing device 140 with the bill discharging port of the rear surface of the game ball lending device 3. Further, because the bill capturing device 140 is attached to the bill capturing device holding clasp 194 of the upper arm part 192 of the attachment clasp 190 in the situation in which the bill capturing device 140 is mounted on the pedestal unit 170, it is possible to easily attach the bill capturing device 140 which is comparatively heavy.

Further, the upper portion of the bill capturing device 140 is held by the bill capturing device holding clasp 194 of the upper arm part 192 of the attachment clasp 190, and the lower portion thereof is held by the pedestal unit 170. Thereby, the bill capturing device 140 is firmly fixed. In particular, because the lower portion of the bill capturing device 140 is held by the pedestal unit 170 attached to the high rigid auxiliary frame 160 which is straightly provided in the gaming machine unit facility 2, the attachment position of the bill capturing device 140 is prevented from being shifted in the width direction of the auxiliary frame 60. As a result, it is possible to set and maintain the second half path 12*c* of the conveyance duct 12 straightly in the longitudinal direction of the gaming machine unit facility 2.

More specifically, in case of the gaming machine unit facility in which the game machines are attached on both sides, the bill capturing devices 140 are provided so as to correspond to the game ball lending devices 3 attached to one side of the gaming machine unit facility 2 and the game ball lending devices 3 attached to the other side thereof, respectively. For the convenience of the construction, as shown in FIG. 53, only the bill capturing device 140A corresponding to one side is fixed to the rear surface of the game ball lending device 3 by the attachment clasp 190. The bill capturing device 140B corresponding to the other side is not held by the attachment clasp 190. The bill capturing device 140B is supported by the adjacent conveyance ducts 12 and the pedestal unit 170 so as to hold the bottom part 150 provided on the lower portion of the bill capturing device 140 by the pedestal unit 170.

In this case, when the bill capturing device 140 is not held by the pedestal unit 170 from the lower side, the bill capturing device 140B is pushed in the direction of the arrow K shown in the drawing (the width direction of the gaming machine unit facility 2) from the rear surface of the game ball lending device 3. Therefore, it is difficult to hold the conveyance path straightly in the conveyance direction F. However, in one or more embodiments, because the lower portion of the bill capturing device 140B is held by the pedestal unit 170 supported on the high rigid auxiliary frame 160, the bill capturing device 140B is prevented from being shifted in the direction of the arrow K. It is possible to hold the conveyance path so as to straightly extend along the auxiliary frame 160.

On the auxiliary frame 160 attached to the auxiliary frame holding clasp 195 of the lower arm part 193 of the attachment clasp 190, the above-described hook member 180 is attached. By the hook member 180, the first half path 12*a* of the conveyance duct 12 is held under the auxiliary frame 160. As described above, because the auxiliary frame 160 has the function for holding the bill capturing device 140 on the upper surface side thereof and the function for holding the first half path 12*a* of the conveyance duct 12 under the lower side thereof, it is possible to effectively support the conveyance path. Further, because the hook member 180 can slide and move along the auxiliary frame 160, the attachment position of the hook member 180 can be freely selected. Thereby, the hook member 180 can be provided at the position on which the hook member 180 is easily attached.

Figure 54:
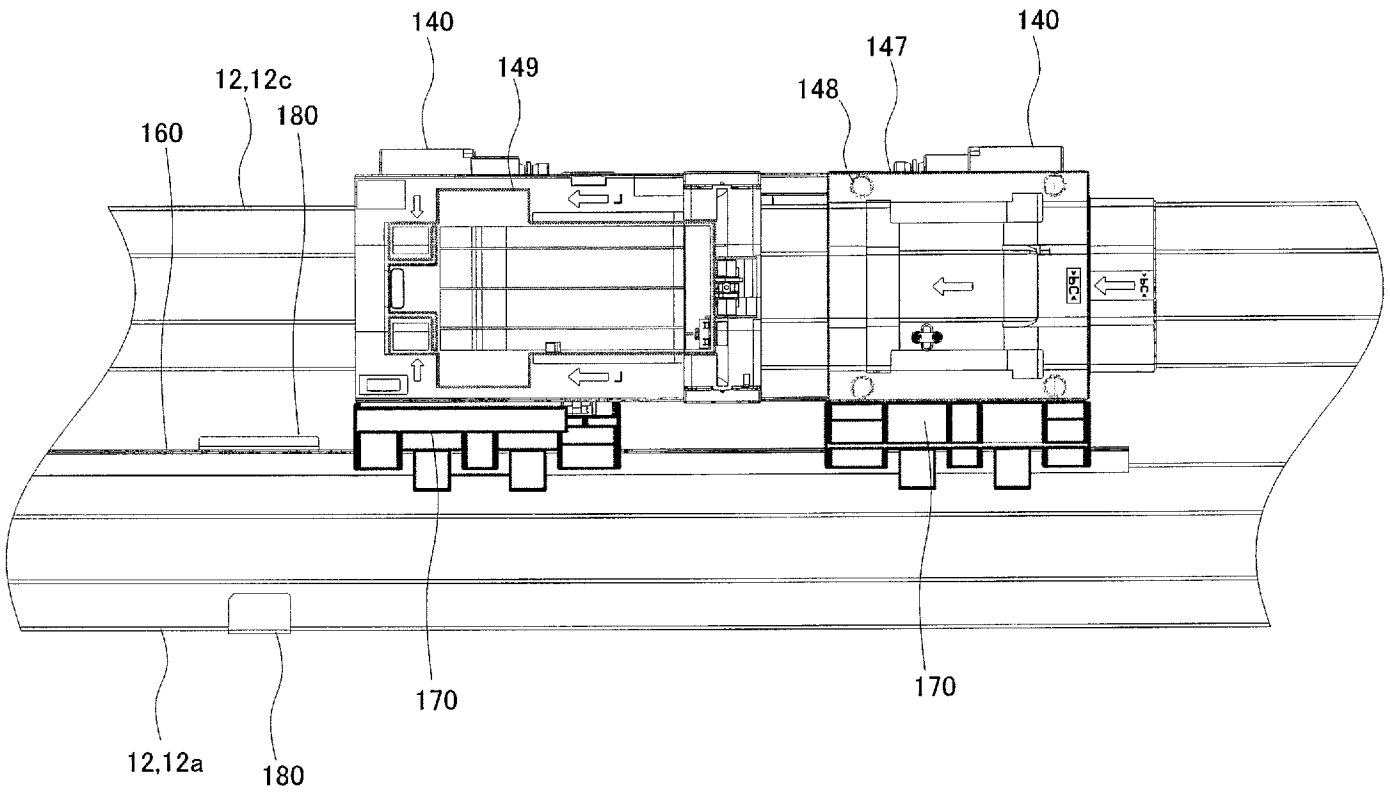
FIG. 54 This is a front view showing the situation in which the bill capturing device is held by the pedestal unit on the frame member, according to one or more embodiments of the present invention.

Further, as shown in FIG. 54, the pedestal unit 170 holds only the bottom part 150 provided on the lower portion of the bill capturing device 140 and does not contact with the path frame 147 and the door 149. Thereby, the path frame 147 can be detached and attached and the door 149 can be opened and closed in the situation in which the bill capturing device 140 is installed. It is possible to easily carry out the working for removing the jamming of the bill 6 in the bill capturing device 140. Further, by passing the cables which are connected with the bill capturing device 140 and the connector 53 through the notch 175 of the pedestal unit 170, it is possible to mount the bill capturing device 140 into the concave part 174 of the pedestal unit 170 without being obstructed by the connector 153 and the cables.

Next, the air volume adjustment of the airstream generation device 14 will be explained.

The control unit 23 of the paper sheet conveyance device 10 adjusts the strength of the airstream generated by the airstream generation device 14 (hereinafter, referred to as the air volume of the airstream generation device 14) according to the position of the conveyance subsidiary body 16 which moves in the conveyance duct 12. Thereby, the conveyance subsidiary body 16 is prevented from being damaged. Further, more stable movement of the conveyance subsidiary body 16 and more stable conveyance of the bill 6 can be provided.

Figure 55:
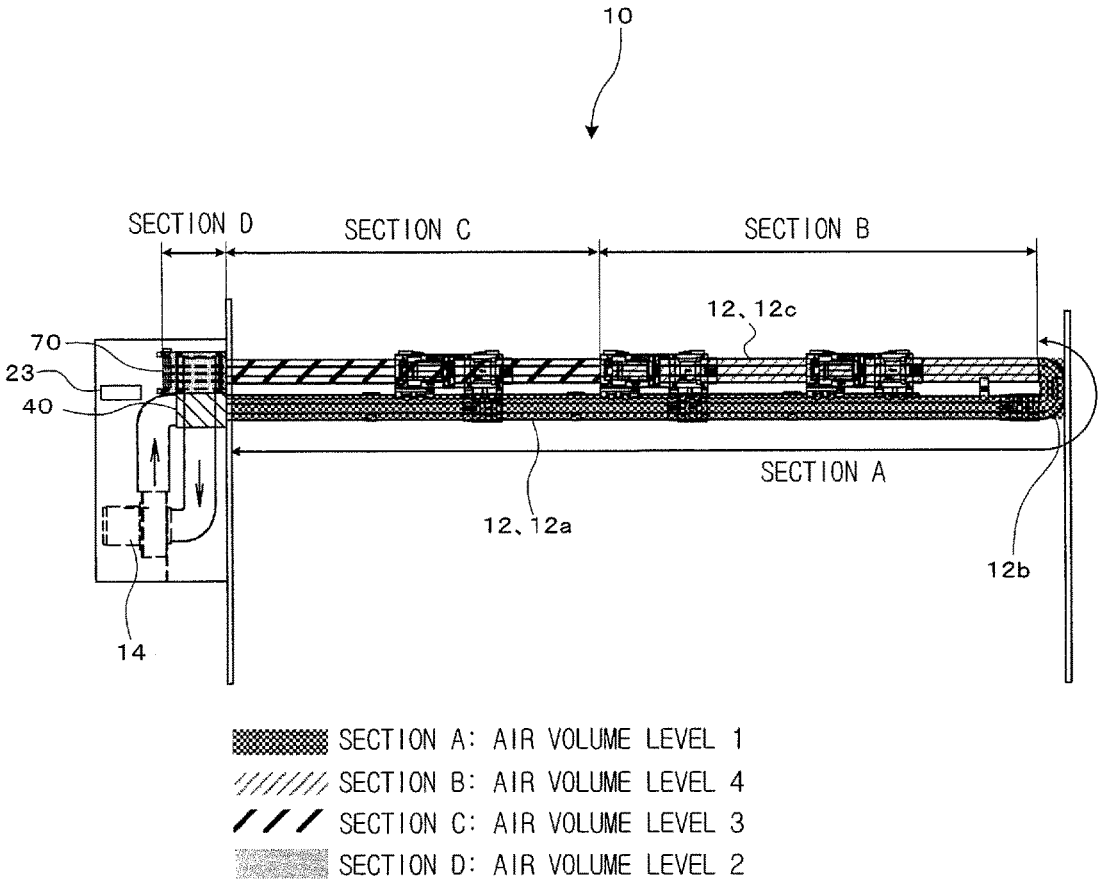
FIG. 55 This is a view showing the relation between each section of the conveyance route and the air volume, according to one or more embodiments of the present invention.
Figure 56:
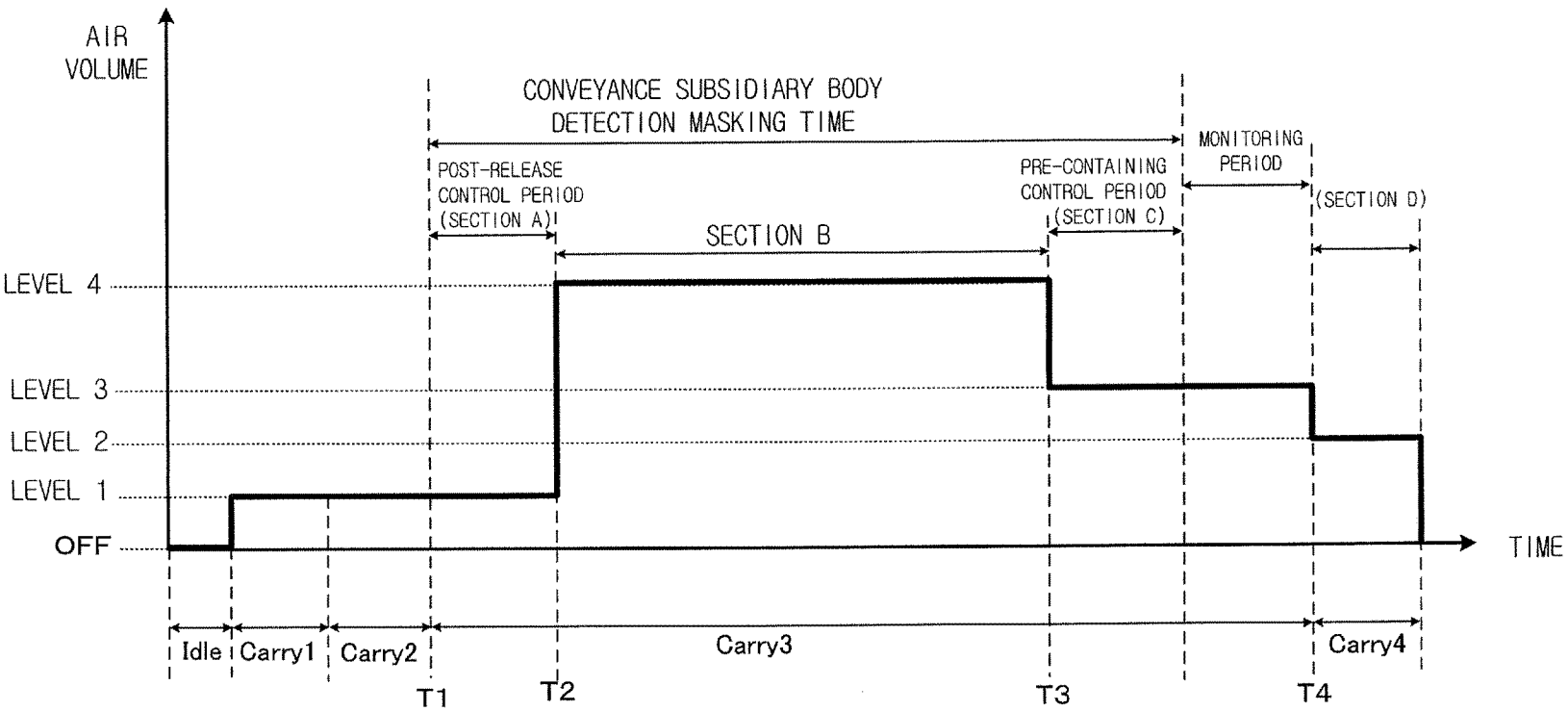
FIG. 56 This is a graph showing the air volume at each timing in the operation for collecting the bill by using the conveyance subsidiary body, according to one or more embodiments of the present invention.

FIG. 55 is a view showing the relation between each section of the conveyance route and the air volume. FIG. 56 is a graph showing the air volume at each timing in the operation for collecting the bill 6 by using the conveyance subsidiary body 16.

In this case, the air volume of the airstream generation device 14 is controlled at five levels: OFF, Level 1, Level 2, Level 3 and Level 4. The air volume satisfies the following relation: OFF<Level 1<Level 2<Level 3<Level 4. The level OFF indicates the situation in which the airstream generation device 14 is stopped.

As shown in FIG. 55 and FIG. 56, the section A in which the air volume is controlled to Level 1, is the first half path 12*a* and the turning portion 12*b*. The section B in which the air volume is controlled to Level 4, is the section from the downstream end of the turning portion 12*b* to the predetermined point in the second half path 12*c* (in this example, the approximate intermediate point of the second half path 12*c*). The section C in which the air volume is controlled to Level 3, is the downstream part of the second half path 12*c*, which follows the section B. The section D in which the air volume is controlled to Level 2, is the section in which the conveyance subsidiary body 16 arrives at the separation/collection device 70 and is separated from the bill 6.

The control unit 23 controls the air volume of the airstream generation device 14 in accordance with the following sequence.

(1) When the bill 6 does not stand by in the bill capturing device 140, the airstream generation device 14 is stopped (the Idle period of FIG. 56).

(2) When the bill 6 stands by in any one of the bill capturing devices 140, the control unit 23 instructs the bill capturing devices 140 to send the bill 6 into the conveyance duct 12. The control unit 23 starts the operation of the airstream generation device 14 and controls the air volume to Level 1 (the Carry 1 period of FIG. 56).

(3) The conveyance subsidiary body insertion device 40 moves the conveyance subsidiary body 16 which stands by in the standby unit 42, to the sending path 41, and executes the conveyance subsidiary body releasing process for sending out the conveyance subsidiary body 16 into the conveyance duct 12 by using the airstream. During the conveyance subsidiary body releasing process, the control unit 23 controls the air volume to Level 1 similar to the above (the Carry 2 period of FIG. 56). In FIG. 56, the conveyance subsidiary body releasing process is finished at the time T1.

(4) While the conveyance subsidiary body 16 is sent out into the conveyance duct 12 and passes through the first half path 12*a* and the turning portion 12*b* of the conveyance duct 12, the control 23 controls the air volume to Level 1 similar to the above (the period from T1 to T2 of FIG. 56 and the section A of FIG. 55).

Because the period from T1 to T2 (hereinafter, referred to as the post-release control period) is varied according to the length of the gaming machine unit facility 2, that is, the length of the first half path 12*a* of the conveyance duct 12, the post-release control period is set for each gaming machine unit facility 2. The control unit 23 maintains the air volume at Level 1 until the set post-release control period elapses since the conveyance subsidiary body 16 is sent out into the conveyance duct 12 by the conveyance subsidiary body insertion device 40.

In case that the conveyance subsidiary body 16 receives the shock by colliding with the inner wall or the like of the turning portion 12*b* in the situation in which the airstream is strong (for example, Level 4), there is some possibility that the conveyance subsidiary body 16 is damaged. Therefore, by controlling the air volume to Level 1 (weak) at least until the conveyance subsidiary body 16 passes through the turning portion 12*b*, the shock which is caused in the turning portion 12*b* is relieved and the conveyance subsidiary body 16 is prevented from being damaged. Further, until the conveyance subsidiary body 16 passes through the turning portion 12*b*, the conveyance subsidiary body 16 moves alone. Because the conveyance subsidiary body 16 does not push the bill 6, the conveyance subsidiary body 16 smoothly moves in the conveyance duct 12 even though the airstream becomes weak by controlling the air volume to Level 1. The jamming is not caused in the conveyance duct 12.

(5) After the conveyance subsidiary body 16 passes through the turning portion 12*b*, the control unit 23 controls the air volume to Level 4 until the conveyance subsidiary body 16 arrives at the position before the separation/collection device 70 provided at the ending portion of the second half path 12*c* by the predetermined distance (the period from T2 to T3 of FIG. 56 and the section B of FIG. 55). Because the conveyance subsidiary body 16 pushes the bill 6 while the conveyance subsidiary body 16 moves in the second half path 12*c*, the airstream is strengthened in this period.

(6) When the conveyance subsidiary body 16 arrives at the position before the separation/collection device 70 by the predetermined distance (T3 of FIG. 56), the control unit 23 controls the air volume so as to be reduced to Level 3. By reducing the air volume from Level 4 to Level 3 at the position before the separation/collection device 70 by the predetermined distance, the conveyance subsidiary body 16 is decelerated. The speed of the conveyance subsidiary body 16 which arrives at the holding unit 81 of the separation unit 80 of the separation/collection device 70 is reduced.

In case that the speed of the conveyance subsidiary body 16 is not reduced, the shock caused when the conveyance subsidiary body 16 collides with the holding unit 81 is large and there is some possibility that the conveyance subsidiary body 16 is damaged. Further, the bill 6 is pushed and folded by the conveyance subsidiary body 16. As a result, the bill 6 is jammed in the separation/collection device 70. Thus, the speed of the conveyance subsidiary body 16 which arrives at the holding unit 81 of the separation/collection device 70 is reduced. Even though the airstream generation device 14 is adjusted, the air volume and the speed of the conveyance subsidiary body 16 cannot be quickly changed. Therefore, the air volume is reduced when the conveyance subsidiary body 16 arrives at the position before the holding unit 81 of the separation/collection device 70 by the predetermined distance.

The time which elapses since the air volume is reduced from Level 4 to Level 3 until the conveyance subsidiary body 16 arrives at the holding unit 81 of the separation/collection device 70, is referred to as the pre-containing control period. The pre-containing control period is constant regardless of the length of the gaming machine unit facility 2 (the length of the second half path 12*c*).

Because the necessary time (the time from T1 to T3 of FIG. 56) which elapses since the conveyance subsidiary body 16 is sent out in the conveyance duct 12 by the conveyance subsidiary body insertion device 40 until the conveyance subsidiary body 16 arrives at the position before the holding unit 81 of the separation/collection device 70 by the predetermined distance is varied according to the length of the gaming machine unit facility 2 (the length of the conveyance duct 12, that is, the length obtained by adding the section A to the section B), the necessary time is previously measured and stored. Then, the control unit 23 changes the air volume to Level 3 when the above necessary time elapses since the conveyance subsidiary body 16 is sent out in the conveyance duct 12 by the conveyance subsidiary body insertion device 40 (T3 of FIG. 56).

(7) Then, when the conveyance subsidiary body 16 arrives at the holding unit 81 of the separation/collection device 70 and is held, the control unit 23 reduces the air volume to Level 2 (T4 of FIG. 56). In this case, the value obtained by adding the predetermined margin time to the necessary time which elapses since the conveyance subsidiary body 16 is sent out in the conveyance duct 12 by the conveyance subsidiary body insertion device 40 until the conveyance subsidiary body 16 arrives at the holding unit 81 of the separation/collection device 70, is set as the conveyance subsidiary body detection masking time. Because the conveyance subsidiary body detection masking time is varied according to the length of the gaming machine unit facility 2 (the length of the conveyance duct 12, that is, the length obtained by adding the lengths of the section A, the section B and the section C), the conveyance subsidiary body detection masking time is set for each gaming machine unit facility 2.

After the conveyance subsidiary body 16 is sent out in the conveyance duct 12 by the conveyance subsidiary body insertion device 40, until the above conveyance subsidiary body detection masking time elapses, the control unit 23 does not execute the operation corresponding to the detection result indicating whether the conveyance subsidiary body 16 is detected by the conveyance subsidiary body detection sensor 63. When the conveyance subsidiary body detection masking time elapses, the control unit 23 executes the operation corresponding to the detection result indicating whether the conveyance subsidiary body 16 is detected by the conveyance subsidiary body detection sensor 63. The reason why until the conveyance subsidiary body detection masking time elapses, the control unit 23 does not execute the operation corresponding to the detection result indicating whether the conveyance subsidiary body 16 is detected by the conveyance subsidiary body detection sensor 63, is as follows. In case that only the bill 6 is moved in the conveyance duct 12 by the airstream prior to the conveyance subsidiary body 16, when the conveyance subsidiary body detection sensor 63 wrongly detects the bill 6 as the conveyance subsidiary body 16, some troubles are caused in the subsequent operation.

In case that the conveyance subsidiary body 16 arrives at the separation/collection device 70 and is held by the holding unit 81 before the conveyance subsidiary body detection masking time elapses, the control unit 23 maintains the air volume at Level 3 until the conveyance subsidiary body detection masking time elapses. When the conveyance subsidiary body detection masking time elapses, the control unit 23 changes the air volume to Level 2 in accordance with the detection of the conveyance subsidiary body 16 by the conveyance subsidiary body detection sensor 63. On the other hand, in case that the conveyance subsidiary body 16 is not held by the holding unit 81 of the separation/collection device 70 (the conveyance subsidiary body detection sensor 63 does not detect the conveyance subsidiary body 16) before the conveyance subsidiary body detection masking time elapses, the control unit 23 monitors whether the conveyance subsidiary body 16 arrives at the holding unit 81 of the separation/collection device 70 in the predetermined period (the monitoring period, for example, 5 seconds) after the conveyance subsidiary body detection masking time elapses.

Then, in case that the conveyance subsidiary body 16 is not held by the holding unit 81 of the separation/collection device 70 (the conveyance subsidiary body detection sensor 63 does not detect the conveyance subsidiary body 16) in the monitoring period, the control unit 23 judges that the conveyance subsidiary body 16 is jammed in the conveyance duct 12. In case that the conveyance subsidiary body detection sensor 63 does not detect the conveyance subsidiary body 16 even though the control unit 23 stops the airstream generation device 14 (in order to remove the jamming by eliminating the load of the airstream in case that the conveyance subsidiary body 16 or the bill 6 is jammed by being pushed by the airstream) and then the airstream generation device 14 is actuated so as to control the air volume to Level 4 (the same level as the section B), the conveyance subsidiary body jamming error is announced and the airstream generation device 14 is stopped.

In case that the conveyance subsidiary body 16 is held by the holding unit 81 of the separation/collection device 70 (the conveyance subsidiary body detection sensor 63 detects the conveyance subsidiary body 16) in the monitoring period, the control unit 23 changes the air volume to Level 2 without waiting for the lapse of the monitoring period.

The period (T1 to T4) which elapses since the conveyance subsidiary body 16 is sent out in the conveyance duct 12 until the conveyance subsidiary body 16 arrives at the holding unit 81 of the separation/collection device 70 and the air volume is changed to Level 2, is referred to as the Carry 3 period.

(8) When the bill 6 separated and collected by the separation/collection device 70 is output from the rear end of the inner unit 90 and is sent to the bill conveyance unit 22, the control unit 23 switches off the airstream generation device 14. The period which elapses since the air volume is reduced to Level 2 until the airstream generation device 14 is stopped, is referred to as the Carry 4 period. The output of the bill 6 from the rear end of the inner unit 90 and the sending of the bill 6 to the bill conveyance unit 22 are detected by the separation/collection device outlet sensor 122 which is provided on the inlet port of the bill conveyance unit 22 (See FIG. 34).

Next, the relation between the separation/collection operation of the separation/collection device 70 and the airstream will be explained.

Figure 57:
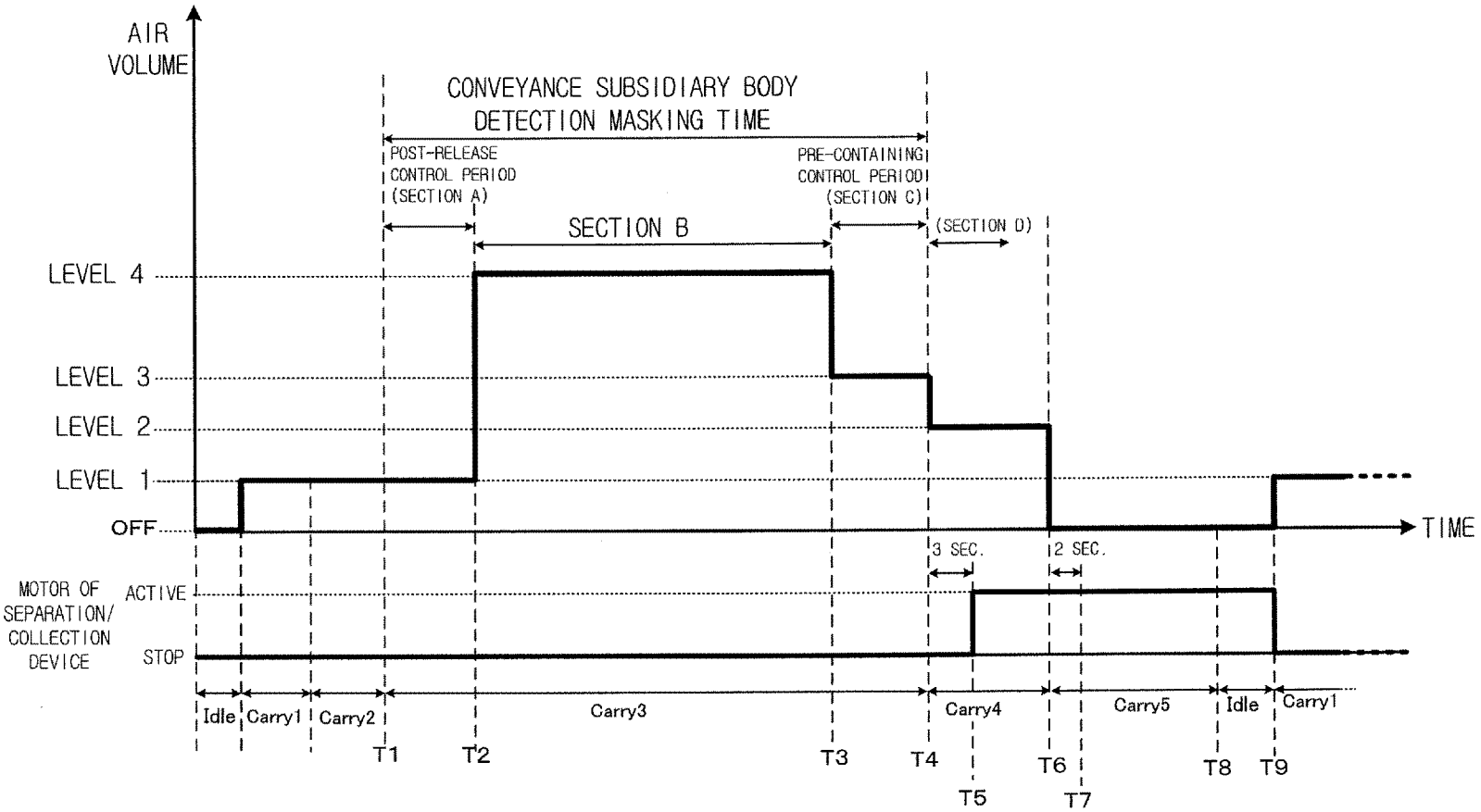
FIG. 57 This is a graph showing the air volume at each timing in the operation for collecting the bill by using the conveyance subsidiary body, and the operation timing of the separation/collection device, according to one or more embodiments of the present invention.

FIG. 57 is a graph showing the air volume at each timing in the operation for collecting the bill 6 by using the conveyance subsidiary body 16, and the operation timing of the separation/collection device 70. The paper sheet conveyance device 10 is operated in accordance with the following sequence [a] to [d].

[a] In FIG. 57, the operation from the Idle period to the end of the Carry 3 period is the same as that of FIG. 56. The explanation thereof is omitted. From the Idle period to the end of the Carry 3 period, the operation of the separation/collection device 70 is stopped. In FIG. 57, before the conveyance subsidiary body detection masking time elapses, the conveyance subsidiary body 16 arrives at the holding unit 81 of the separation/collection device 70.

[b] As explained in the above-described (7), when the conveyance subsidiary body 16 is held by the holding unit 81 of the separation/collection device 70 and the conveyance subsidiary body detection sensor 63 of the separation/collection device 70 detects the conveyance subsidiary body 16 (T4 of FIG. 57), the control unit 23 changes the air volume of the airstream generation device 14 to Level 2.

Further, after the predetermined time (for example, 3 seconds) elapses since the control for reducing the air volume to Level 2 is started (T5 of FIG. 57), the conveyance belts 98 are actuated by the separation conveyance actuating unit 64 of the inner unit 90 of the separation/collection device 70. The bill 6 existing in the inner unit 90 clings to the conveyance belts 98 by the airstream sucked from the sucking port 75, and is conveyed toward the rear end of the inner unit 90 by the conveyance belts 98 (See FIG. 31 and the like). The strength of the airstream sucked from the sucking port 75 depends on the air volume of the airstream generation device 14.

Even though the airstream generation device 14 is controlled so as to reduce the air volume to Level 2, the time lag from the control of the airstream generation device 14 to the actual reduction of the air volume is caused. Therefore, in case that the conveyance belts 98 are actuated by the separation conveyance actuating unit 64 immediately after the conveyance subsidiary body 16 is detected by the conveyance subsidiary body detection sensor 63, the bill 6 clings to the conveyance belts 98 in the situation in which the air volume is not reduced. In case that the airstream is strong, the bill 6 clings to the conveyance belts 98 too strongly. When the bill 6 is conveyed by the conveyance belts 98 in this situation, as explained in FIG. 33, there is some possibility that the jamming of the bill 6 is caused in the inner unit 90.

Then, after the predetermined time (in this case, 3 seconds) elapses since the conveyance subsidiary body detection sensor 63 of the separation/collection device 70 detects the conveyance subsidiary body 16 (T4: since the air value is controlled to Level 2) (T5 of FIG. 57), the actuation of the conveyance belts 98 is started. Because the air volume is sufficiently reduced by waiting for the above predetermined time, the bill 6 which clings to the conveyance belts 98 at the suitable strength is conveyed. Thereby, it is possible to avoid the jamming of the bill 6 in the inner unit 90 without clinging to the conveyance belts 98 too strongly.

[c] As explained in the above-described (8), when the bill 6 separated and collected by the separation/collection device 70 is output from the rear end of the inner unit 90 and is sent to the bill conveyance unit 22, the control unit 23 switches off the airstream generation device 14 (T6 of FIG. 57). The period from T4 to T6 is referred to as the Carry 4 period.

In detail, when the separation/collection device outlet sensor 122 (See FIG. 34) provided on the inlet port of the bill conveyance unit 22 detects the bill 6, the airstream generation device 14 is stopped. Further, after the predetermined time (for example, 2 seconds) elapses since the bill 6 is detected by the separation/collection device outlet sensor 122 (T7 of FIG. 57), the operation for transferring the conveyance subsidiary body 16 held by the holding unit 81 of the separation/collection device 70 to the standby unit 42 of the conveyance subsidiary body insertion device 40 is started. In FIG. 57, at T8, the conveyance subsidiary body 16 is moved to the standby unit 42 of the conveyance subsidiary body insertion device 40 and the above transfer is finished. The period from T6 to T8 is referred to as the Carry 5 period.

Figure 58:
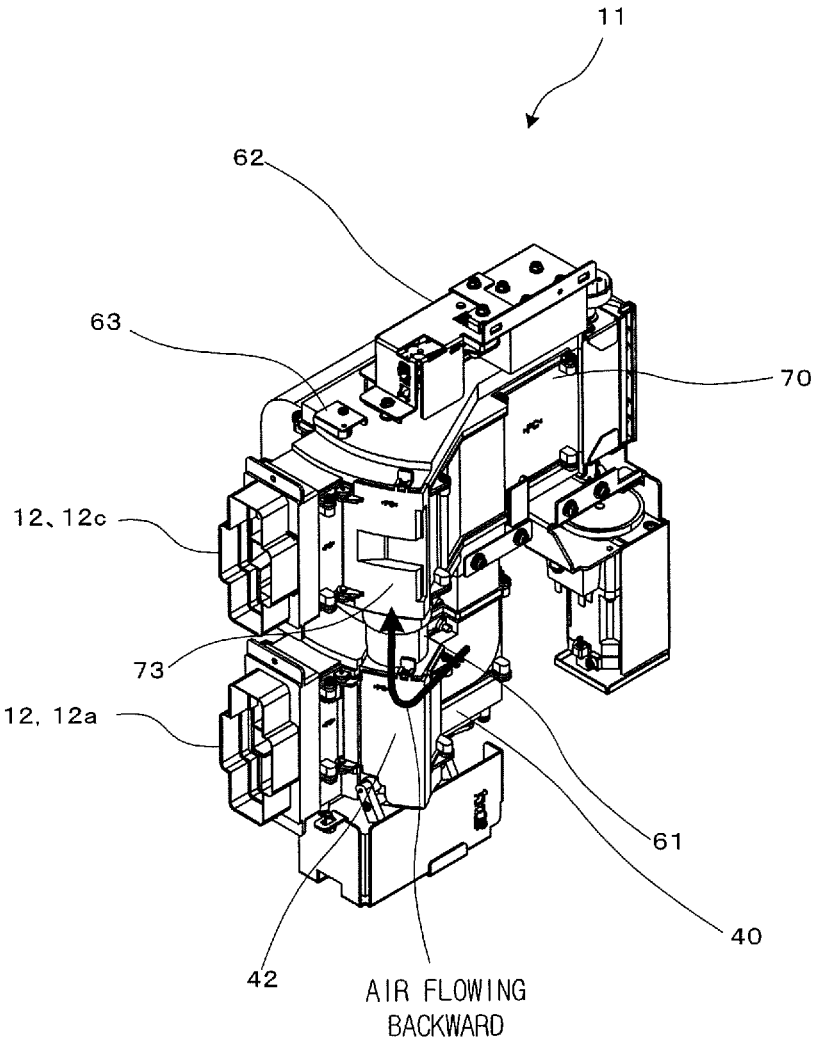
FIG. 58 This is a view showing the situation in which the airstream flows backward to the discharge position in the guide path, according to one or more embodiments of the present invention.

When the bill 6 is detected by the separation/collection device outlet sensor 122, the airstream generation device 14 is stopped. However, even though the airstream generation device 14 is stopped, the air volume is not quickly reduced. Therefore, when the separation unit 80 of the separation/collection device 70 is rotated from the collection position on which the holding unit 81 approaches to the ending portion of the conveyance duct 12 to the discharge position on which the holding unit 81 enters the expanding chamber 73 immediately after the airstream generation device 14 is stopped, as shown in FIG. 58, the airstream flows upwardly from the standby unit 42 of the conveyance subsidiary body insertion device 40 to the discharge position in the expanding chamber 73 via the guide path 61. As a result, the conveyance subsidiary body 16 is floated without dropping into the standby unit 42 and the jamming of the conveyance subsidiary body 16 is caused.

Therefore, after the predetermined time (for example, 2 seconds) elapses since the separation/collection device outlet sensor 122 detects the bill 6 (the airstream generation device 14 is stopped, T6 of FIG. 57), the operation for transferring the conveyance subsidiary body 16 is started. Thereby, the holding unit 81 of the separation unit 80 of the separation/collection device 70 is rotated from the collection position to the discharge position in the situation in which the airstream is stopped. As a result, the conveyance subsidiary body 16 is securely returned to the standby unit 42, and the jamming of the conveyance subsidiary body 16 can be avoided.

[d] The actuation of the conveyance belts 98, which is carried out by the separation conveyance actuating unit 64 of the inner unit 90 is stopped when the bill 6 is completely discharged from the bill conveyance unit 22 toward the bill containing unit 21 without being jammed in midstream (T9 of FIG. 57). Specifically, in addition to the separation/collection device outlet sensor 122 of the bill conveyance unit 22, the bill conveyance route sensor for detecting the jamming of the bill in the bill conveyance route of the bill conveyance unit 22, the bill conveyance outlet sensor which is provided near the bill discharging port of the bill conveyance unit 22 and which detects the bill discharged from the bill conveyance unit 22, and the like are provided. When the control unit 23 confirms that the bill 6 is discharged from the bill conveyance unit 22 toward the bill containing unit 21 without being jammed in midstream in accordance with the detection of the bill 6 by these sensors, the control unit 23 stops the actuation of the conveyance belts 98, which is carried out by the separation conveyance actuating unit 64 of the inner unit 90.

When the conveyance subsidiary body 16 is completely transferred to the standby unit 42 of conveyance subsidiary body insertion device 40, there are some cases in which the next bill 6 stands by in the bill capturing device 140. In this case, the control unit 23 successively carries out the process for sending out the next conveyance subsidiary body 16. Therefore, when the operation (Carry 1) relating to the next conveyance subsidiary body 16 is carried out, there are some cases in which the bill 6 has not been discharged from the bill conveyance unit 22 toward the bill containing unit 21 yet. In this case, the actuation of the conveyance belts 98, which is carried out by the separation conveyance actuating unit 64 of the inner unit 90, is continued until the initial period of the Carry 1 relating to the next conveyance subsidiary body 16.

Then, by returning to [a], the above operation is repeated.

Next, the relation between the material of the conveyance subsidiary body 16 and the material of the turning portion 12*b* of the conveyance duct 12 will be explained.

For the turning portion 12*b*, the material which is hard to be worn down (for example, PC: polycarbonate) is used. For the conveyance subsidiary body 16, the material which is easy to be worn down (for example, ABS: acrylonitrile butadiene styrene) is used.

When the conveyance subsidiary body 16 passes through the turning portion 12*b*, the conveyance subsidiary body 16 and the turning portion 12*b* are worn down by the shock caused by contacting the conveyance subsidiary body 16 with the turning portion 12*b*. In this case, by making the turning portion 12*b* of the material which is hard to be worn down as compared with the material of the conveyance subsidiary body 16, the turn portion 12*b* is hard to be worn down. The exchange frequency of the turning portion 12*b* which is difficult to be exchanged can be reduced. Further, in case that the turning portion 12*b* is hard to be worn down, the situation in which the conveyance subsidiary body 16 is suitably guided in the turning portion 12*b* can be maintained long. Therefore, it is possible to avoid the jamming of the conveyance subsidiary body 16. Because the conveyance subsidiary body 16 can be exchanged easily, there is no problem even though the conveyance subsidiary body 16 is made of the material which is worn down more easily than the material of the turning portion 12*b*. With respect to the material, the material of the turning portion 12*b* may be worn down more easily than that of the conveyance subsidiary body 16.

As described above, embodiments of the invention are explained by using the drawings. However, the present invention is not limited to the above embodiments. In the present invention, various modifications of the above embodiments or the addition of various functions or the like to the embodiments can be carried out without departing from the invention.

In the one or more embodiments described above, the number of the conveyance belts 98 is three. However, the number of the conveyance belts 98 may be optional besides three. Further, in case that the belt having the air permeability, such as the conveyance belt having a large number of the air vents, the reticulate conveyance belt or the like, is used, one wider belt can be used.

In the one or more embodiments described above, in the inner unit 90 of the separation/collection device 70, the ribs 110 are provided around the upstream half portion of the path part 96, and the conveyance belts 98 are bridged on the downstream side of the ribs 110. However, it is only necessary that on the upstream portion of the path part 96, the ribs 110 prevents the bill 6 from clinging and on the downstream side of the ribs 110, the bill 6 clings to the conveyance belt. For example, the conveyance belts 98 may be also provided on the upstream portion of the path part 96, and in the upstream portion, the ribs 110 may project more upwardly than the conveyance belts or the conveyance belts may be covered.

The inner unit 90 is detachably attached to the outer frame unit 71. However, the outer frame unit 71 and the inner unit 90 may be unitedly formed.

In the one or more embodiments described above, the path part 96 is formed shortly so as to be slightly longer than the length of the bill 6 in the conveyance direction. However, the path part 96 may be formed longer. Also in this case, the length L2 from the upstream end of the path part 96 (near the passing port 84 of the separation unit 80) to the conveyance belts 98 may be the length illustrated in FIG. 23, or may be set within the range from ⅓ to ⅘ of the length of the bill 6 in the conveyance direction.

The number of the ribs 110 and the opposing ribs 112 provided in the inner unit 90 is merely an example. The above number may be increased or decreased.

In the one or more embodiments described above, the separation/collection device 70 and the conveyance subsidiary body insertion device 40 are unitedly configured as the bill separation/conveyance subsidiary body circulation device 11 so as to overlap the separation/collection device 70 with the conveyance subsidiary body insertion device 40 from above. However, the conveyance subsidiary body insertion device 40 and the separation/collection device 70 may be separately provided. For example, the conveyance subsidiary body 16 collected by the separation/collection device 70 may be stored in the collection container or the like, and by carrying the collection container to the installation place of the conveyance subsidiary body insertion device 40, the conveyance subsidiary body 16 may be sent out from the collection container to the standby position of the conveyance subsidiary body insertion device 40.

Further, the gaming machine unit facility 2 is not limited to the facility containing the pachinko machine 4 and the game ball lending device 3 which are illustrated in the one or more embodiments described above, and may be the facility containing a medal lending device and a slot machine, or the like.

In the one or more embodiments described above, in the separation/collection device 70, by rotating the separation unit 80, the separation unit 80 is moved between the collection position and the discharge position. The method for moving the separation unit 80 is not limited to the rotation thereof. The conveyance subsidiary body 16 which is contacted and stopped may be discharged outside by the airstream from the conveyance route. For example, the separation unit 80 which holds the conveyance subsidiary body 16 stopped on the collection position may be straightly moved sideward. Similarly, the method for moving the conveyance subsidiary body 16 which stands by in the standby unit 42 to the sending path 41, is not limited to the method in which the holding portion 43*a* of the movable containing unit 43 is rotated. The holding portion 43*a* may be straightly reciprocated between the standby unit 42 and the sending path 41.

Each shape of the auxiliary frame 160, the pedestal unit 170 and the hook member 180 is not limited to the shape illustrated in the one or more embodiments described above. Another shape may be adopted as long as each member has the corresponding function.

The hook member 180 may be formed so as to be hung in both one groove portion 162 and the other groove portion 162 of the auxiliary frame 160. Thereby, the hook member 180 may hold the conveyance duct 12 (the first half path 12*a*) from the both of the front face and the rear face thereof.

Further, the shape of the conveyance subsidiary body 16 is not limited to the shape illustrated in the one or more embodiments described above. For example, the shape thereof may be a pillar shape having a rectangular cross section, a polygon or the like. Further, the conveyance subsidiary body 16 has a shape which is symmetrical with respect to the center line in Y direction. However, the conveyance subsidiary body 16 may have the shape which is not symmetrical with respect to Y direction.

In the one or more embodiments described above, the timing at which the air volume is changed at the boundary between the section A and the section B, the boundary between the section B and the section C, and the like is managed in accordance with the elapse time from the finish of the process for releasing the conveyance subsidiary body 16. However, by providing sensors, such as an optical sensor for detecting the passing of the conveyance subsidiary body 16 at suitable positions in the conveyance duct 12, or the like, the position of the conveyance subsidiary body 16 may be recognized in accordance with the detection of the conveyance subsidiary body 16 by using the above sensors to control the air volume at a desired timing.

In the one or more embodiments described above, the bill 6 is illustrated as the paper sheet. Another type of paper sheet, such as a ticket, a card, or the like, may be used. Further, the shape of the paper sheet is not limited to a rectangle. Further, the paper sheet conveyance device 10 is not limited to one which is installed in the gaming machine unit facility 2. For example, the paper sheet conveyance device may be configured so as to circulate the paper sheet in a plurality of gaming machine unit facilities 2 of an amusement hall, a management room or the like. The management room is separated from the amusement hall in which the game machines and the like are installed, and is a room in which a surveillance monitor for displaying the information obtained from a management device for managing game machines and the like and from surveillance cameras for monitoring the amusement hall, and the bill housing stacker for containing the bills inserted into the game ball lending devices for lending the balls, are provided. In the management room, a manager of the amusement hall, employees and the like manage the whole of the amusement hall.

In the one or more embodiments described above, the example in which only one paper sheet is conveyed is shown. However, in case that the conveyance subsidiary body 16 is inserted in the situation in which a plurality of bills 6 exist in the conveyance duct 12, it is possible to convey a plurality of bills 6 at once. For example, when the conveyance subsidiary body 16 is sent out from the conveyance subsidiary body insertion device 40 in the situation in which the bill 6 is stopped in the capturing finish position of each bill capturing device 140 in the second half path 12*c* of the conveyance duct 12, the number of the bills 6 to be pushed by the conveyance subsidiary body 16 sequentially increases during the movement of the conveyance subsidiary body 16 in the first half path 12*a*. Therefore, all of the bills 6 can be conveyed. The large conveyance force for conveying a plurality of bills is secured because the conveyance subsidiary body 16 is formed in the shape for almost closing the cross section of the conveyance duct 12 and then the clinging of the bill 6 is reduced, and because the area in which the airstream is received is large due to the expanding portions 33. Further, because the conveyance subsidiary body 16 has an undeformed pillar shape, it is possible to execute the conveyance process for conveying a large number of paper sheets at once, which cannot be realized by impellers, or the like.

In the one or more embodiments described above, the cross section of the conveyance duct 12 is a substantial rectangle. Another shape, such as a circle, an ellipse or the like, may be adopted. However, it is possible to form the conveyance subsidiary body in the shape corresponding to the inner edge shape of the conveyance duct 12 and to close almost the whole cross section thereof. Further, by providing a plurality of ribs, the substantial width of the path for the paper sheet may be narrowed.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

2 gaming machine unit facility
3 game ball lending device
4 game machine (pachinko machine)
5 bill housing stacker
6 bill
10 paper sheet conveyance device
11 bill separation/conveyance subsidiary body circulation device
12 conveyance duct
12*a* first half path
12*b* turning portion
12*c* second half path
13*d* rib
13*b* arc part
13*c* straight part
14 airstream generation device
14*a* air blowing path
14*b* air sucking path
14*c* motor
16 conveyance subsidiary body
16*a* head portion
16*b* neck portion
16*c* large-diameter portion
16*d* narrow portion
18 connection unit
21 bill containing unit
22 bill conveyance unit
23 control unit
24 power supply unit
31 wall portion
32 side wall portion
33 expanding portion
34 separation wall
40 conveyance subsidiary body insertion device
41 sending path
41A upper sending path
41B lower sending path
42 standby unit
43 movable containing unit
43*a* holding portion
43*b* support plate
43*d* shaft projection
43*e* shaft arm portion
43*f* guide portion
43*g* air blowing hole
43*h* air blowing hole
44 second actuating unit
45 conveyance duct connection port
46 blowing path connection port
47 shaft hole
48 conveyance subsidiary body sensor
49 guide rail
49A upper guide rail
49B middle guide rail
49C lower guide rail
50 duct
51 posture correction mechanism
52 bearing hole
61 guide path
62 first actuating unit
63 conveyance subsidiary body detection sensor
64 separation conveyance actuating unit
70 separation/collection device
71 outer frame unit
71A frame part
71B upper cover part
71C side wall duct part
72 conveyance duct connection port
73 expanding chamber
74 dropping opening
75 sucking port
77 bill sucking prevention wall
78 shaft hole
80 separation unit
81 holding unit
82 supporting unit
83 guide rail
84 passing port
85 projection shaft
86 discharging opening
90 inner unit
91 inner unit main body portion
92 inner unit cover portion
92*a* opposing wall
92*b* upper face
92*c* bottom face
93 basic part
94 first side wall
94*a* opening
95 partition wall
95*a* opening
96 path part
97*a* downstream pulley
97*b* upstream pulley
98, 98B conveyance belt
99 movable frame
100*a* downstream rotation shaft
100*b* upstream rotation shaft
101 discharge roller
102 opposing discharge roller
103 rotation shaft

104 transmission gear
105 transmission gear
106 handle
107 bill discharge path
108 spring
109 air path
110 rib
112 opposing rib
120 conveyance belt
122 separation/collection device outlet sensor
140, 140A, 140B bill capturing device
141 path part
143 main body part
144 insertion port
145 standby path
146 conveyance roller
147 path frame
148 nighlatch
149 door
150 bottom part
151 bill receiving port
153 connector
160 auxiliary frame
161 flat portion
162 groove portion
163 project portion
163*a* space
164 connection member
164*a* stop portion
166 attachment clasp
170 pedestal unit
171 outer engaging portion
172 pawl portion
174 concave part
174*a* wall
175 notch
180 hook member
181 hung part
182 arm part
182*a* holding portion
190 attachment clasp
191 base part
192 upper arm part
193 lower arm part
194 bill capturing device holding clasp
195 auxiliary frame holding clasp
Dx distance between the reference plane parts of the conveyance duct
Dy inside dimension of the conveyance duct in Y direction
F extending direction of the conveyance duct
K direction in which the bill capturing device is pushed from the rear surface of the game ball lending device
W path width
X path width direction of the conveyance duct
Y height direction of the conveyance duct

The invention claimed is:

1. A paper sheet conveyance device for conveying a paper sheet by an airstream generated in a tubular conveyance path, the paper sheet conveyance device comprising:

a frame member that supports the conveyance path and is provided along an installation route of the conveyance path;

pedestal units attached to the frame member and that slide along a longitudinal direction of the frame member; and a plurality of paper sheet capturing devices, wherein:

each of the plurality of paper sheet capturing devices is provided in the conveyance path and sends out one of the plurality of paper sheets to be conveyed into the conveyance path, each of the plurality of paper sheet capturing devices comprises a path part that forms a part of the conveyance path, the conveyance path is formed by joining a plurality of conveyance ducts and the path parts of the paper sheet capturing devices, each of the pedestal units is provided for one of the paper sheet capturing devices and holds the one of the paper sheet capturing devices, each of the plurality of paper sheet capturing devices conveys bills discharged from one of a plurality of play media lending devices provided in a game machine unit facility by capturing the bills in the conveyance path extending in a longitudinal direction of the game machine unit facility, the frame member is attached and fixed in the game machine unit facility along the longitudinal direction of the game machine unit facility, the plurality of paper sheet capturing devices are provided on positions corresponding to the plurality of play media lending devices, each of the pedestal units slides to a position corresponding to one of the plurality of paper sheet capturing devices and holds the one of the paper sheet capturing devices, the frame member and the plurality of paper sheet capturing devices are held by a plurality of holding members at holding positions, each of the plurality of holding members being attached to a rear surface portion of one of the play media lending devices, and a distance from each rear surface portion to each corresponding holding position is adjusted by each of the corresponding holding members.

2. The paper sheet conveyance device of claim 1, wherein in each of the plurality of paper sheet capturing devices, a side surface portion is openable, and each of the pedestal units holds only a lower portion of each corresponding paper sheet capturing device and does not prevent the side surface portion from being opened.

3. The paper sheet conveyance device of claim 1, wherein the paper sheet is conveyed when a rear edge of the paper sheet is pushed by a conveyance subsidiary body that moves in the conveyance path by receiving the airstream.

4. A paper sheet conveyance device for conveying a paper sheet by an airstream generated in a tubular conveyance path, the paper sheet conveyance device comprising:

a frame member that supports the conveyance path and is provided along an installation route of the conveyance path;

pedestal units attached to the frame member and that slide along a longitudinal direction of the frame member; and a plurality of paper sheet capturing devices, wherein:

each of the plurality of paper sheet capturing devices is provided in the conveyance path and sends out one of the plurality of paper sheets to be conveyed into the conveyance path, each of the plurality of paper sheet capturing devices comprises a path part that forms a part of the conveyance path, the conveyance path is formed by joining a plurality of conveyance ducts and the path parts of the paper sheet capturing devices, each of the pedestal units is provided for one of the paper sheet capturing devices and holds the one of the paper sheet capturing devices, and the conveyance path comprises:

a first half path;

a turning portion that turns at an end edge portion of the first half path; and a second half path extending along the first half path above the first half path after the conveyance path is turned at the turning portion, the first half path is formed by the conveyance ducts, the second half path is formed by joining the path parts of the paper sheet capturing devices and the conveyance ducts, the frame member is provided between the first half path and the second half path, each of the pedestal units is provided on an upper surface of the frame member and holds one of the plurality of paper sheet capturing devices from below, a hook member is hung from the frame member, and the first half path is held by the hook member under the frame member.

5. The paper sheet conveyance device of claim 4, wherein each of the plurality of paper sheet capturing devices conveys bills discharged from each of a plurality of play media lending devices provided in a game machine unit facility by capturing the bills in the conveyance path extending in a longitudinal direction of the game machine unit facility, the frame member is attached and fixed in the game machine unit facility along the longitudinal direction of the game machine unit facility, each of the plurality of paper sheet capturing devices is provided at positions corresponding to the plurality of play media lending devices, and each of the pedestal units slides to a position corresponding to one of the plurality of paper sheet capturing devices and holds the one of the plurality of paper sheet capturing devices.

6. The paper sheet conveyance device of claim 5, wherein the frame member and the plurality of paper sheet capturing devices are held by a plurality of holding members, each of the plurality of holding members being attached to a rear surface portion of one of the play media lending devices.

7. The paper sheet conveyance device of claim 4, wherein in each of the plurality of paper sheet capturing devices, a side surface portion is openable, and each of the pedestal units holds only a lower portion of each corresponding paper sheet capturing device and does not prevent the side surface portion from being opened.

8. The paper sheet conveyance device of claim 4, wherein the paper sheet is conveyed when a rear edge of the paper sheet is pushed by a conveyance subsidiary body that moves in the conveyance path by receiving the airstream.

* * * * *